US010968660B2

(12) United States Patent
Maiga et al.

(10) Patent No.: US 10,968,660 B2
(45) Date of Patent: Apr. 6, 2021

(54) ELECTRONIC DOOR LOCK

(71) Applicant: PassiveBolt, Inc., Ann Arbor, MI (US)

(72) Inventors: Kabir Zachary Maiga, Superior Township, MI (US); Philip Michael Johnson, Plymouth, MI (US); Simon Forster, Cologne (DE)

(73) Assignee: PassiveBolt, Inc., Ann Arbor, MI (US)

( * ) Notice: Subject to any disclaimer, the term of this patent is extended or adjusted under 35 U.S.C. 154(b) by 0 days.

(21) Appl. No.: 16/806,655

(22) Filed: Mar. 2, 2020

(65) Prior Publication Data

US 2020/0265662 A1 Aug. 20, 2020

Related U.S. Application Data

(63) Continuation-in-part of application No. PCT/US2019/020028, filed on Feb. 28, 2019.
(Continued)

(51) Int. Cl.
*E05B 17/20* (2006.01)
*G07C 9/00* (2020.01)
(Continued)

(52) U.S. Cl.
CPC ..... *E05B 17/2034* (2013.01); *E05B 15/102* (2013.01); *E05B 17/2007* (2013.01);
(Continued)

(58) Field of Classification Search
CPC ..... E05B 17/2007; E05B 17/203; E05B 17/2034; E05B 17/2069; E05B 17/2073; E05B 47/00; E05B 47/0001; E05B 47/02; E05B 47/06; E05B 47/0603; E05B 47/0607; E05B 2047/0048; E05B 2047/005; E05B 2047/0052; E05B 2047/0056; E05B 15/10;
(Continued)

(56) References Cited

U.S. PATENT DOCUMENTS 697,599 A * 4/1902 Barrett ..... E05B 55/00 70/150
5,134,870 A 8/1992 Uyeda et al.
(Continued)

FOREIGN PATENT DOCUMENTS

CN 203838826 U 9/2014
GB 2516218 A 7/2013
(Continued)

OTHER PUBLICATIONS

International Search Report and Written Opinion in PCT/US2019/020028, dated May 30, 2019, 8 pages.

*Primary Examiner* — Christopher J Boswell
(74) *Attorney, Agent, or Firm* — Young Basile Hanlon & MacFarlane, P.C.

(57) ABSTRACT

An electronic door lock includes a controller, a first touch sensor, and a lock operator. The first touch sensor detects touch on an exterior an exterior side of a door. The lock operator is selectively operated by the controller to unlock a deadbolt according to the touch detected by the first touch sensor. The electronic door lock is located on an interior side of the door. The first touch sensor may be electrically coupleable to a deadbolt lock for the deadbolt to act as an electrode of the touch sensor. The first touch sensor may detect the touch capacitively.

20 Claims, 37 Drawing Sheets

Related U.S. Application Data

(60) Provisional application No. 62/957,199, filed on Jan. 4, 2020, provisional application No. 62/789,190, filed on Jan. 7, 2019, provisional application No. 62/636,290, filed on Feb. 28, 2018, provisional application No. 62/636,292, filed on Feb. 28, 2018, provisional application No. 62/636,293, filed on Feb. 28, 2018.

(51) Int. Cl.

| | |
|---|---|
| ***E05B 47/06*** | (2006.01) |
| ***E05B 47/00*** | (2006.01) |
| ***E05B 15/10*** | (2006.01) |
| ***E05B 47/02*** | (2006.01) |

(52) U.S. Cl.
CPC ..... *E05B 17/2073* (2013.01); *E05B 47/0001* (2013.01); *E05B 47/02* (2013.01); *E05B 47/06* (2013.01); *E05B 47/0607* (2013.01); *G07C 9/00174* (2013.01); *E05Y 2900/132* (2013.01)

(58) Field of Classification Search
CPC ..... E05B 15/102; G07C 9/00174; G07C 9/00563; E05C 1/00; E05C 1/004; E05C 1/08; E05C 1/12
See application file for complete search history.

(56) References Cited

U.S. PATENT DOCUMENTS

| | | | | |
|---|---|---|---|---|
| 5,199,288 | A | 4/1993 | Merilainen et al. | |
| 5,666,830 | A | 9/1997 | Litvin | |
| 5,758,527 | A | 6/1998 | Crepinsek | |
| 5,839,307 | A | 11/1998 | Field et al. | |
| 6,032,500 | A | 3/2000 | Collard, Jr. et al. | |
| 7,050,897 | B2 | 5/2006 | Breed | |
| 7,775,072 | B2 * | 8/2010 | Pullmann | E05B 15/101 292/144 |
| 7,908,896 | B1 | 3/2011 | Olson et al. | |
| 8,773,263 | B2 | 7/2014 | Thibault | |
| 9,024,759 | B2 * | 5/2015 | Uyeda | G07C 9/00182 340/542 |
| 9,142,108 | B2 | 9/2015 | Seelman | |
| 9,322,194 | B2 * | 4/2016 | Cheng | H04N 7/186 |
| 9,340,999 | B2 | 5/2016 | Romero | |
| 9,390,572 | B2 | 7/2016 | Almomani | |
| 9,406,181 | B2 | 8/2016 | Almomani et al. | |
| 9,424,700 | B2 * | 8/2016 | Lovett | G06F 3/0416 |
| 9,546,504 | B2 * | 1/2017 | Overgaard | E05B 47/02 |
| 9,670,696 | B2 | 6/2017 | Chong | |
| 9,697,302 | B2 | 7/2017 | Nguyen et al. | |
| 9,719,278 | B2 * | 8/2017 | Taylor | E05B 47/0603 |
| 9,822,553 | B1 * | 11/2017 | Ho | E05B 47/0012 |
| 9,871,399 | B2 | 1/2018 | Mittleman | |
| 9,890,565 | B2 * | 2/2018 | Shiu | E05B 63/08 |
| 10,240,365 | B2 * | 3/2019 | Almomani | G07C 9/00309 |
| 10,662,692 | B2 | 5/2020 | Brueckner | |
| 10,663,479 | B2 | 5/2020 | He | |
| 2003/0160681 | A1 | 8/2003 | Menard et al. | |
| 2004/0237609 | A1 | 12/2004 | Hosselet | |
| 2005/0179517 | A1 | 8/2005 | Harms et al. | |
| 2009/0273440 | A1 | 11/2009 | Marschalek et al. | |
| 2013/0176107 | A1 | 7/2013 | Dumas et al. | |
| 2014/0077929 | A1 * | 3/2014 | Dumas | G07C 9/00174 340/5.61 |
| 2014/0113563 | A1 | 4/2014 | Almomani et al. | |
| 2014/0157842 | A1 | 6/2014 | Almomani et al. | |
| 2014/0260448 | A1 | 9/2014 | Beck et al. | |
| 2014/0260449 | A1 | 9/2014 | Uyeda et al. | |
| 2015/0101370 | A1 * | 4/2015 | Russo | E05B 47/0001 70/263 |
| 2015/0225983 | A1 | 8/2015 | Alzingre et al. | |
| 2015/0279136 | A1 | 10/2015 | Lovett et al. | |
| 2016/0284148 | A1 | 9/2016 | Almomani | |
| 2016/0284181 | A1 | 9/2016 | Johnson | |
| 2017/0076520 | A1 | 3/2017 | Ho et al. | |
| 2017/0204636 | A1 | 7/2017 | Sack | |
| 2017/0263065 | A1 | 9/2017 | Johnson | |
| 2018/0051509 | A1 | 2/2018 | German | |
| 2018/0080250 | A1 | 3/2018 | Martin et al. | |
| 2019/0178003 | A1 | 6/2019 | Martin et al. | |
| 2019/0186169 | A1 * | 6/2019 | Ho | E05B 37/0048 |
| 2019/0213813 | A1 | 7/2019 | Chong et al. | |
| 2019/0242170 | A1 | 8/2019 | Brueckner | |

FOREIGN PATENT DOCUMENTS

| | | | |
|---|---|---|---|
| TW | 201638445 | A | 11/2016 |
| WO | 91/19068 | A1 | 12/1991 |
| WO | 9921200 | A2 | 4/1999 |
| WO | 0186097 | A2 | 11/2001 |
| WO | 2006001572 | A1 | 1/2006 |
| WO | 2009024961 | A2 | 2/2009 |
| WO | 2011128901 | A1 | 10/2011 |
| WO | 2015054667 | A1 | 4/2015 |
| WO | 2015138755 | A1 | 9/2015 |
| WO | 2016130777 | A1 | 8/2016 |

* cited by examiner

ELECTRONIC DOOR LOCK

CROSS-REFERENCE TO RELATED APPLICATION(S)

This application claims priority to and the benefit of U.S. Provisional Application No. 62/957,199 (filed Jan. 4, 2020) and is a continuation-in-part of International Patent Application No. PCT/US2019/020028 (filed Feb. 28, 2019), which claims priority to and the benefit of U.S. Provisional Application No. 62/789,190 (filed Jan. 7, 2019), U.S. Provisional Application No. 62/636,290 (filed Feb. 28, 2018), U.S. Provisional Application No. 62/636,292 (filed Feb. 28, 2018), and U.S. Provisional Application No. 62/636,293 (filed Feb. 28, 2018), the entire disclosures of which are incorporated by reference herein.

TECHNICAL FIELD

This disclosure relates to entry doors and, in particular, electronic door locks.

BACKGROUND

Door locks for entry doors of building structure include deadbolts. A deadbolt lock is a locking device that typically includes a deadbolt mechanism, as well as an interior knob and an exterior key cylinder that are turned to operate the deadbolt mechanism. Electronic door lock devices may operate deadbolts electronically. Door locks, deadbolts, and electronic door lock devices may benefit from improvements, for example, to address retrofitting, provide touch detection, address tampering (e.g., lock picking), reduce power consumption, provide electronic key detection, and/or provide door monitoring.

SUMMARY

Disclosed herein are implementations of electronic door locks. In various implementations, an electronic door lock device includes one or more of a deadbolt operator, a touch detector, a deadbolt locker, or an electronic key detector. The electronic door lock device is coupleable to an interior side of a door and to a deadbolt lock. The deadbolt operator electronically operates the deadbolt lock. The touch detector detects touch to the deadbolt lock. The deadbolt locker secures the deadbolt lock by preventing movement thereof. The electronic key detector detects electronic keys in a key detection area that is on an exterior side of the door and horizontally asymmetric as measured in a plane of the door. The electronic door lock device may further include a position detector that includes an accelerometer and a magnetometer and determines whether the door is in a closed position or an open position according thereto.

In an implementation, a locking device for detecting tampering or lock picking of a locking assembly of the locking device includes a mounting plate configured to partially house the locking assembly, a touch sensor, an anti-picking actuator, and a processor in communication with the touch sensor and the anti-picking actuator. The anti-picking actuator moves between a first position that physically prevents the deadbolt from moving from the locked position to the unlocked position and a second position that allows the deadbolt to move between the locked position and the unlocked position. The processor is configured to determine when the electrical signal emitted from the touch sensor indicates that the locking assembly is being picked or tampered with by the user and actuate the anti-picking actuator to the first position when the processor determines that the locking assembly is being picked or tampered with.

In an implementation, turnkey electronic module for converting a locking device into a smart locking device includes a processor, a printed circuit board, and an electric motor. The processor is mounted on the printed circuit board and the printed circuit board is configured to mount within a housing of the locking device. The electric motor is in communication with the processor is configured to actuate a locking assembly of the locking device so as to lock or unlock the locking device.

In an implementation, an electronic locking device includes a locking assembly and a battery pouch. The locking assembly includes a deadbolt and is configured to move the deadbolt between an unlocked position and a locked position. The electronic locking device is configured to be at least partially disposed within the cavity formed within a door that utilizes electronic locking device. The battery pouch contains a battery for powering the electronics of the electronic locking device and is configured to extend and be housed substantially within the cavity formed within the door when the locking assembly is attached to the door.

In one implementation, an electronic door lock is for use with a deadbolt lock of a door. The deadbolt lock includes a bolt movable between an extended position and a retracted position, and includes a locking arm rotatable between a non-locking position and a locking position in which the locking arm engages the bolt to prevent retraction from the extended position. The electronic door lock includes a controller and a deadbolt locker. The deadbolt locker, when coupled to the deadbolt lock, is selectively operated by the controller to prevent rotation of the locking arm from the locking position to the non-locking position. The electronic door lock may further include an electronic key detector for detecting an electronic key associated with the electronic door lock. The locking actuator includes a block that, when the locking actuator is selectively operated by the controller and torque is applied to the locking arm, is moved toward an exterior side of the door to a position above the locking arm and prevents rotation of the locking arm from the locking position by transferring force from the locking arm to a surface of the door defining a bore in which the locking arm is positioned. The electronic door lock may further include one or more of a touch sensor for detecting touch, a movement sensor for detecting rotation of a pin by which deadbolt lock is operated, or an accelerometer for detecting acceleration of the door. The touch sensor detects capacitance and electrically couples to the deadbolt lock for the deadbolt lock to function as an electrode of the touch sensor. The controller selectively operates the deadbolt locker according the detection of the electronic key and one or more of the detection of the touch, the detection of the rotation, or the detection of the acceleration. The electronic door lock may include all of the touch sensor, the movement sensor, and the accelerometer. The controller selectively operates the deadbolt locker according the detection of the electronic key, the detection of the touch, the detection of the rotation, and the detection of the acceleration.

In one implementation, an electronic door lock includes a touch sensor, a locking actuator, and a controller. The touch sensor is electrically connectable to a deadbolt lock to detect touch thereto. The locking actuator is movable to mechanically block the deadbolt lock. The controller that selectively operates the locking actuator according to the touch detected by the touch sensor.

The electronic door lock may further include one or more of a movement sensor for detecting rotation of a pin by which the deadbolt lock is operated, or an accelerometer by which acceleration of the electronic door lock is determined. The electronic door lock may include both the movement sensor and the accelerometer, and the controller selectively operates the locking actuator according to the touch detected, the rotation detected, and the acceleration detected.

An electronic door lock for operating a deadbolt lock of a door includes one or more of a deadbolt operator or a deadbolt locker. The deadbolt locker further includes a touch sensor, a movement sensor, an accelerometer, and a controller. The deadbolt operator locks and unlocks the deadbolt lock. The deadbolt locker that prevents unlocking of the deadbolt lock. The touch sensor is electrically coupleable to the deadbolt lock for detecting touch thereof. The movement sensor senses rotation of a pin that is rotatable for operating the deadbolt lock. The accelerometer measures acceleration of the door. The controller selectively operates the one or more of the deadbolt operator or the deadbolt locker according to the touch sensor, the movement sensor, and the accelerometer.

The electronic door lock may further include an electronic key detector, and the controller selectively operates the one or more of the deadbolt operator or the deadbolt locker according to detection with the electronic key detector an electronic key associated with the electronic door lock. The electronic door lock may include both the deadbolt operator and the deadbolt locker. The controller may selectively operate the deadbolt operator according to the touch sensor and the electronic key detector, and the controller selectively operates the deadbolt operator according to the touch sensor, the movement sensor, and the accelerometer.

In one implementation, an electronic door lock is for use with an existing deadbolt lock and includes a deadbolt operator, a touch detector, and a controller. The deadbolt operator is operatively coupleable to the deadbolt lock to operate the deadbolt lock. The touch detector is operatively coupleable to the deadbolt lock to detect touch to the deadbolt lock. The controller selectively operates the deadbolt operator according to the touch detected with the touch detector.

In one implementation, an electronic door lock includes a touch detector, a deadbolt locker, and a controller. The touch detector senses touch to a deadbolt lock capacitively. The deadbolt locker is selectively operated by the controller to engage the deadbolt lock to secure the deadbolt lock according to the touch sensed by the touch detector.

In one implementation, an electronic door lock includes a deadbolt operator, an electronic key detector, and a controller. The deadbolt operator that is operatively coupleable to a deadbolt lock. The electronic key detector that is coupleable to an interior side of a door to which the deadbolt lock is coupled, and detects electronic keys in a key detection region on an exterior side of the door. The key detection region being horizontally asymmetric relative to the key detector in a coordinate system defined by a plane of the door. The controller selectively operates the deadbolt operator according to the detection of the electronic key with the electronic key detector.

In one implementation, a door position detector includes an accelerometer, a magnetometer, and a controller. The accelerometer senses movement of a door to which the door position detector is coupleable. The magnetometer for senses the magnetic field of the environment. The controller determines whether the door to which the door position detector is coupled is in either an open position or a closed position according to the accelerometer and the magnetometer.

In one implementation, an electronic door lock for use with a deadbolt lock includes a controller, a touch detector, an electronic key detector, a deadbolt operator, and a deadbolt locker. The touch detector is operatively coupleable to the deadbolt lock to detect touch to the deadbolt lock. The electronic key detector is coupleable to an interior side of a door to which the deadbolt lock is coupled, and detects electronic keys in a key detection region on an exterior side of the door. The key detection region may be horizontally asymmetric relative to the key detector in a coordinate system defined by a plane of the door. The deadbolt operator is operatively coupleable to the deadbolt lock and selectively operated by the controller according to the touch detected by the touch detector and the detection of the electronic key by the electronic key detector. The deadbolt locker is selectively operated by the controller to engage the deadbolt lock to secure the deadbolt lock according to the touch detected by the touch detector and the detection of the electronic key by the electronic key detector.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

FIG. 7I-1 is front view of alternative antenna array of the key detector.

FIG. 7I-2 is a cross-sectional view of the electronic door lock with a variation of the key detector.

FIG. 7O is a flow chart of an alternative technique for detecting an electronic key associated with the electronic door lock.

Figure 8A:
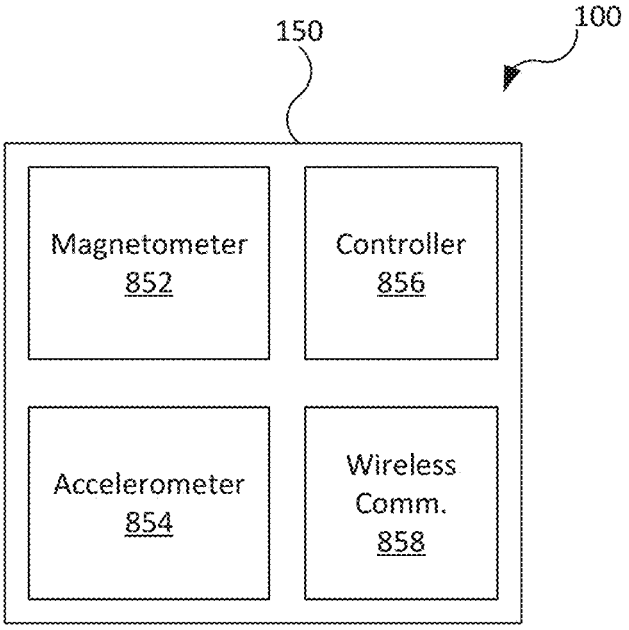
FIG. 8A is a schematic view of a door position detector of the electronic door lock of FIG. 1.
Figure 8B:
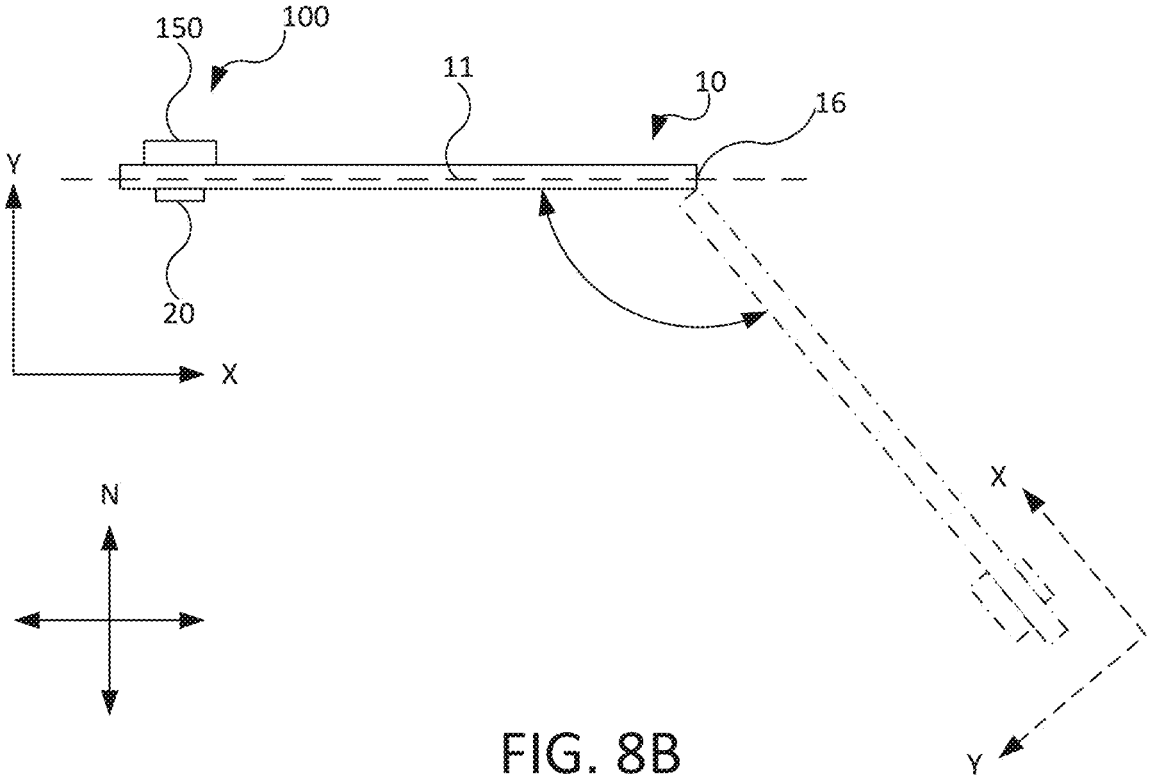
FIG. 8B is an overhead schematic of a door in a closed position (solid lines) and an open position (broken dash-dot lines) with a door coordinate system illustrated as moving relative to a global coordinate system.
Figure 8C:
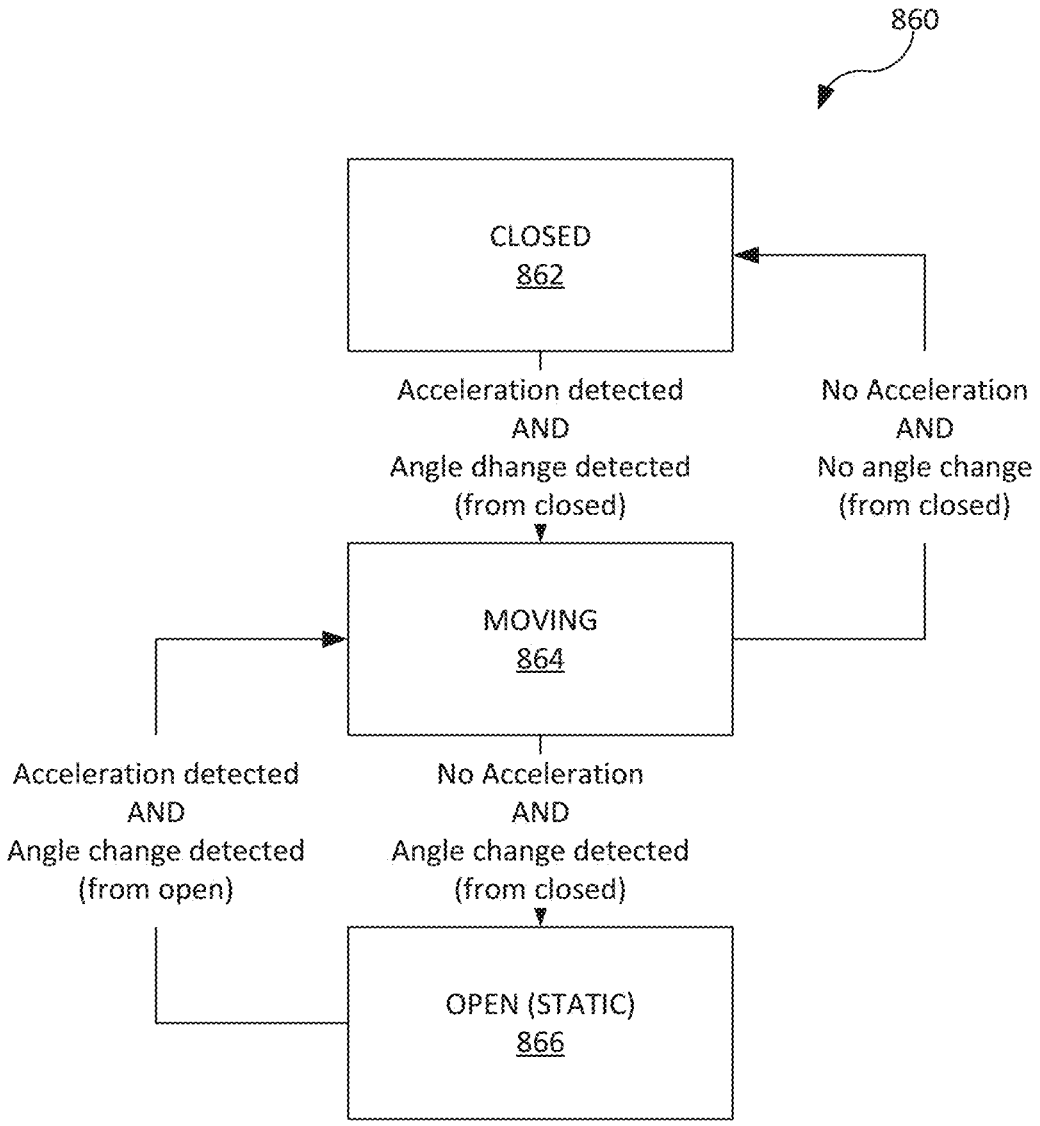
FIG. 8C is a flow chart of a first technique for determining a position of a door.
Figure 8D:
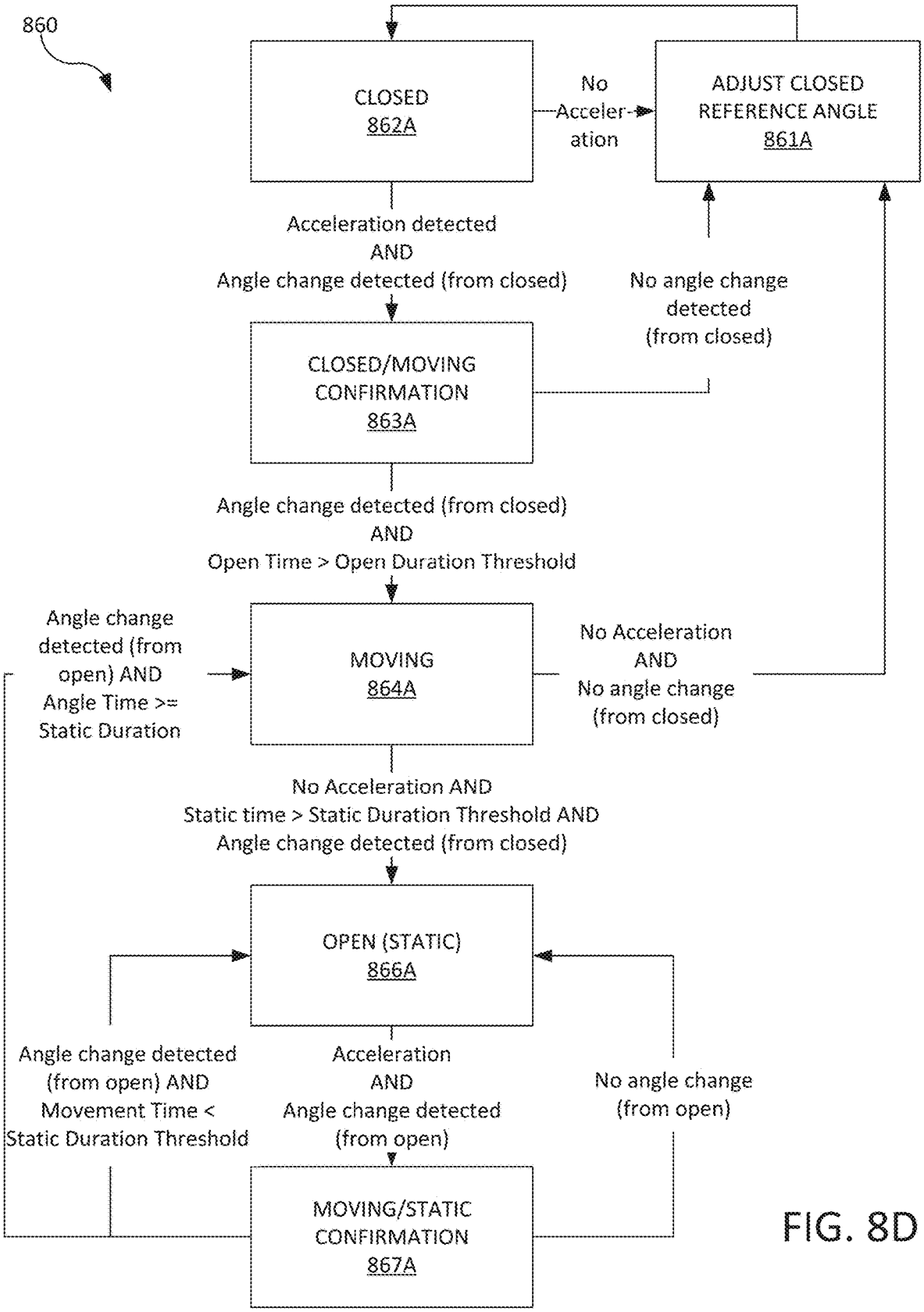
FIG. 8D is a flow chart of another technique for determining a position of a door.
Figure 8E:
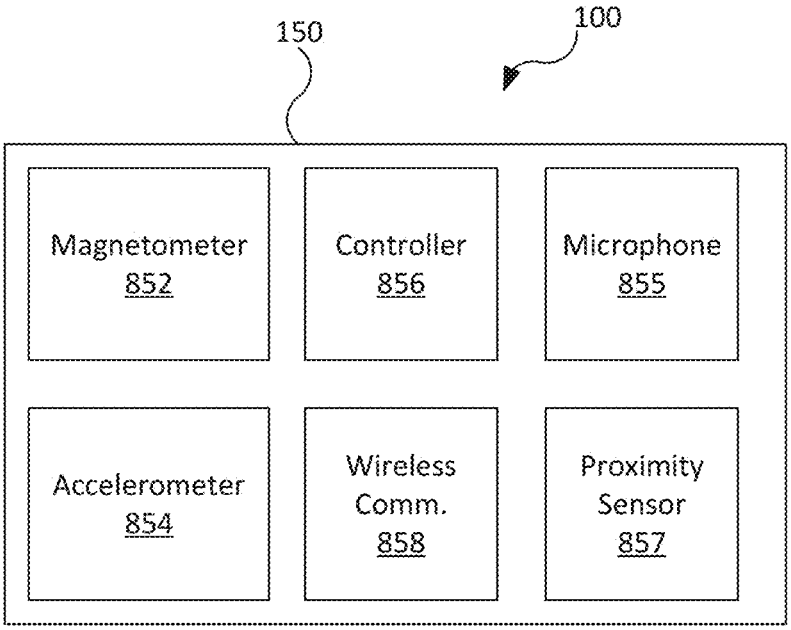
FIG. 8E is a schematic view of another door position detector of the electronic door lock 100.

8F is a plan view of the door position detector of FIG. 8E detecting proximity to building structures.

Figure 1:
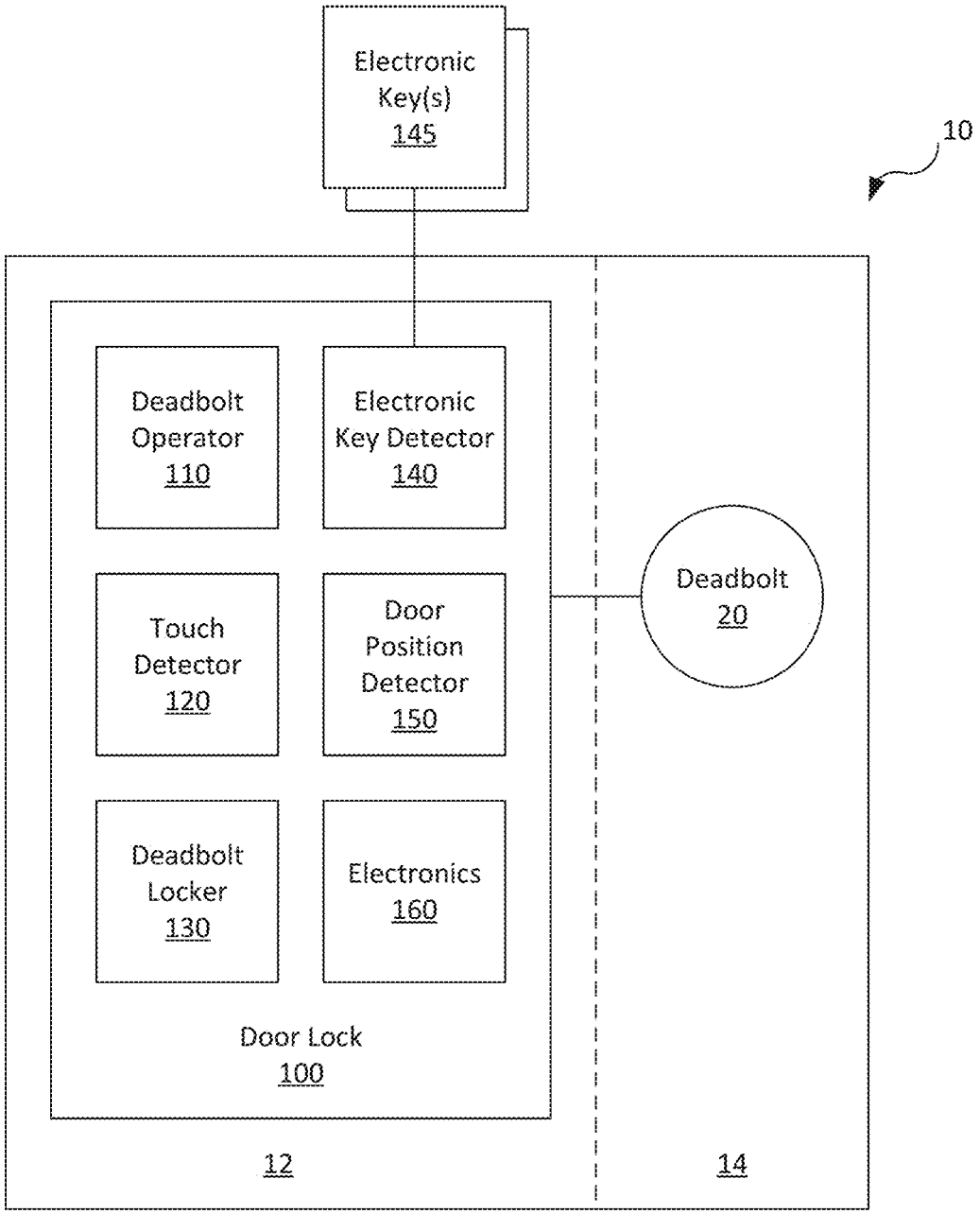
FIG. 1 is a schematic view of a door having electronic door lock and a deadbolt.
Figure 9A:
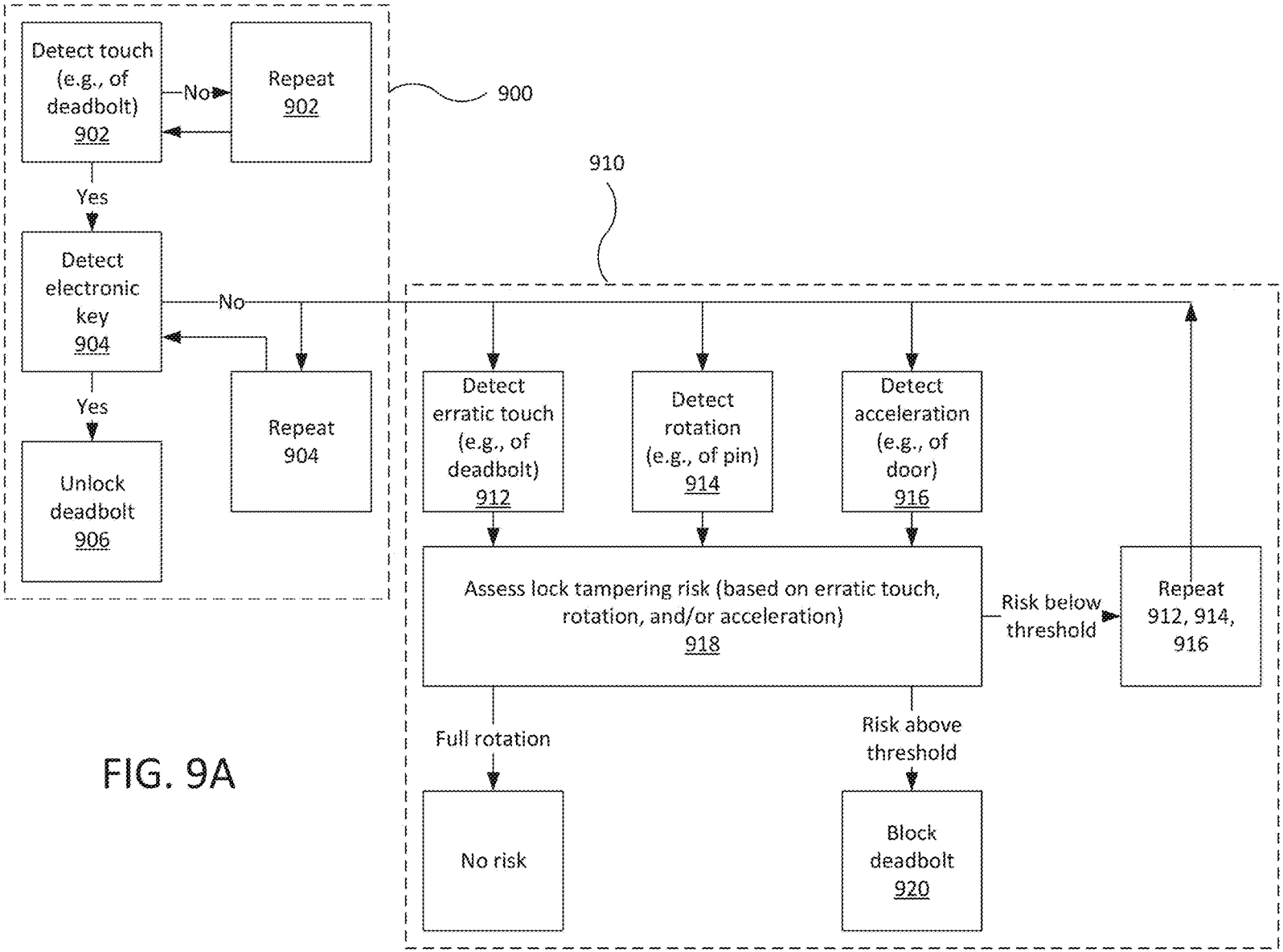

FIG. 9A is a flow chart of techniques for operating the electronic door lock of FIG. 1.

Figure 9B:
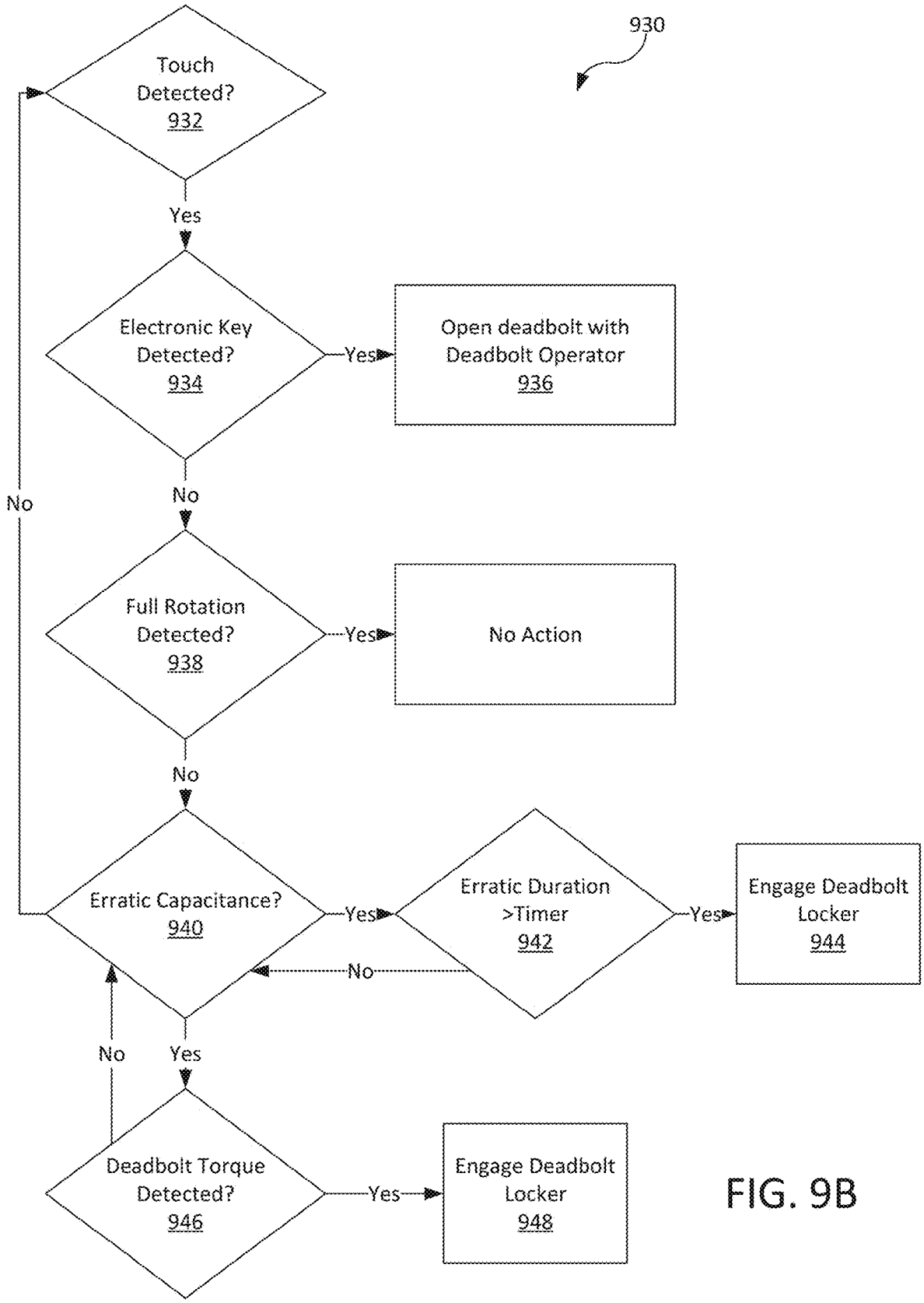

FIG. 9B is a flow chart for operating the electronic door lock of FIG. 1.

Figure 10A:
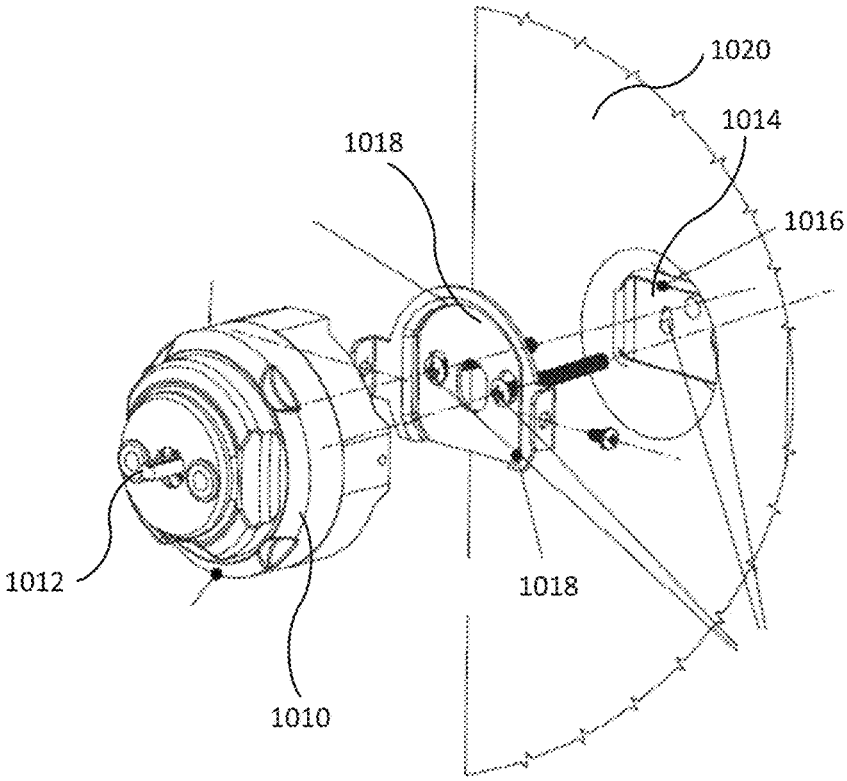
Figure 10B:
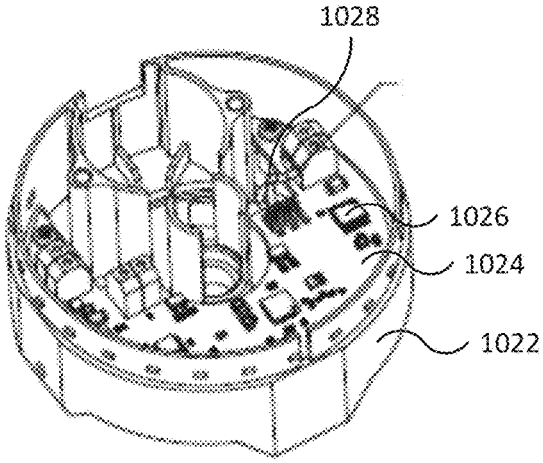
Figure 10C:
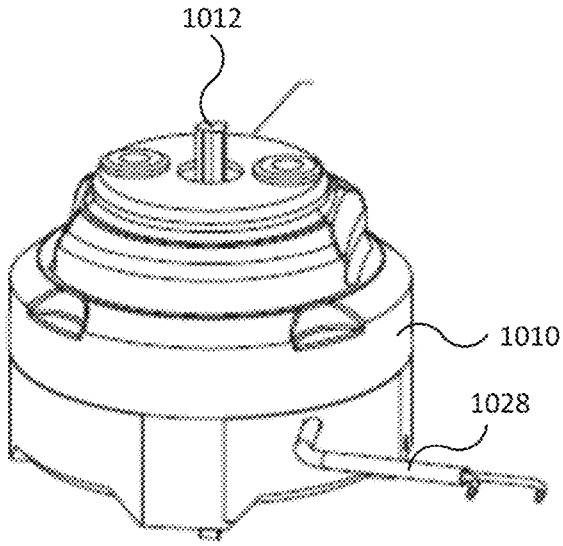
Figure 10D:
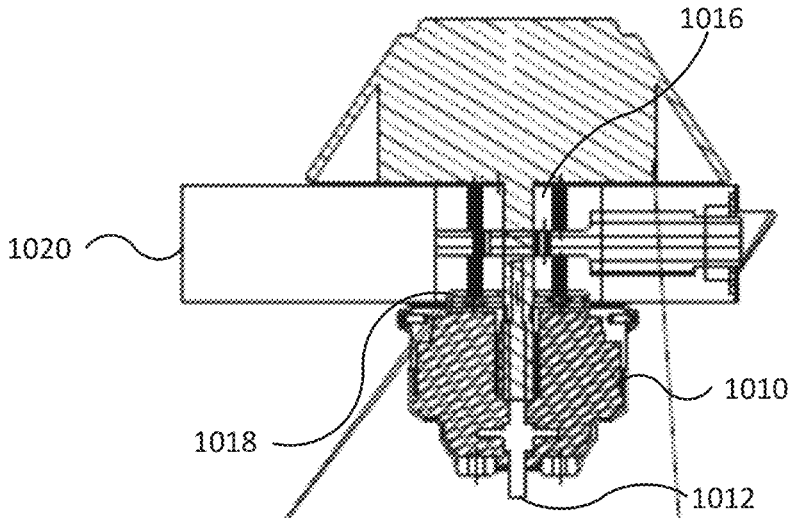

FIG. 10A illustrates a locking device incorporating a turnkey module for converting the locking device into a smart locking device;

FIG. 10B illustrates a view of the module so that the printed circuit board of the module is viewable;

FIG. 10C illustrates the locking device with the module and a touch sensor; and FIG. 10D illustrates a cross-sectional view of the locking device with the module mounted to a door.

Figure 10E:
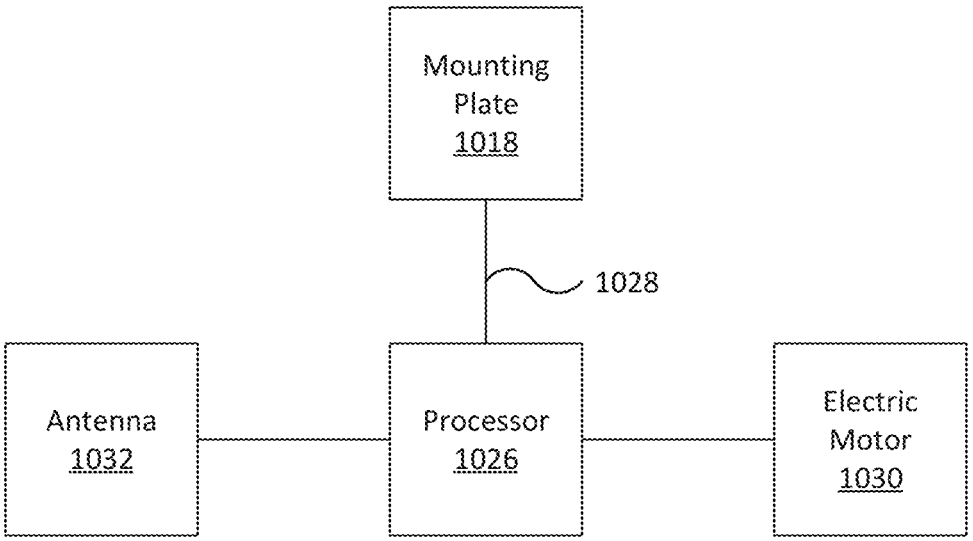

FIG. 10E is a block diagram of the electrical components of the turnkey module.

Figure 11A:
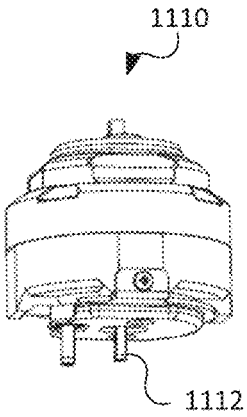
Figure 11B:
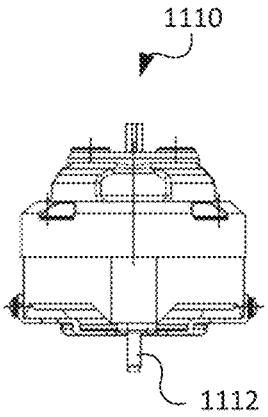
Figure 11C:
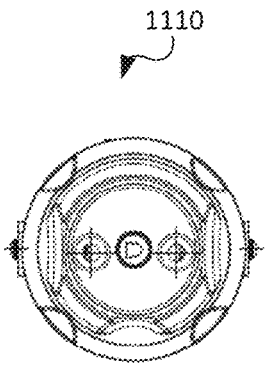
Figure 11D:
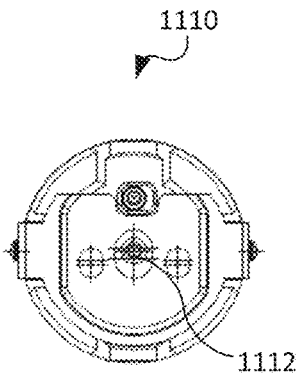
Figure 11E:
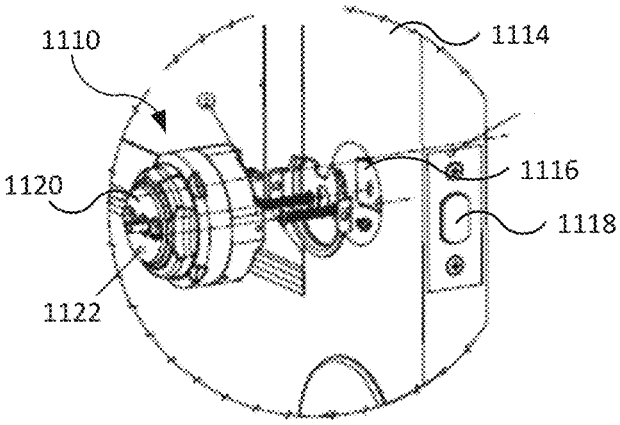
Figure 11F:
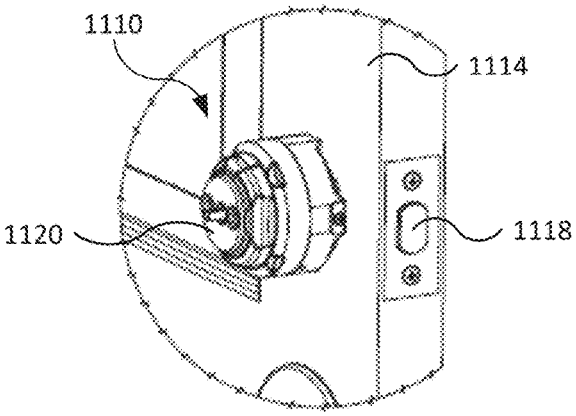
Figure 11G:
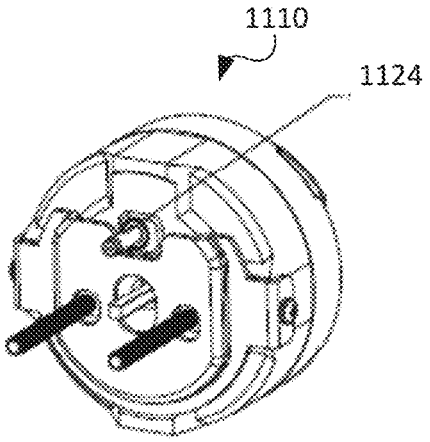
Figure 11H:
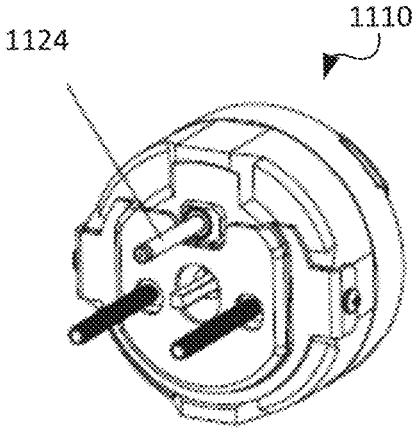
Figure 11I:
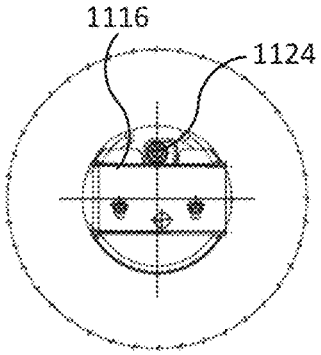
Figure 11J:
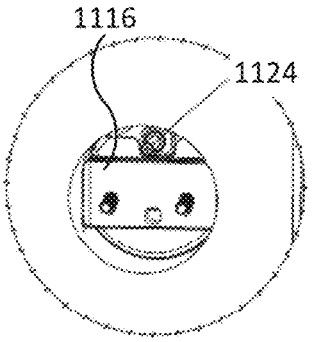
Figure 11K:
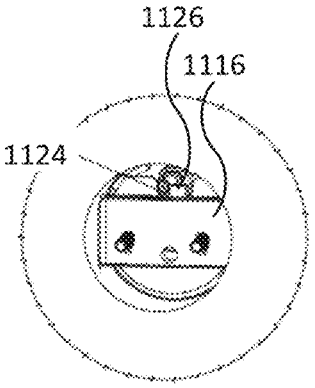
Figure 11L:
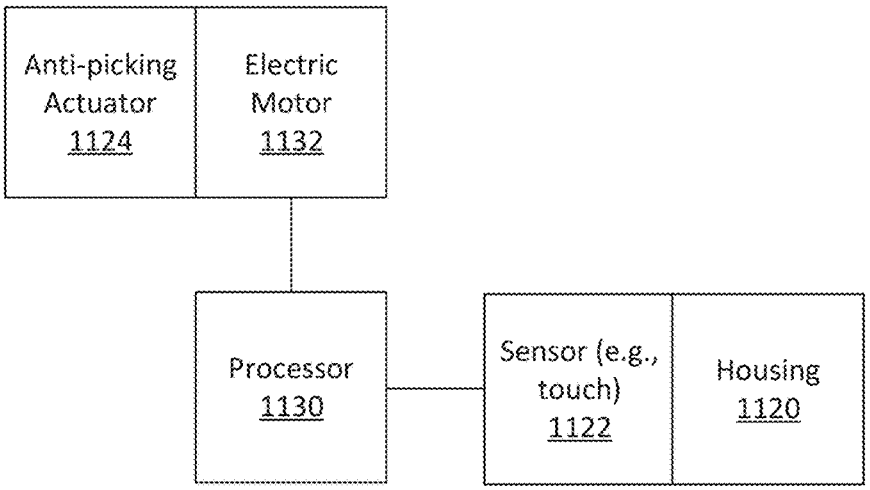

FIGS. 11A-11D illustrate different views of the locking device for detecting tampering or lock picking of a locking assembly of the locking device;

FIGS. 11E and 11F illustrate the locking device mounted to a door;

FIGS. 11G and 11H illustrate in more detail an anti-picking actuator of the locking device;

FIGS. 11I-11K show in even greater detail the anti-picking actuator of the locking device; and FIG. 11L illustrates a block diagram of the electrical components of the locking device.

Figure 12A:
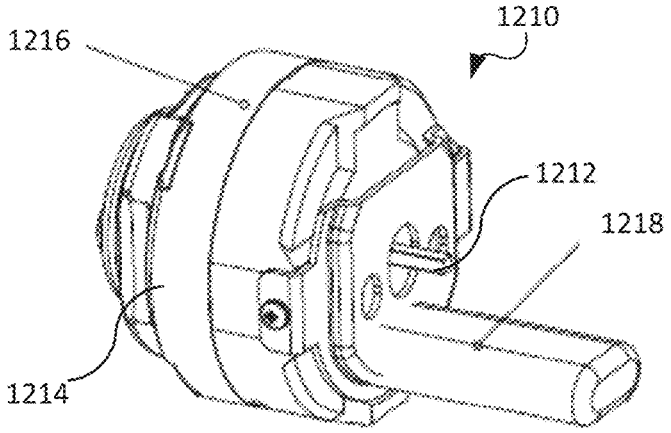
Figure 12B:
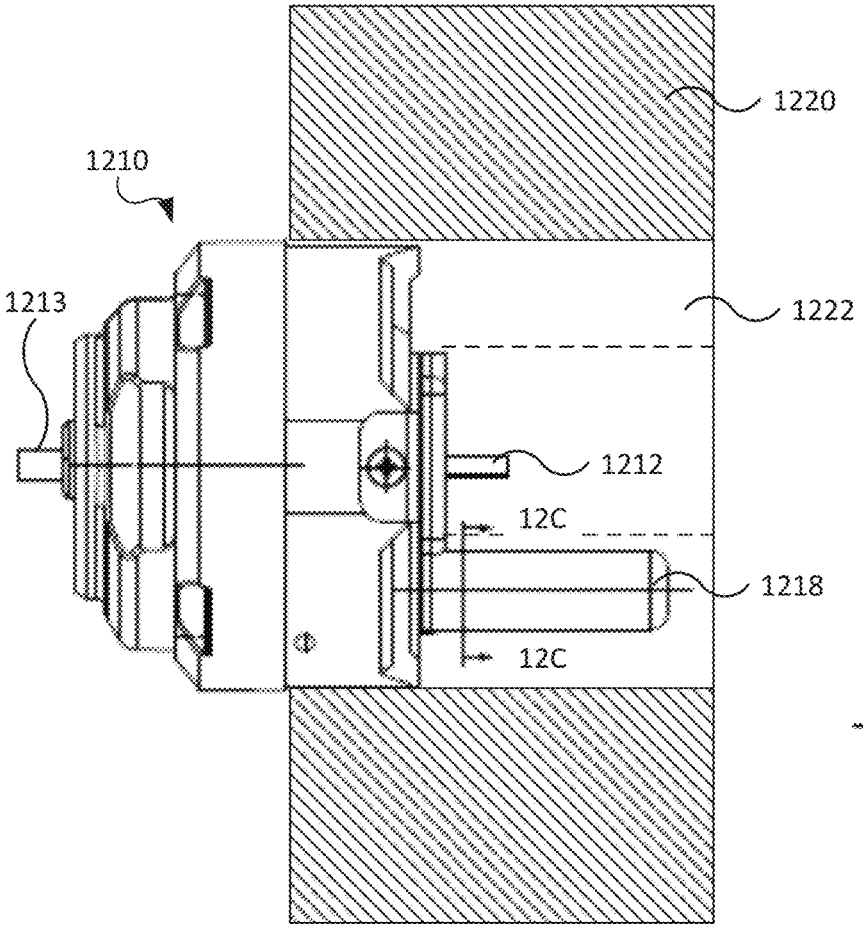
Figure 12C:
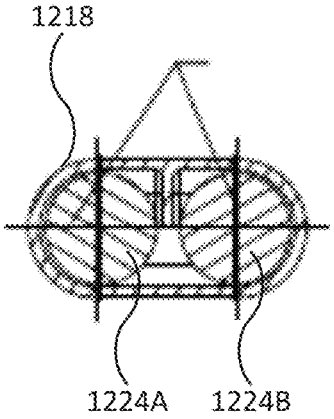

FIG. 12A illustrates an isometric view of an electronic locking device having a battery pouch;

FIG. 12B illustrates an electronic locking device having the battery pouch mounted to a door; and FIG. 12C illustrates a cross-sectional view of the battery pouch of FIGS. 12A and 12B.

Figure 13A:
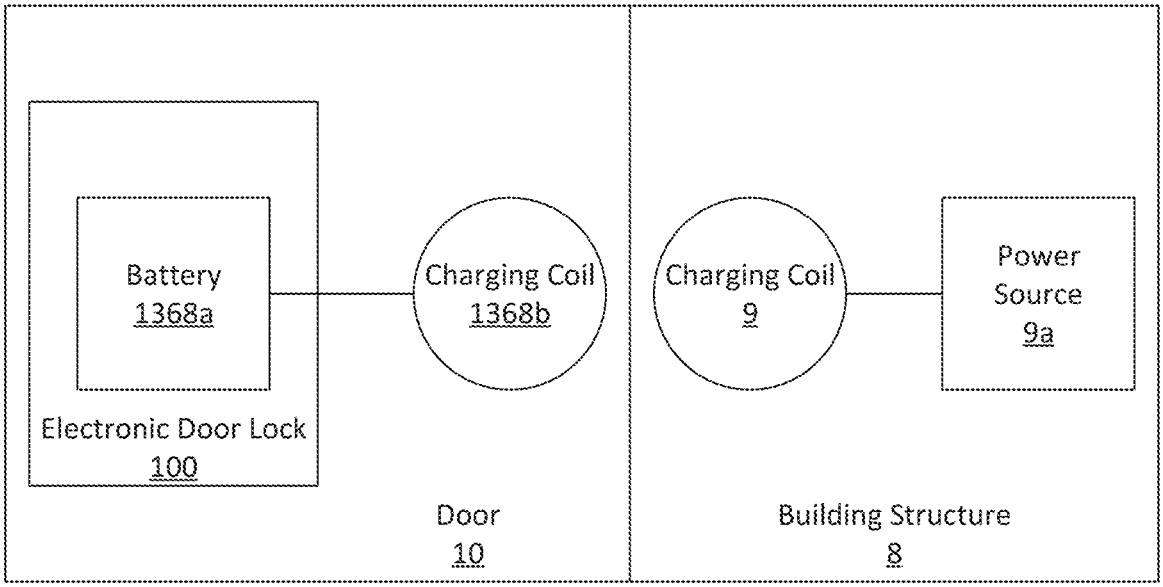

FIG. 13A is a schematic of a building structure and a door having an electronic door lock with a battery that is charged wirelessly by the building structure.

Figure 13B:
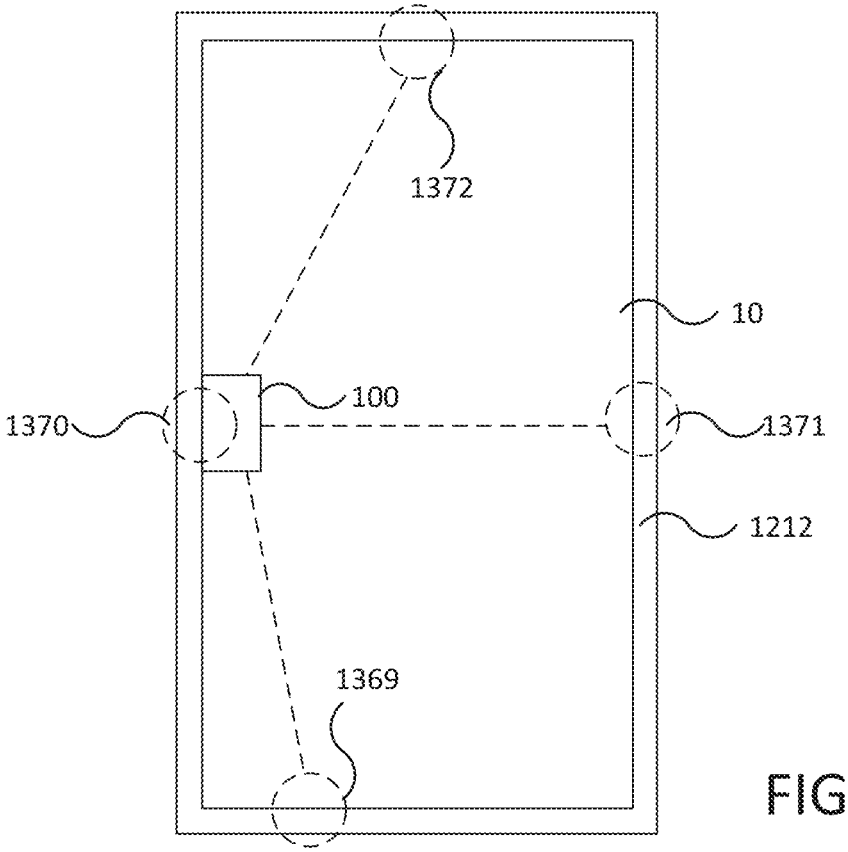

FIG. 13B is a schematic of locations at which charging coils may be located relative the door and the building structure.

DETAILED DESCRIPTION

Referring to FIG. 1, an electronic door lock 100 is coupled to a door 10 on an interior side 12 thereof. The electronic door lock 100 is configured to perform one or more functions relating to locking the door 10. For example, the electronic door lock 100 may include one or more of a deadbolt operator 110, a touch detector 120, a deadbolt locker 130, an electronic key detector 140, or a door position detector 150. The deadbolt operator 110 is configured to operate a deadbolt lock 20 associated with the door 10. The touch detector 120 is configured to detect touch on an exterior side 14 of the door 10 and, for example, conductively couples to the deadbolt lock 20 to function as a capacitive electrode of the touch detector 120 for detecting touch capacitively. The deadbolt locker 130 is configured to secure the deadbolt lock 20 by mechanically engaging the deadbolt lock 20 to prevent movement thereof between the locked stated and the unlocked state. The electronic key detector 140 is configured to detect electronic keys 145 associated with the electronic door lock 100 and within a detection region, for example, to operate the deadbolt operator 110. The door position detector 150 is configured to detect whether the door 10 is in a closed position or an open position, and may further determine an angle at which the door is open. The deadbolt operator 110, the touch detector

120, the deadbolt locker 130, the electronic key detector 140, and the door position detector 150 are each discussed in further detail below. It should be noted that the deadbolt operator 110, the touch detector 120, the deadbolt locker 130, the electronic key detector 140, and/or the door position detector 150 may be used in any suitable combination with each other and/or with the deadbolt lock 20. For example, the electronic key detector 140 may be used in systems and/or applications without any of the other systems described herein, without the deadbolt lock 20, with variations of the systems described herein, and/or with other systems. The electronic door lock 100 may also be referred to as a locking device, a door locking device, a door locking device, or an electronic door lock system.

As discussed in further detail below, the electronic door lock 100 may be configured as a retrofit solution, whereby the electronic door lock 100 may be installed on the door 10 to operate the deadbolt lock 20 previously installed on the door 10. For example, the electronic door lock 100 is coupled to the interior side 12 of the door 10 to replace the interior manual operator (e.g., a knob or thumb turn) of the existing deadbolt lock 20, while maintaining and operatively engaging the internal mechanism of the existing deadbolt lock 20 and also maintaining the exterior operator (e.g., keyed cylinder) of the existing deadbolt lock 20, thereby maintaining exterior aesthetics of the deadbolt lock 20. Alternatively, the electronic door lock 100 may include the deadbolt lock 20, or the electronic door lock 100 and the various systems and components thereof may be used with other types of locks.

Figure 2:
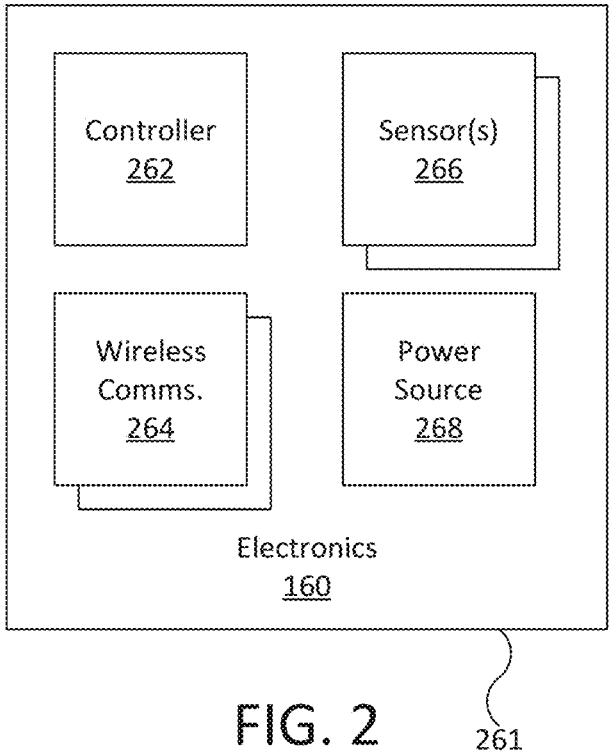
FIG. 2 is a schematic view of electronics of the electronic door lock of FIG. 1.

The electronic door lock 100 further includes electronics 160, which function to operate and may form parts of the deadbolt operator 110, the touch detector 120, the deadbolt locker 130, the electronic key detector 140, and/or the door position detector 150, for example, each being considered to include and/or share a controller 262 (discussed below). Referring to FIG. 2, the electronics 160 generally include the controller 262, one or more wireless communication devices 264, one or more sensors 266, and a power source 268, which may be mounted to or otherwise coupled (e.g., electrically) to a circuit board 261. The controller 262 is configured to operate the various devices of the electronic door lock 100, for example, being in communication with (e.g., being electrically coupled to) and receiving signals from the wireless communication devices 264 and/or the sensors 266. The wireless communication devices 264 are configured to send to and receive from various other electronic devices signals wirelessly (e.g., the electronic keys 145). The wireless communication devices 264 may, for example, include a transmitter and a receiver coupled to an antenna. The wireless communication devices 264 may communicate according to any suitable wireless communication protocol including, but not limited to, Wi-Fi, Bluetooth, and/or Bluetooth Low Energy (BLE). The sensors 266 are configured to detect various conditions, such as a magnetic field (e.g., including a compass or magnetometer), acceleration (e.g., including an accelerometer or gyroscope), and/or touch (e.g., capacitance, pressure). The power source 268, such as a battery, is configured to provide electric power to the various other electronic components.

Figure 3:
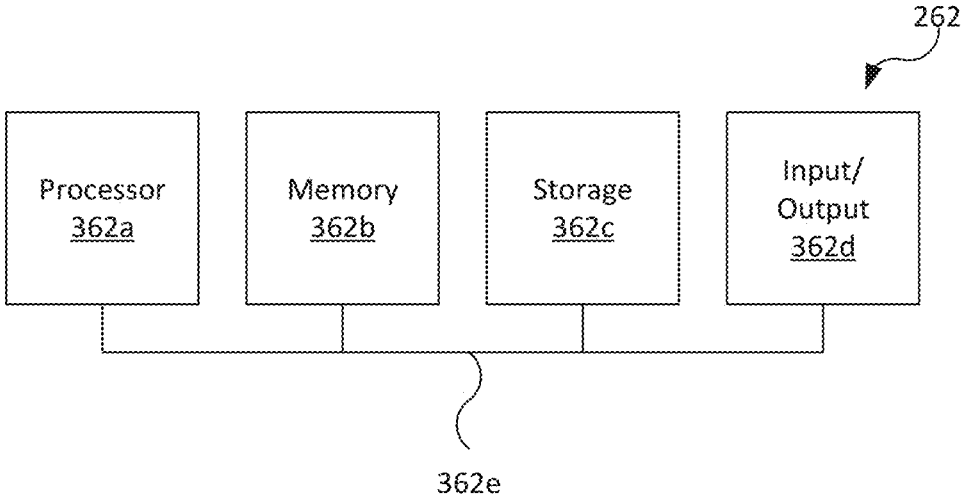
FIG. 3 is a schematic view of an example hardware configuration of the controller of the electronics of FIG. 2.

Referring to FIG. 3, an example hardware configuration of the controller 262 is shown. The controller 262 may be any computing device suitable for implementing the devices and methods described herein. In the example, shown, the controller 262 generally includes a processor 362*a*, a memory 362*b*, a storage 362*c*, an input/output 362*d*, and a bus 362*e* by which the other components of the controller 262 are in communication. The processor 362*a* may be any suitable processing device, such as a central processing unit (CPU), configured to execute instructions (e.g., software programming). The memory 362*b* may be a short-term, volatile electronic storage device, such as a random-access memory module (RAM). The storage 362*c* is a long-term, non-volatile electronic storage device, such as a solid-stated drive (SSD) or other computer-readable medium. The storage 362*c* stores therein instructions (e.g., the software programming), which are executed by the processor 362*a*. The input/output 362*d* is a communication device by which the controller 262 sends and receives signals, for example, to and from the wireless communication devices 264 and the sensors 266.

Other devices and methods pertaining to the electronic door lock 100 and variations thereof are discussed with reference to FIG. 10A to FIG. 12C.

Figure 4:
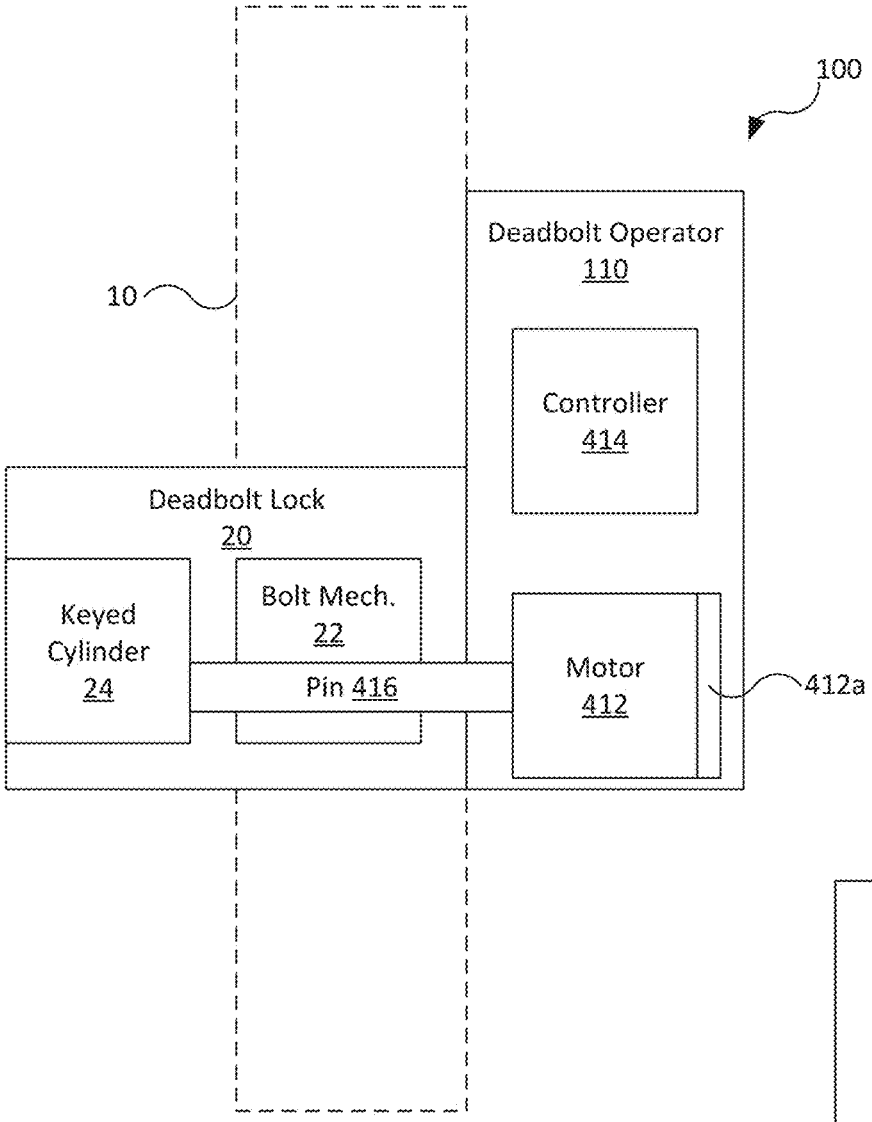
FIG. 4 is a schematic view of a deadbolt operator of the electronic door lock of FIG. 1.

Referring to FIG. 4, the electronic door lock 100 includes the deadbolt operator 110. As illustrated schematically, the deadbolt operator 110 generally includes a motor 412 and a controller 414, and may further include or otherwise engage a pin 416 (e.g., a spindle, tailpiece, or cam bar). The motor 412 operatively engages the pin 416 to be rotated thereby, for example, having one or more gears arranged therebetween. The pin 416 operatively engages a deadbolt mechanism 22 of the deadbolt lock 20, such that rotation of the pin 416 by the motor 412 or by a keyed cylinder 24 (e.g., an external manual operator) of the deadbolt lock 20 operates the deadbolt mechanism 22 (e.g., causing extension and retraction thereof). The pin 416 may be provided as part of the deadbolt operator 110 (e.g., with the electronic door lock 100), or may instead be provided as part of the deadbolt lock 20 and receivable by the deadbolt operator 110 (e.g., a receptacle that is rotatable by the motor 412). The controller 414 controls operation (e.g., rotation) of the motor 412 and, thereby, controls operation of the deadbolt lock 20. The controller 414 may be the controller 262 or another controller 414.

Referring to FIGS. 5A-5E, the electronic door lock 100 includes the touch detector 120. The touch detector 120 is configured to detect touch, which may be indicative of a user's intent to unlock the deadbolt lock 20 to open the door 10. The touch detector 120 generally includes a touch sensor 522 and a controller 524. The touch sensor 522 is configured to sense touch on the exterior side 14 of the door 10. The controller is electrically coupled to the touch sensor 522, so as to receive and interpret signals therefrom to determine whether a touch has been detected. In a preferred example, the touch sensor 522 is configured to measure capacitance, and the controller 524 determines touch based on the measured capacitance (e.g., if capacitance exceeds a threshold). The touch sensor 522 may be one of the sensors 266 (or another sensor), while the controller 524 may be the controller 262 (or another controller).

The touch detector 120 is further configured to couple to the deadbolt lock 20 and utilize components thereof as a sensing component for the touch detector 120. As a result, the electronic door lock 100 may be used with an existing deadbolt lock 20 and detect touches thereof. More particularly, a deadbolt lock 20 of a conventional type will typically include an external housing 26 (e.g., a shroud or escutcheon) that surrounds the keyed cylinder 24 and provides access thereto with mechanical keys. The external housing 26 provides the deadbolt lock 20 with the aesthetics of the deadbolt lock 20 on the exterior side 14 of the door 10, for example, having different shapes and/or colors. The external housing 26 is generally made of or otherwise includes a conductive material (e.g., a metal).

Figure 5A:
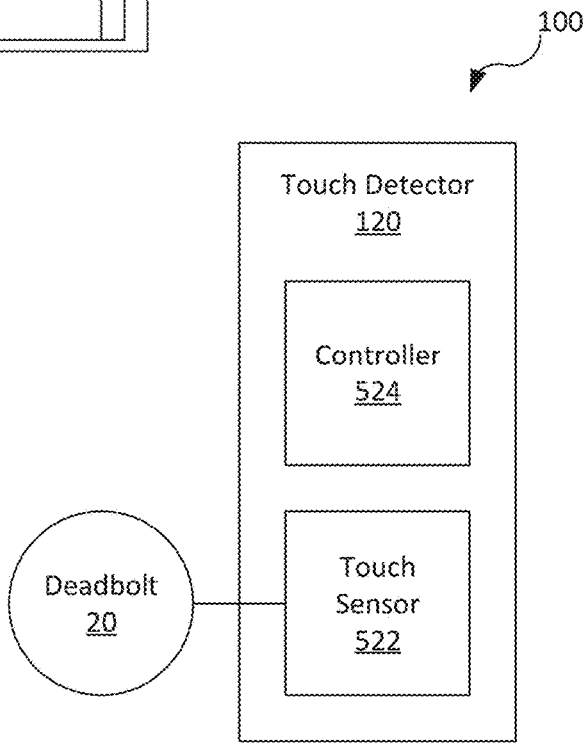
FIG. 5A is a schematic view of a touch detector of the electronic door lock of FIG. 1.
Figure 5C:
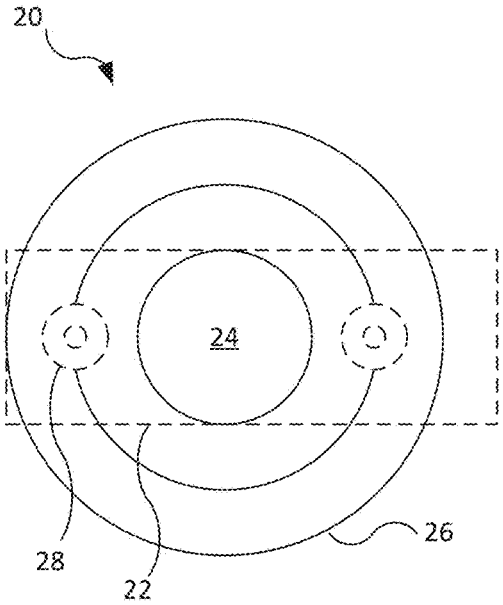
FIG. 5C is a front view of the deadbolt lock of FIG. 5B with hidden components depicted in dashed lines.
Figure 5I:
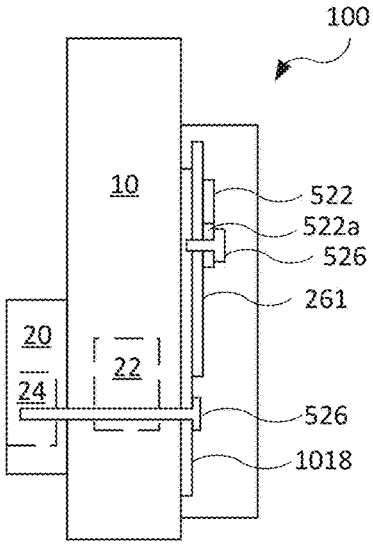
FIG. 5I is another partial cross-sectional view of another embodiment of the electronic door lock having the touch detector of FIG. A and being coupled to a door.
Figure 5B:
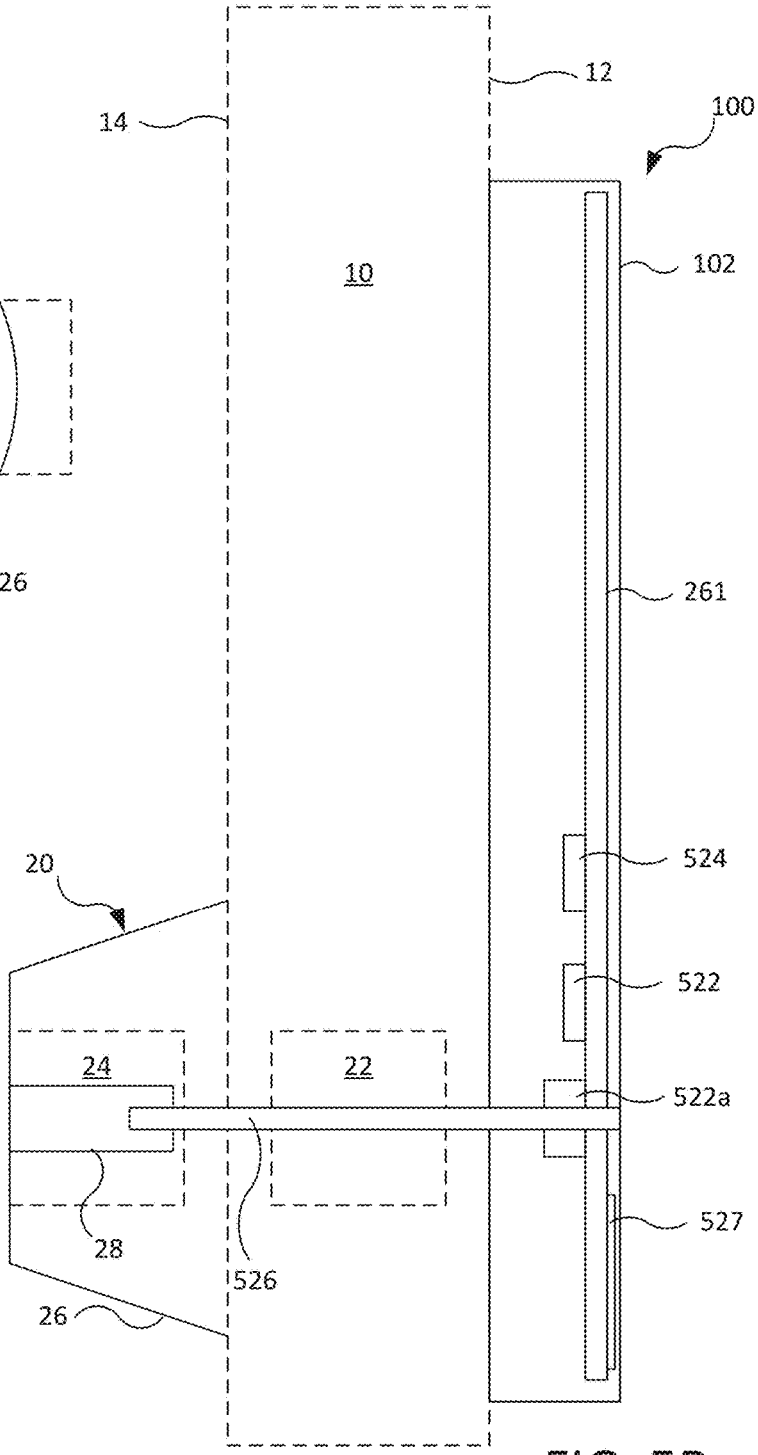
FIG. 5B is a partial cross-sectional view of the electronic door lock having the touch detector of FIG. 5A and being coupled to a deadbolt lock and a door.

The touch sensor 522 of the touch detector 120 is electrically coupleable to the external housing 26 of the deadbolt lock 20, such that the external housing 26 functions as an electrode of the touch sensor 522 whereby capacitance may be measured for detecting touch thereto. As shown in FIGS. 5B-5C, the touch sensor 522 is conductively coupled to the deadbolt lock 20 and, in particular, to the external housing 26 with a fastener 526 (e.g., a screw or other threaded fastener). The fastener 526 may further function to mount the deadbolt lock 20 to the door 10 and/or mount the electronic door lock 100 to the door 10.

The deadbolt lock 20 includes mounting holes 28 (e.g., in conductive bosses) in the external housing 26 (as shown) or other structure (e.g., the keyed cylinder 24 or a mounting plate) that receive threaded fasteners for coupling the external housing 26 in a conventional arrangement with an internal operator (e.g., the thumb turn) and, thereby, mounting the deadbolt lock 20 to the door 10. The deadbolt mechanism 22 may further include apertures through which one or more of the threaded fasteners 526 may extend and may be in contact (e.g., conductive contact) with the threaded fasteners 526.

The touch sensor 522 includes a conductive contact 522*a* that is electrically coupled thereto (e.g., via the circuit board 261) and that conductively engages the fastener 526. As shown, the conductive contact 522*a* is a boss (e.g., a standoff) formed of a conductive material (e.g., metal) and through which the fastener 526 extends, but may be configured in other manners (e.g., a conductive spring member that engages the fastener 526). The fastener 526 extends through the door 10 and is received by the holes 28 and, thereby, conductively couples the touch sensor 522 to the deadbolt lock 20 and the external housing 26 thereof. Thereby, the external housing 26 of the deadbolt lock 20 is conductively coupled to the touch sensor 522 and functions as an electrode thereof for measuring capacitance.

The fastener 526 may further functions to mount the deadbolt lock 20 (e.g., the external housing 26 and the deadbolt mechanism 22) to the door 10.

In one example, the fastener 526 may be in conductive contact with both the deadbolt lock 20 (e.g., the external housing 26 and/or the deadbolt mechanism 22), for example, extending directly therebetween.

In other examples, intermediate electrically conductive members may be arranged between the fastener 526 and the deadbolt lock 20 (e.g., the external housing 26) and/or the touch sensor 522 (e.g., the conductive contact 522*a*), while the fastener 526 is still considered to electrically conductively couple the touch sensor 522 to the deadbolt lock 20 to function as an electrode thereof. Such intermediate conductive members may, for example, include a washer or metal plate (e.g., a mounting plate, such as the mounting plate 1018). For example, as illustrated in FIG. 5I the deadbolt lock 20 (e.g., the external housing 26, the mounting holes 28, and/or the deadbolt mechanism 22) may be conductively coupled to the mounting plate with one of the fasteners 526 (e.g., to mount the deadbolt lock 20 to the door 10, as shown in FIG. 10A with fasteners extending through the mounting plate 1018 and the bore of the door to the deadbolt 1014), while the touch sensor 522 is electrically conductively coupled to the mounting plate with another of the fasteners 526 (e.g., extending through or otherwise conductively engaging the conductive contact 522*a*, which may also mechanically couple the electronic door lock 10 to the door 14 via the mounting plate). In this scenario, the touch sensor 522 is electrically coupled to the deadbolt 20 serially via a first fastener 526, a mounting plate 1018, and a second fastener 526.

As shown in FIG. 5B, the touch detector 120 may, instead of or in addition to the touch sensor 522, include an interior touch sensor 527, which may detect touch to the housing 102 of the electronic door lock 100. The interior touch sensor 527 may measure touch (e.g., force or pressure thereto) or may be a proximity sensor that measures capacitance (e.g., through the housing 102). The interior touch sensor 527 may be one of the sensors 266. A touch may be determined with the interior touch sensor 527 according to the techniques 530 and 530A described below. Upon detecting a touch (or touch gesture, such as a double tap) with the interior touch sensor 527, the deadbolt operator 110 may be operated to lock or unlock the deadbolt 20 irrespective of an electronic key 145. Gestures may be advantageous, so as to avoid performing operations based on inadvertent touches (e.g., bumping into by a person, or a pet touching the interior touch sensor 527).

Figure 5D:
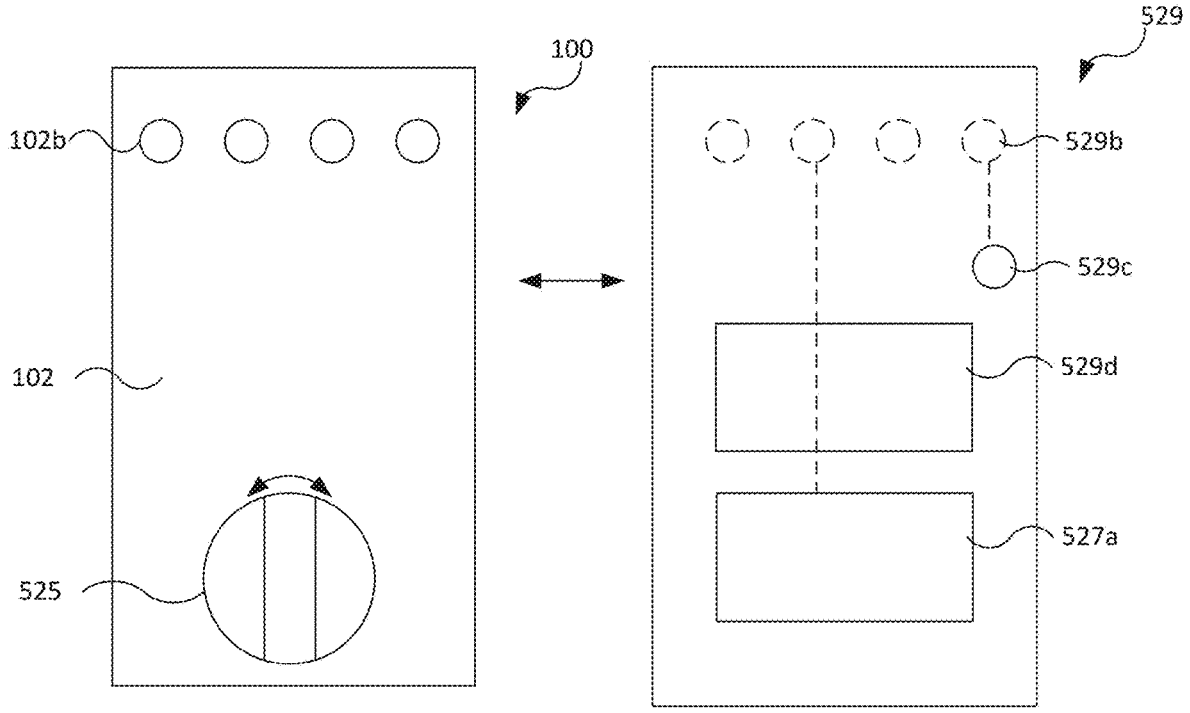
FIG. 5D is a front view of a variation of the electronic door lock having a removable cover illustrated adjacent to the electronic door lock with hidden components depicted in dashed lines.
Figure 5E:
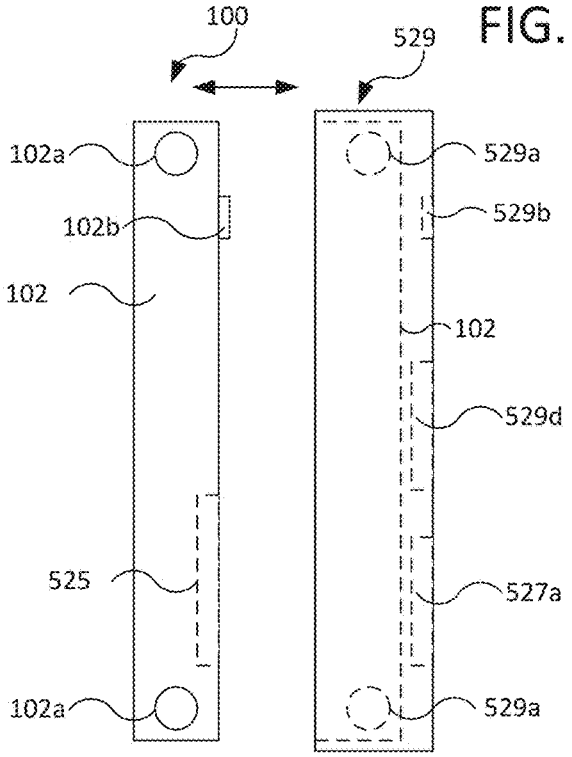
FIG. 5E is a side view of the electronic door lock of FIG. 5D with the removable cover in a first state located in front of the electronic lock with hidden components depicted in dashed lines and in a second state containing the electronic door lock therein (illustrated in dashed lines).
Figure 5F:
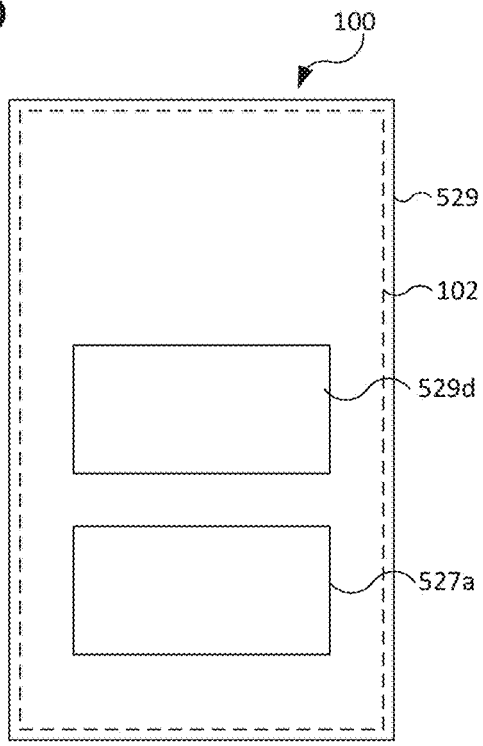
FIG. 5F is a front view of the electronic door lock (hidden and illustrated in dashed lines) of FIG. 5D received by the removable cover.

Referring to FIGS. 5D-5F, the electronic door lock 100 may include a removable cover 529. The removable cover 529, for example, couple to the housing 102 or otherwise be positioned between various components of the electronic door lock 100 and the user to protect such components, provide desirable aesthetics, and/or provide other functions. The removable cover 529 may be configured as a face plate (e.g., being generally planar and providing a front surface to the electronic door lock 100), or may, as shown, extend along upper, lower, and side surfaces of the housing 102 into close proximity with the interior side 12 of the door 10 (e.g., such that the housing 102 functions as an interior housing or chassis). In the latter case, the removable cover 529 defines a recess into which is received the housing 102.

The removable cover 529 may removably couple to the housing 102 in a repeatable manner. For example, the housing 102 may include magnetic components 102*a* thereon (e.g., attractor plates or permanent magnets), while the removable cover 529 includes corresponding magnetic components 529*a* (e.g., attractor plates or permanent magnets) configured to magnetically couple to the magnetic components 102*a* of the housing 102. The removable cover 529 may removably couple to the housing 102 in other manners, such as with mechanical features (e.g., corresponding protrusions/recesses or spring clips)

In one example, the removable cover 529 includes an interior electrode 527*a* (i.e., on the interior side 12 of the door 10) that has an exposed conductive surface accessible for touch by users and is electrically coupleable to the capacitive sensor 527 located remotely thereto (e.g., on the circuit board 261), or which is otherwise capable of detecting touch or proximity thereto (e.g., thin plastic layer over the electrode 527*a*). As a result, capacitance can be detected directly by the interior electrode 527*a* (e.g., as opposed to through the housing 102). For example, the housing 102 (or the circuit board 261) may include one or more conductive contacts 102*b* electrically coupled to the capacitive sensor 527, while the removable cover 529 includes one or more conductive contacts 529*b* corresponding thereto and that are electrically coupled to the electrode 527*a*. When the removable cover 529 is coupled to the housing 102, the conductive contacts 102*b*, 527*b* engage each other to form an electrical connection between the electrode 527*a* and the capacitive sensor 527 whereby touch of the electrode 527*a* on the interior side 12 of the door 10 is detected capacitively with the capacitive sensor 527. The conductive contacts 102*b*, 529*b* may be configured for repeatable engagement (e.g., one, the other, or both, being spring contacts, such as spring pins). Alternatively, the interior electrode 527*a* and the capacitive sensor 527 may be conductively coupled in other manners, such as with a releasable plug/receptacle connector system).

Instead of or in addition to including the interior electrode 527*a*, the removable cover 529 may include other electronic components (depicted schematically), such as lights 529*c* that may be illuminated for different purposes (e.g., configured to emit colors or flashing patterns indicative of different conditions, such as detection of an electronic key 145, acceptable touches to the interior electrode 527*a* for operating the electronic door lock 100, or error conditions), a display 529*d*, and/or an input device (e.g., a keypad, not shown). The various electronic, including the interior electrode 527*a*, the contacts 529*b*, the lights 529*c*, the display 529*d*, and/or any conductors extending therebetween, may be in-molded structural electronics that are coupled to the cover 529 during a molding process of the cover 529 (e.g., molded into the cover 529 during an injection molding process that forms the cover 529). The various electronics may be operated by the controller 262 or other controller, which may include outputting information via the lights 529*c* and/or the display 529*d* received by the wireless communication device 264.

The electronic door lock 100 may also be configured to disable one or more functions when the cover 529 is removed therefrom, for example, presuming that that the power source 268 (e.g., batteries) are to be replaced when the cover 529 is removed from thereover. For example, the deadbolt operator 110, the touch detector 120, the deadbolt locker 130, the electronic key detector 140, and/or the door position detector 150 may be disabled or otherwise have functionality reduced when the cover 529 is removed from the electronic door lock 100. The electronic door lock 100 may determine that the cover 529 has been removed, for example, based on a change of current or voltage measured with the conductive contacts 102*b*.

When including a display 529*d*, the electronic door lock 100 (e.g., the removable cover 529 thereof) is capable of displaying graphics to a user, such as alphanumeric text, iconography, and/or pictures. The door 10 forms a necessary point of interaction between a user and a building in which the electronic door lock 100, such as when the user exits the building. As a result, the electronic door lock 100 advantageously provides an opportunity for providing information to the user in a location and on a device that that user may frequently, or necessarily, interact with. The graphics may be used to communicate various information, such as information pertaining to the electronic door lock 100, environment, and/or information received by the electronic door lock 100 form another source. Information pertaining to the electronic door lock 100 may, for example, include whether the deadbolt is locked or unlocked, battery life, fault conditions (e.g., if unable to operate the deadbolt operator or deadbolt locker), and initialization instructions (e.g., for configuring the electronic door lock 100 to work with a particular door 10 to which the electronic door lock 100 is installed), among other information. Environmental information may include, for example, time, temperature, and/or humidity information that may be sensed or otherwise determined by the electronic door lock 100. The received information may, for example, include local advertisements (e.g., associated with the building or geographic region in which the electronic door lock 100 is used, such as when used in hotel or vacation rental property), weather information (e.g., forecast and/or warnings), contact information for a tenant of the building in which the electronic door lock 100 is installed (e.g., that of an owner or manager of the building, which may be considered a primary user and have greater permissions, such as to issue electronic keys to operate the electronic door lock 100, while the tenant is considered a secondary user of the electronic door lock 100 and may have fewer permissions than the primary user). The received information may be received, for ex ample, via the wireless communications device 264.

The display 529*d* may be any suitable display screen. In one example, the display 529*d* is an ultra-low power display, such as an electronic ink display, or other display employing bistable pixels, that consumes power to change graphics but consumers no power when maintaining display of graphics over long periods of time (e.g., days, weeks). The use of an ultra-low power display may be advantageous with those embodiments of the electronic door lock 100 that are battery-powered but are generally not coupled to or otherwise receive power from a continuous power supply. With those embodiments of the electronic door lock 100 that have a continuous power supply (e.g., that are inductively powered, as discussed below with respect to the embodiment shown in FIGS. 13A and 13B), the electronic door lock 100 may include a display that consumes more power (e.g., LED, OLED, or other types of lighted displays).

In other embodiments, the electronic door lock 100 may include a display that is not removable from the electronic door lock 100 (e.g., is not part of the removable cover 529, or the electronic door lock 100 does not include the removable cover 529).

The electronic door lock 100 may also include a manual operator 525 on the interior side 12 of the door 10. The interior operator 525 is manually manipulable by the user to operate the deadbolt lock 20 (e.g., the deadbolt mechanism 22). The manual operator 525 may, for example, be a conventional thumb turn or other rotatable or pivotable knob or lever, which is couple to the pin 416 to cause rotation thereof directly or indirectly (e.g., via intermediate gears, linkages, or other mechanisms). The removable cover 529 may also be configured to cover the manual operator 525 from view when coupled to the electronic door lock 100. In such cases, the removable cover may or may not be configured to provide the further electronic functions described above (e.g., with or without the electrode 527*a* and/or the electronic components).

Figure 5G:
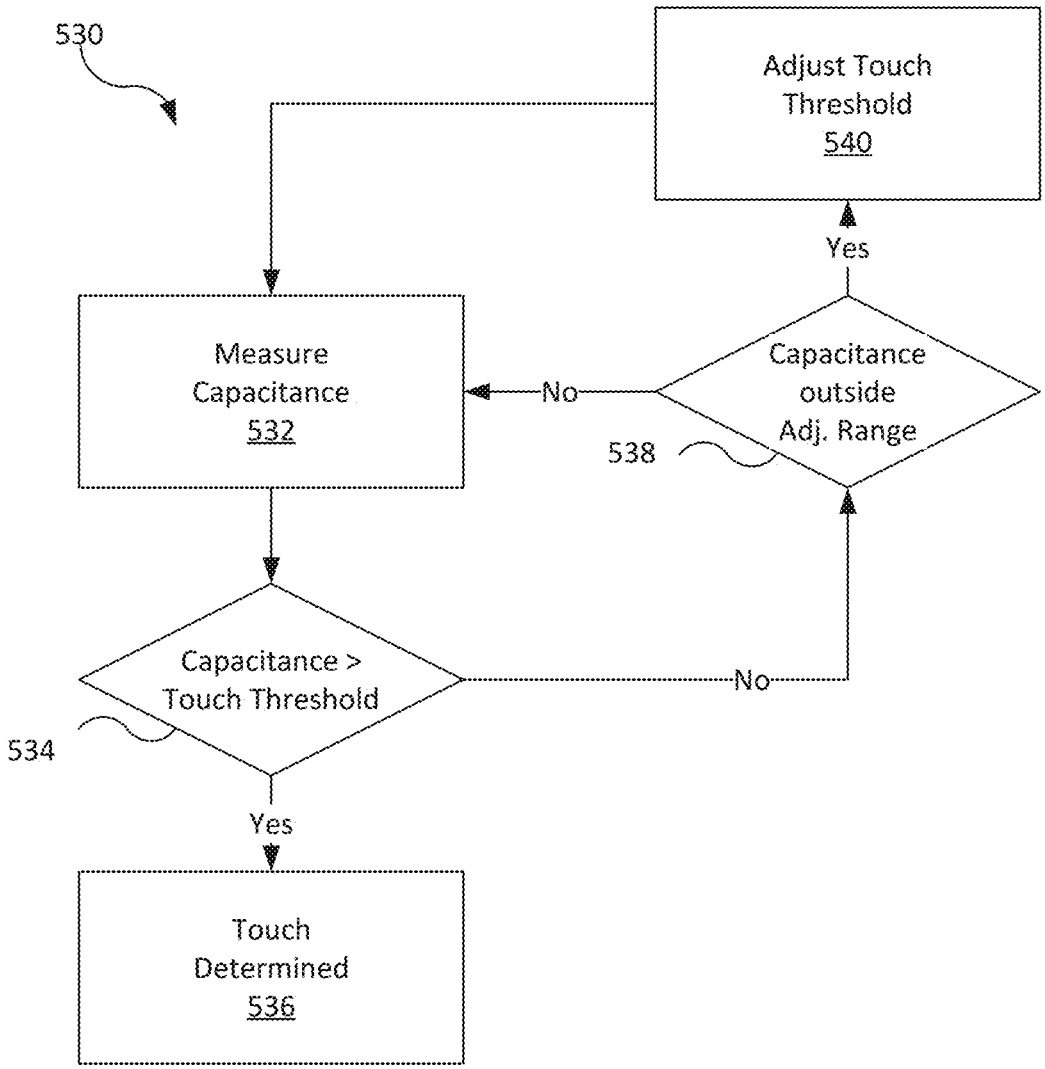
FIG. 5G is a flowchart of a technique for detecting touch with touch detector of FIG. 5A.

Referring to FIG. 5G, a technique 530 is provided for detecting touches with the touch detector 120. At 532, capacitance is measured with the touch sensor 522 and is compared to various capacitance values with the controller 524 for making various determinations. The technique 530 may also be used with the interior touch sensor 527.

At 534, the measured capacitance is compared to a touch threshold, which is a measure of capacitance (e.g., output from the touch sensor 522) indicative of the deadbolt lock 20 (e.g., the external housing 26) having been touched by a person.

At 536, if the measured capacitance is greater than (or equal to) the touch threshold, a touch is determined. The touch determination may then be used in another operation, such as determining when to operate the deadbolt lock 20 with the deadbolt operator 110.

At 538, if the measured capacitance is less than (or equal to) the touch threshold, the measured capacitance is compared to a reference capacitance. The reference capacitance is a generally constant level of capacitance that is measured absent touches to the deadbolt lock 20 and which may account for other generally static sources of capacitance near the touch sensor 522 (e.g., the external housing 26), such as environmental conditions (e.g., snow water). The reference capacitance is generally constant over periods of time longer than a duration of a touch (e.g., a few seconds, more less), but may vary over longer periods of time. For example, to compare to the reference capacitance, the capacitance measured at 532 may be compared to an adjustment range that surrounds the reference capacitance (e.g., a minimum adjustment capacitance and a maximum adjustment capacitance). If the measured capacitance is within the adjustment range, the touch threshold is not changed. Further, the reference capacitance (or adjustment range, or the minimum adjustment capacitance and maximum adjustment capacitance) may also be adjusted.

At 540, if the measured capacitance is outside the adjustment range, the touch threshold may be adjusted, for example, by an amount equal to a difference between the reference capacitance and the measured capacitance. Further, the reference capacitance (or adjustment range, or the minimum adjustment capacitance and maximum adjustment capacitance) may also be adjusted.

The measured capacitance may be determined with the touch sensor 522, for example, being a singular measurement or an average of multiple readings (e.g., between three and ten, such as four) at a suitable resolution (e.g., measurements at between 5 ms and 500 ms, such as between 10 ms and 100 ms, such as every 20 ms).

Figure 5H:
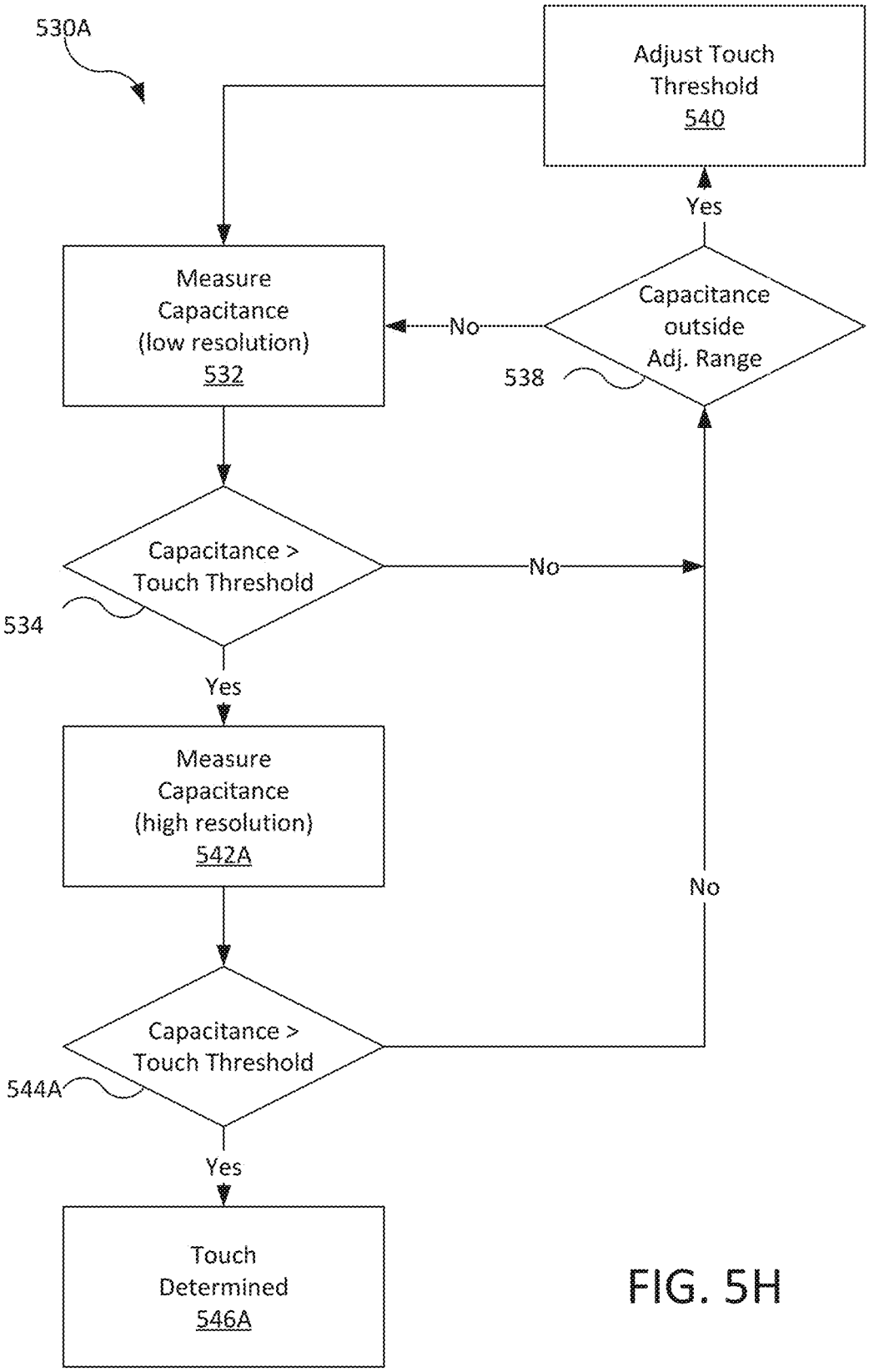
FIG. 5H is a flowchart of another technique for detecting touch with the touch detector of FIG. 5A.

Furthermore, the measured capacitance may be determined in different manners, for example, upon detecting a touch (or exceeding another capacitance value) based on a singular measurement at a low resolution (i.e., low sampling frequency), the touch may be subsequently be confirmed as an average of measurements at a higher resolution (i.e., higher sampling frequency). Referring to FIG. 5H, a technique 530A is a variation of the technique 530. The technique 530A includes the operations 532, 534, 538, and 540 as described previously. However, at 532, capacitance is measured with a low resolution (e.g., at a low sampling frequency and/or with only a single data point).

If at 534, the capacitance measured at 532 (at the low resolution) exceeds the touch threshold, capacitance is measured again at 542A at a high resolution (e.g., at a higher sampling rate than at 532 and/or an average of multiple data points, such as between three and ten, such as four).

At 544A, the capacitance measured at 542A is compared to the touch threshold. If the capacitance does not exceed the touch threshold, the technique proceeds back to 538 as described previously. If the capacitance exceeds the touch threshold, a touch is determined at 546A.

As discussed in further detail below, the touch detector 120 may compare the measured capacitance to different thresholds and over different durations to determine other conditions besides a singular touch, such as erratic touch, which may be used in other operations. The comparison to the reference capacitance 538 and subsequent adjustments 540 permit the touch detector 120 to have relatively high sensitivity, as opposed to simply setting the touch threshold at a static high level, which may permit various functionality, but may instead be omitted.

Other devices and methods pertaining to touch detection are discussed with reference to FIG. 10A to FIG. 12C.

Figure 6A:
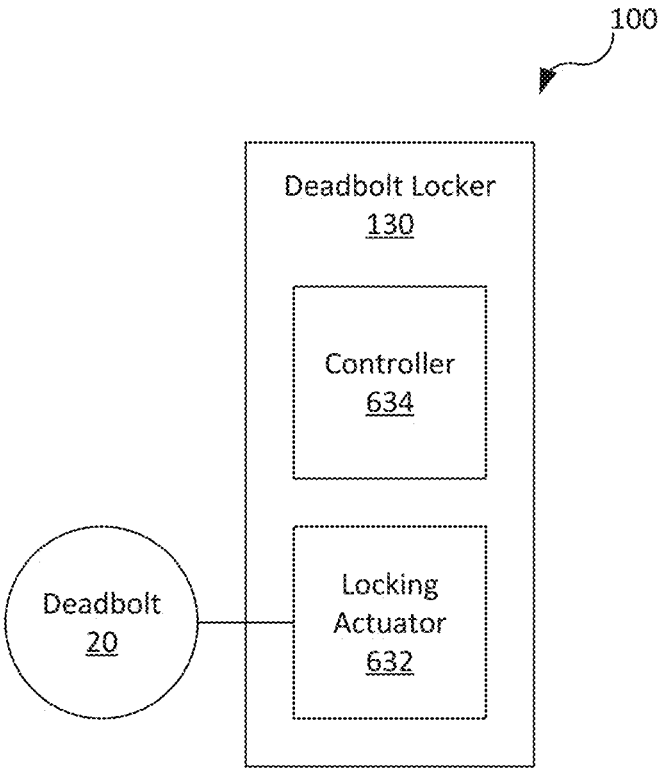
FIG. 6A is a schematic view of a deadbolt locker of the electronic door lock of FIG. 1.
Figure 6B:
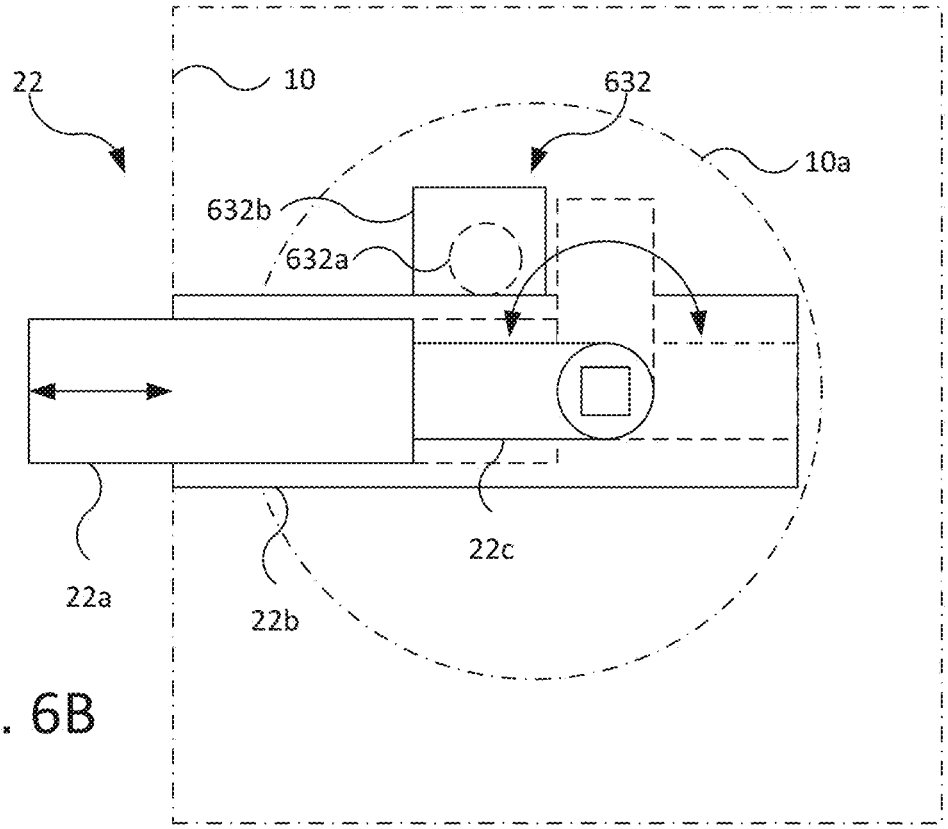
FIG. 6B is a partial cross-sectional view of the deadbolt locker and a deadbolt lock in a non-locking state.
Figure 6C:
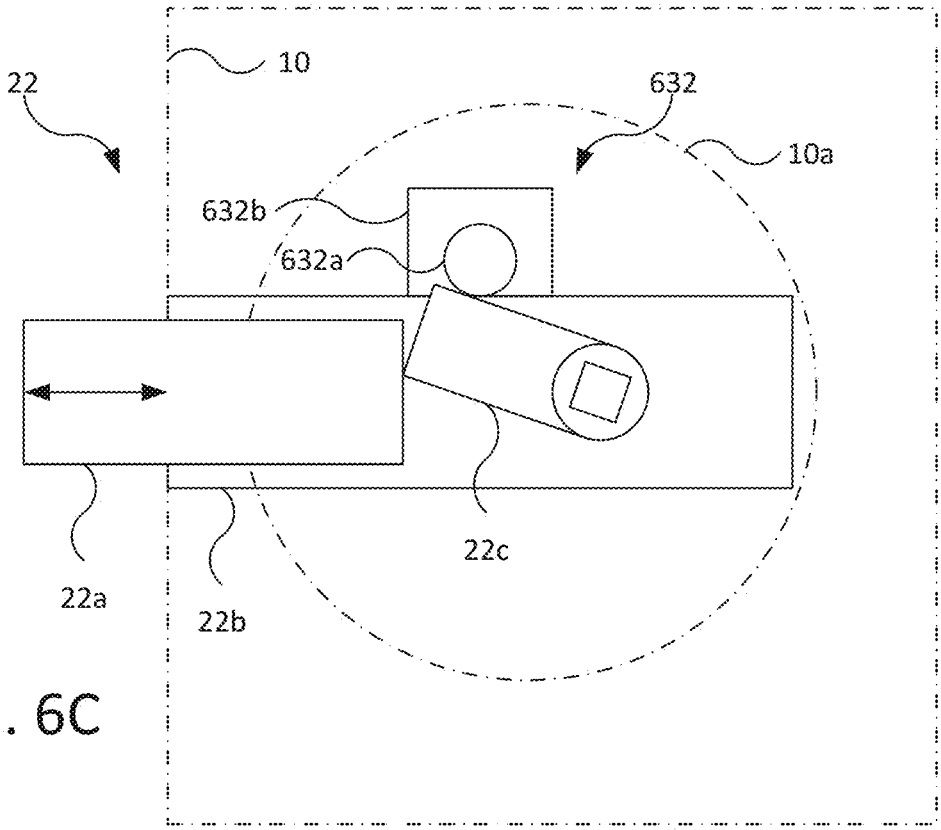
FIG. 6C is a partial cross-sectional view of the deadbolt locker and the deadbolt lock in a locking state.

Referring to FIGS. 6A-6C, the electronic door lock 100 may include the deadbolt locker 130, which is a mechanical device that physically engages the deadbolt lock 20 (e.g., the deadbolt mechanism 22 independent of the pin 416) to prevent operation thereof (e.g., the deadbolt locker 130 mechanically blocks the deadbolt lock 20). The deadbolt locker 130 generally includes a locking actuator 632 and a controller 634. The locking actuator 632 engages the deadbolt mechanism 22 to prevent operation thereof, as discussed in further detail below, and the controller 634 controls operation thereof. The controller 634 may be the controller 262, for example, such that the same controller controls operation of the deadbolt operator 110, the touch detector 120, and the deadbolt locker 130, or may be another suitable controller. The deadbolt locker 130 may also be referred to as a lock blocking, lock jamming device, or anti-picking actuator (see, e.g., description in FIGS. 11A-11L).

As shown in FIGS. 6B and 6C, the deadbolt mechanism 22 of the deadbolt lock 20 generally includes a bolt 22*a*, a body 22*b*, and a locking arm 22*c*, which are positioned within a bore 10*a* of the door 10 (both illustrated in broken dash-dot lines). As the pin (e.g., the pin 416) is rotated, the bolt 22*a* is moved relative to the body 22*b* between an extended position (shown in solid lines) and a retracted position (shown in dashed lines). For example, a cam mechanism (not shown) may be arranged between the pin and the bolt 22*a*, whereby rotation of the pin causes movement of the bolt 22*a*. Furthermore, as the pin is rotated, the locking arm 22*c* rotates between a locking position (shown in solid lines) and a non-locking position (shown in dashed lines at two rotational positions). In the locking position, a distal end of the locking arm 22*c* engages an inner end of the bolt 22*a* to prevent retraction thereof into the body 22*b*. In the locking and non-locking positions of the locking arm 22*c*, the locking arm 22*c* is generally contained by the body 22*b* (e.g., being positioned below an upper edge thereof), while the distal end thereof extends above the body 22*b* when rotating therebetween. Operation of a deadbolt lock is also discussed with respect to the deadbolt 1118 and FIGS. 11A-11L.

The locking actuator 632 of the deadbolt locker 130 is configured to engage and, thereby, prevent movement of the locking arm 22*c* from the locking position to the non-locking position. Thereby, the distal end of the locking arm 22*c* remains engaged with the inner end of the bolt 22*a* to prevent retraction thereof. The locking actuator 632 includes, for example, a locking pin 632*a* and an actuator 632*b* (e.g., a motor or a solenoid). When the locking pin 632*a* is in a retracted position (e.g., indicated by dashed lines in FIG. 6B), the locking pin 632*a* is retracted toward the interior side 12 of the door 10 and, thereby, allows the locking arm 22*c* of the deadbolt mechanism 22 to rotate between the locking and non-locking positions. When the locking pin 632*a* is in an extended position (e.g., indicated by solid lines in FIG. 6C), the locking pin 632*a* is extended toward the exterior side 14 of the door 10 and is positioned above the locking arm to, thereby, engage and prevent rotation of the locking arm 22*c* from the locking position to the non-locking position thereof.

Figure 6D:
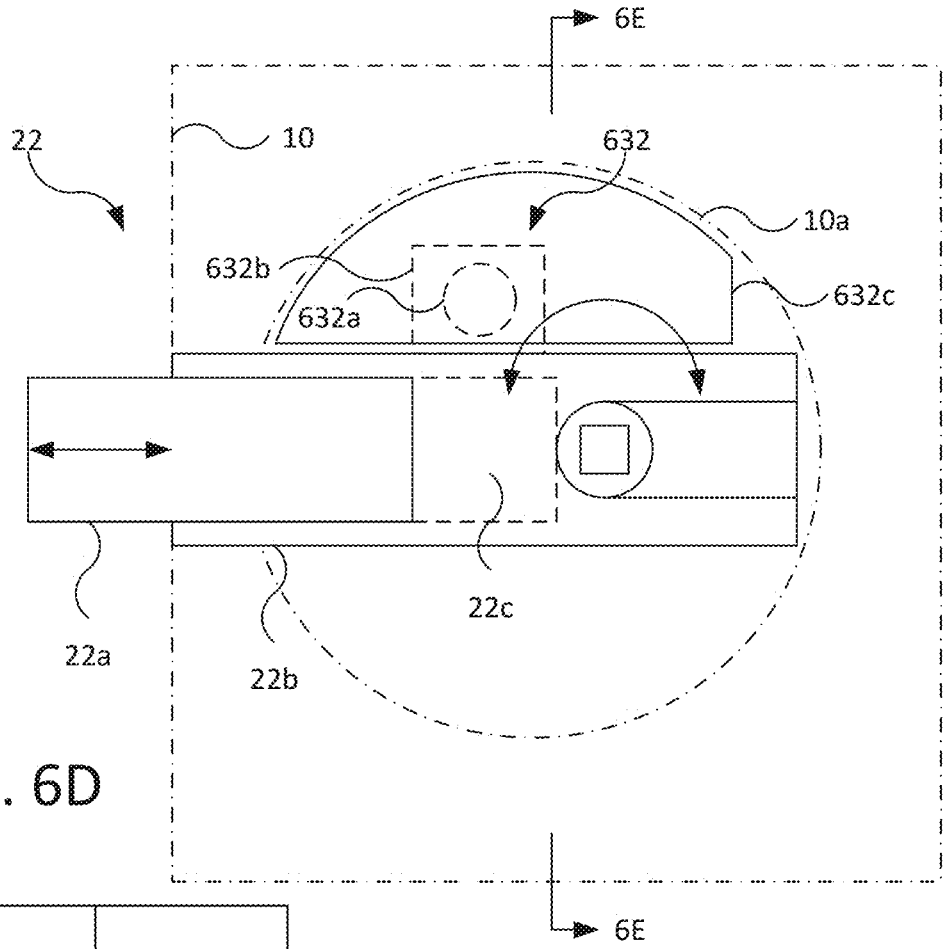
FIG. 6D is a partial cross-sectional view of the deadbolt locker having a locking block.
Figure 6E:
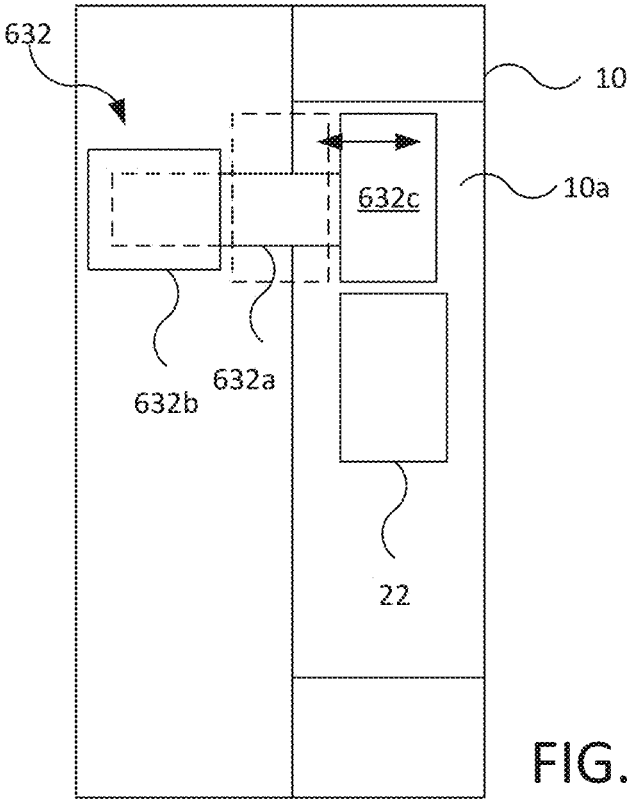
FIG. 6E is a partial cross-sectional view taken along line 6E-6E in FIG. 6D illustrating the deadbolt locker in a locked state (solid lines) and an unlocked state (dashed lines).

Referring to FIGS. 6D-6E, the deadbolt locker 130 may further include a locking block 632*c* coupled to the locking pin 632*a* or otherwise movable by the locking actuator 632. The locking block 632*c*, as compared to the locking pin 632*a*, may fill a larger space between the deadbolt mechanism 22 and the bore 10*a* of the door 10. Thus, as the locking arm 22*c* is attempted to be rotated, the locking arm 22*c* presses the locking block 632*c* into the surface of the door 10 defining the bore 10*a*, thereby transferring force arising from the torque applied to the locking arm 22*c* from the locking block 632*c* to the door. As a result, the locking actuator 632 may be required to bear only a nominal force in the radial direction of the locking pin 632*a*, while still preventing operation of the deadbolt lock 20. Further, considering that different predominant manufacturers may have or continue to produce deadbolts mechanisms 22 with different designs (e.g., geometries), the electronic door lock 100 may be provided (e.g., sold) with a set of different locking blocks 632*c* that correspond to the designs of those deadbolt locks 20 (e.g., the deadbolt mechanisms 22) from the different manufacturers and that are interchangeably coupleable to the locking actuator 632 (e.g., the locking pin 632*a*). The locking block 632*c* and the locking block assembly 632*c*' may also be used with the anti-picking actuator 1124 described below. While depicted as having an irregular shape, the locking block 632*c* may have any suitable shape (e.g., rectilinear, circular, ovoid).

Figure 6F:
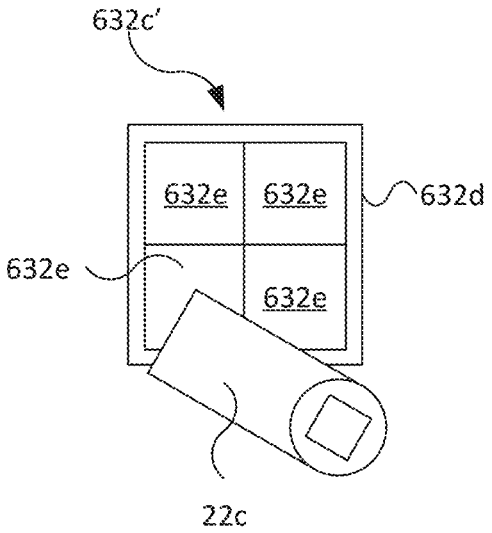
FIG. 6F is a partial front view of a locking block assembly of a deadbolt locker.
Figure 6G:
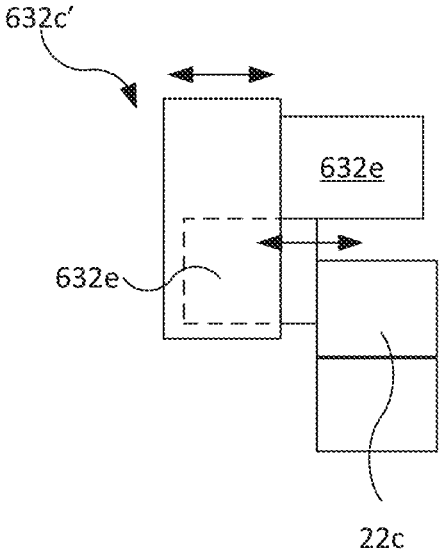
FIG. 6G is a partial side view of the locking block assembly with a hidden portion shown in dashed lines.

Referring to FIGS. 6F-6G, a locking block assembly 632*c*' may include a base 632*d* coupled to and movable by actuator 632*b* and multiple blocks 632*e* (e.g., two, three, four (as shown) that are normally sprung outward (e.g., toward the exterior side 14 of the door 10) but may be biased inward. For example, when the actuator 632*b* is operated and the locking block assembly 632*c* is moved outward, the one or more of the blocks 632*e* (e.g., two lower blocks 632*e* as shown) are biased inward (e.g., inside) relative to the base 632*d* (e.g., the lower blocks 632*e* as shown). Those blocks 632*e* that do engage the locking arm 22*c* (e.g., the two upper blocks 632*e* as shown) extend to a position above the locking arm 22*c* and, thereby, may prevent further rotational movement of the locking arm 22*c*. While depicted as having a squared shape, the locking blocks 632*e* may have any suitable shape (e.g., rectilinear, circular, ovoid, irregular).

Figure 7A:
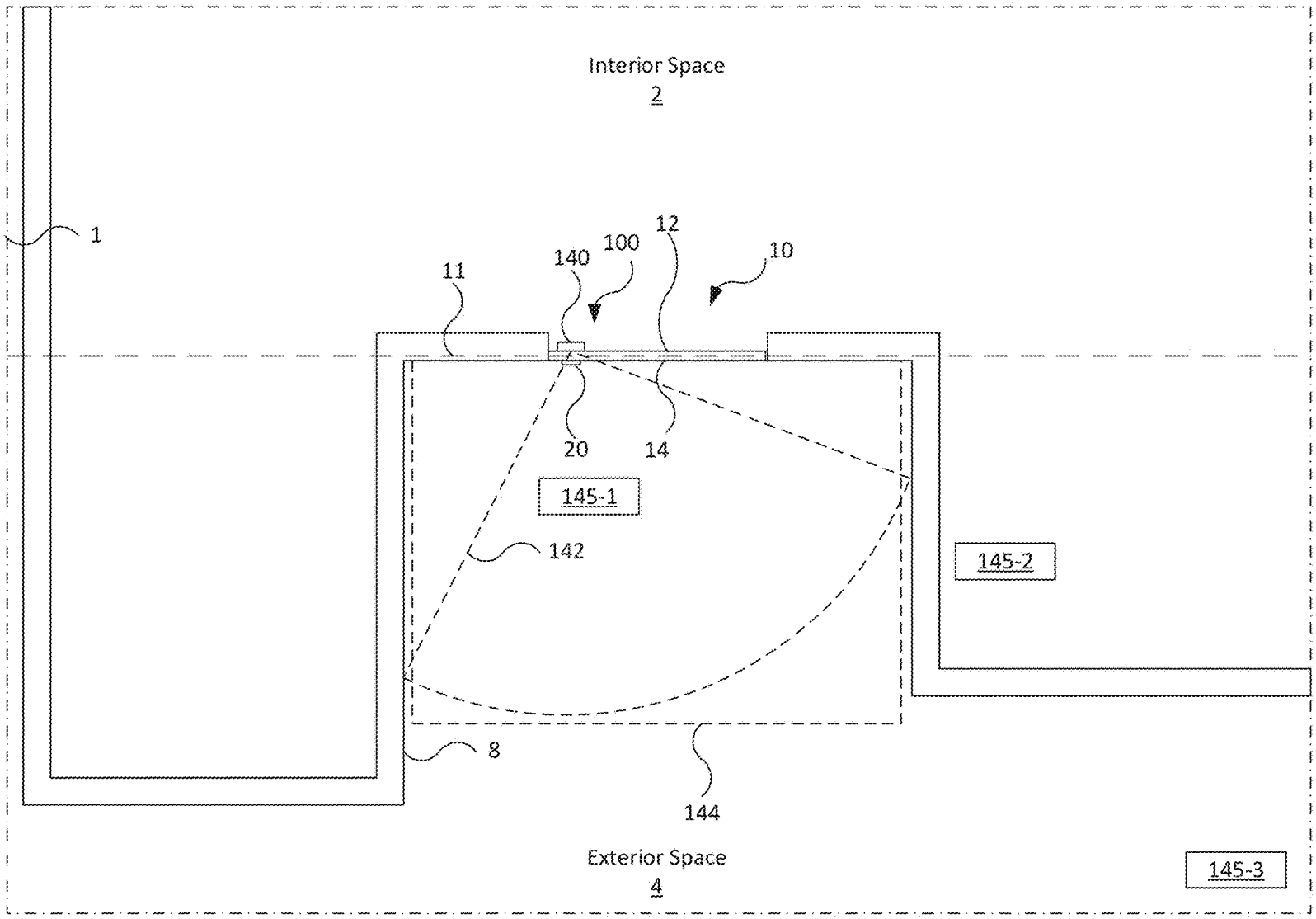
FIG. 7A is a top view of a building structure having an entry door with an electronic door lock having an electronic key detector.

Referring to FIGS. 7A-7O, the electronic door lock 100 may include the electronic key detector 140. The electronic key detector 140 determines whether any of the electronic keys 145 that are associated with the electronic door lock 100 is in a detection region 142 (or an alternative detection region 144). The detection region 142 is a constrained volume on an exterior side 14 of the door 10. The detection region 142 is limited dimensionally relative to the door 10 (e.g., relative to the electronic key detector 140 on the door 10) to prevent key detections for electronic keys 145 not associated with persons attempting to unlock the deadbolt lock 20. A key detection is a determination that an electronic key is within the detection region 142.

Other devices and methods pertaining to further securing the deadbolt lock 20 and/or detecting lock picking (or other malintent) are discussed with reference to FIG. 10A to FIG. 12C. The electronic key detector may also be referred to a key locator.

Referring to FIG. 7A, a space 1 may be divided into an interior space 2 and an exterior space 4 by a door plane 11 defined by the door 10 when closed. The interior space 2 is on the interior side 12 of the door plane 11, and the exterior space 4 is on the exterior side 14 of the door plane 11. However, because a building structure 8 may extend forward of the door plane 11 (i.e., toward the exterior side 14), an interior volume of the building structure 8 may be positioned in the exterior space 4 (i.e., on the exterior side 14 of the door plane 11 of the door 10). While not shown, the interior volume of the building structure 8 may also extend into the exterior space 4 above or below the door 10 (e.g., in a lower level or an upper level, respectively).

The detection region 142 is limited dimensionally to prevent detection of the electronic keys 145 that are not spatially associated with persons attempting to open the door 10. For example, the detection region 142 is dimensioned to not include the interior side 12 or the interior volume of the building structure 8 that is positioned on the exterior side 14 of the door 10, so as to prevent key detection of the electronic keys 145_2 inside the building structure 8. Further, the detection region 142 is dimensioned to not include electronic keys 145_3 outside a reasonable distance from the door 10.

A building code may be determined by a governmental organization and dictate building shapes, which the detection region 142 may be configured to account for, such that the electronic key detector 140 may be utilized with different building structures complying with the building code. For example, referring to FIG. 7B, a building code may require that any portion of a building structure extending forward of a door 10, such as an entry door to a home or other building structure, be at least two feet from a door frame of the door 10 (e.g., from the edges of the door 10). Therefore, on a hinge side 16 of the door 10, any forwardly-extending portion of the building structure is at least two feet (per the building code), plus a width of the door 10 (e.g., 32 inches for common entry door sizes), minus an offset for the bore location of the deadbolt lock 20 (e.g., typically 2.375 inches or 2.75 inches from a lock-side edge of the door 10). Thus, any hinge-side forwardly-extending portion of the building structure 8 will generally be four feet six inches (i.e., 4' 6") or more from the electronic key detector 140. On a lock side 18 of the door 10, any forwardly-extending portion of the building structure is at least two feet (per the building code) plus the offset for the bore location of the deadbolt lock 20. Thus, any lock-side forwardly-extending portion of the building structure 8 will generally be two feet, two inches or more from the electronic key detector 140.

Figure 7B:
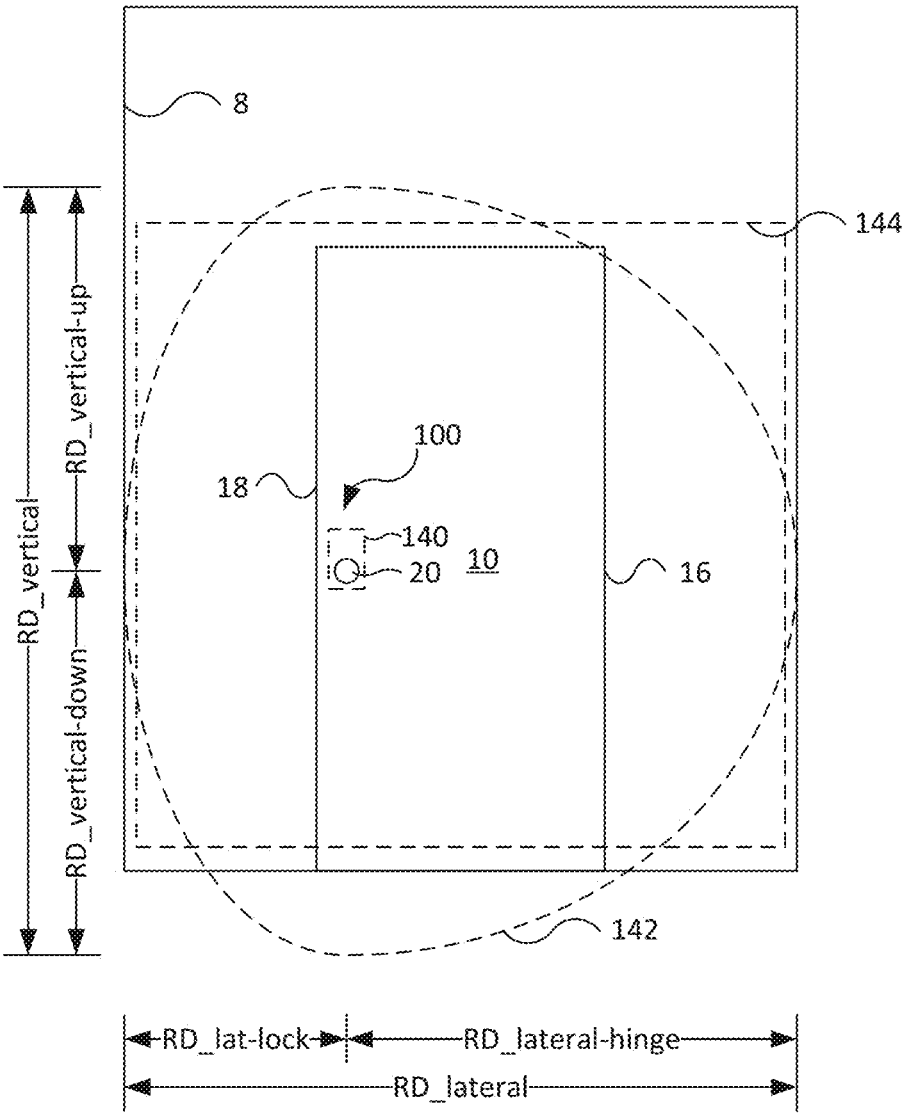
FIG. 7B is a front view of the building structure illustrating a detection region of the key detector.
Figure 7C:
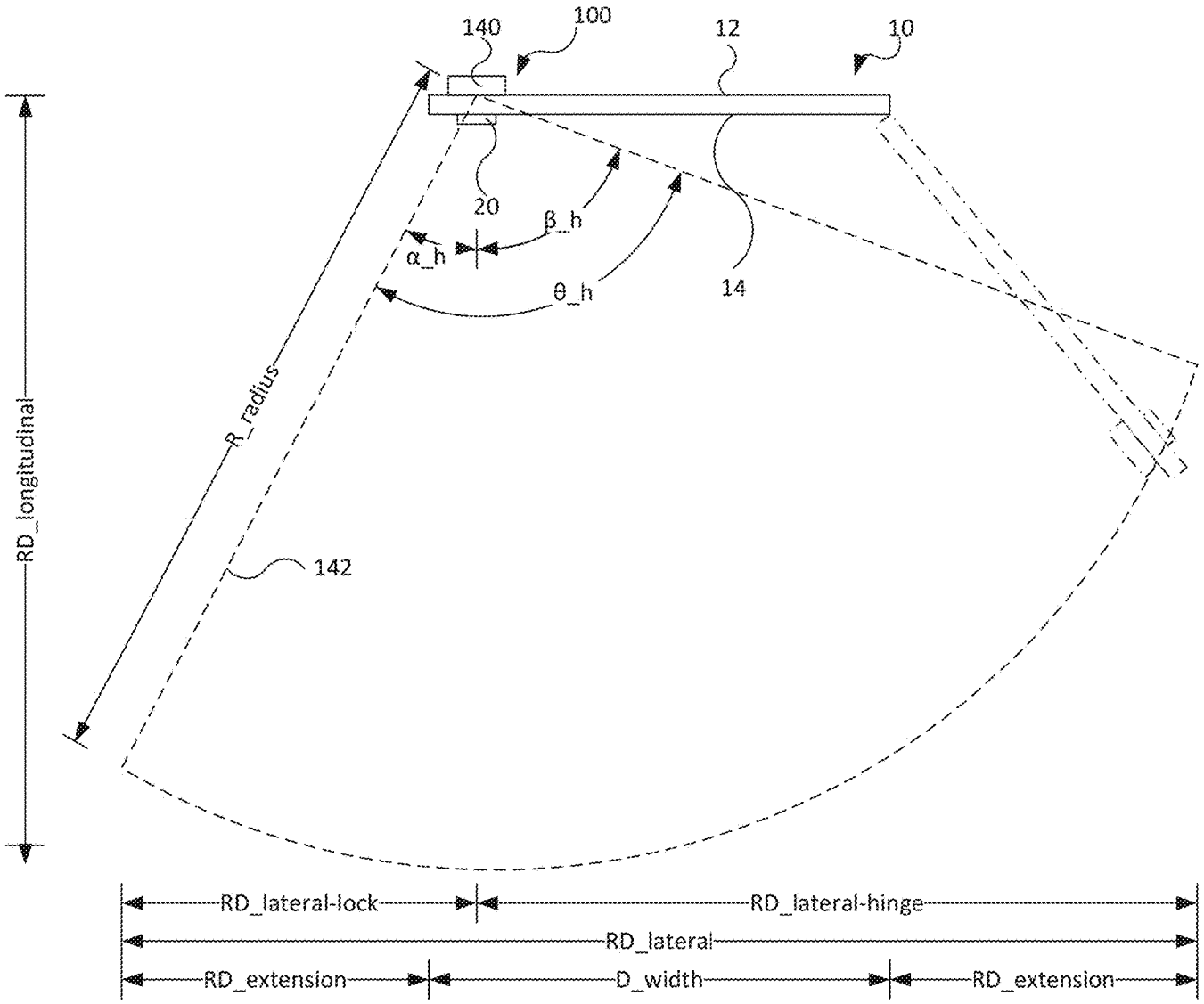
FIG. 7C is a top view of the entry door illustrating the detection region.
Figure 7D:
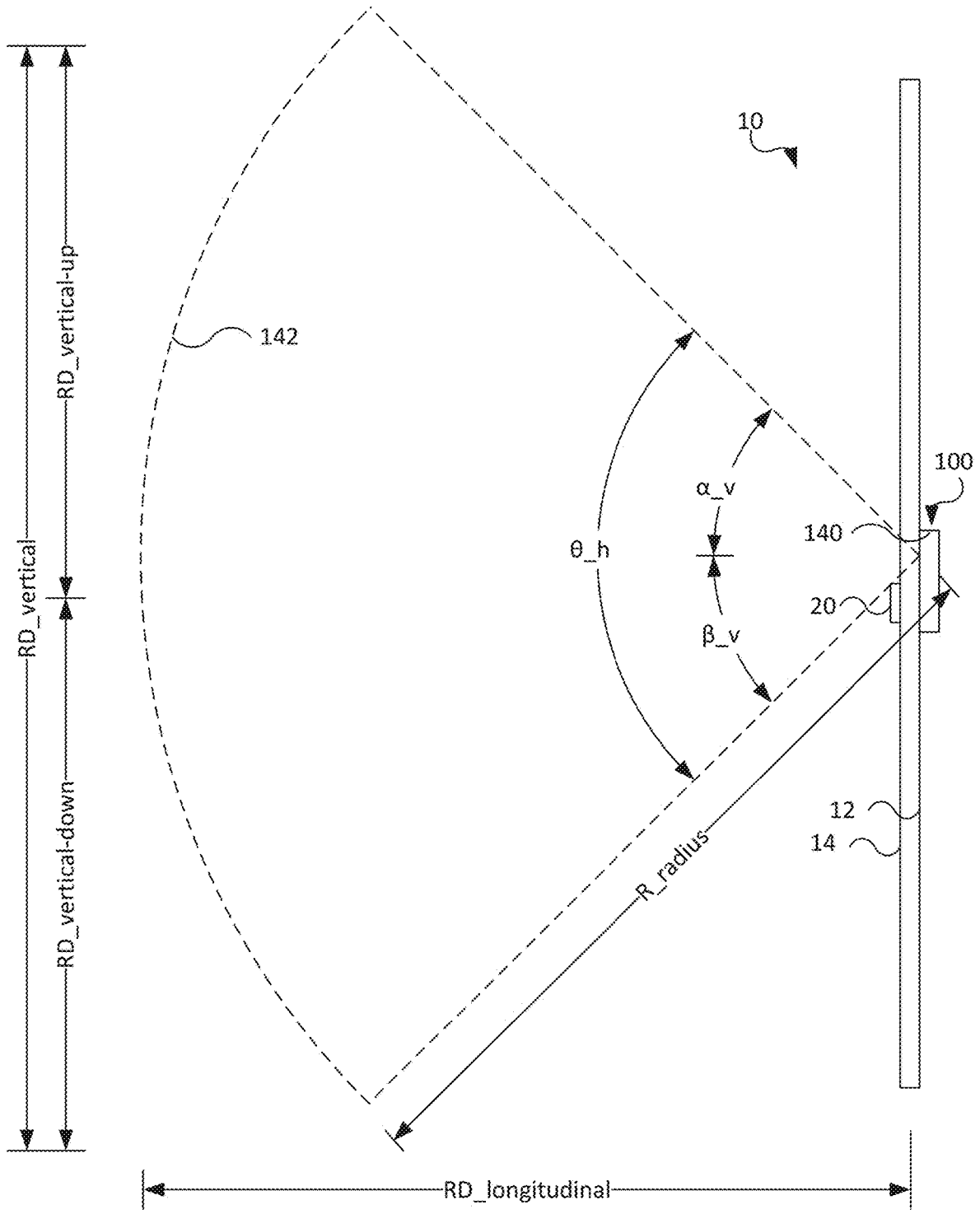
FIG. 7D is a side view of the entry door illustrating the detection region.

Referring to FIGS. 7B-7D, the detection region 142 may be defined by one or more of a lateral detection distance RD_lateral measured horizontally parallel with the door plane 11, a vertical detection distance RD_vertical measured vertically parallel with the door plane 11, and a longitudinal detection distance RD_longitudinal measured horizontally perpendicular to the door plane 11. The lateral detection distance RD_lateral may be further divided into a hinge-side component (e.g., a hinge-side lateral detection distance RD_lateral-hinge) and a lock-side component (e.g., a lock-side lateral detection distance RD_lateral-lock), which are measured from the electronic key detector 140 and may be the same or different as discussed in further detail below. The vertical detection distance RD_vertical may be further divided into an upper component (e.g., an upper-side vertical distance RD_vertical-up) and a lower component (e.g., a lower-side vertical distance RD_vertical-down) measured from the electronic key detector 140, which may be the same or different as discussed in further detail below. The longitudinal detection distance RD_longtidunal is measured from the electronic key detector 140.

Referring to FIGS. 7B-7C, in one example, the lateral detection distance RD_lateral is fifteen feet or less, such as approximately twelve, 10, or seven feet or less or a range therein (e.g., approximately six to eight feet). The hinge-side lateral detection distance RD_lateral-hinge and the lock-side lateral detection distance RD_lateral-lock may be equal, for example, being approximately ten, eight, six, five, or four feet or less or a range therein (e.g., between three and six feet).

Alternatively, the hinge-side lateral detection distance RD_lateral-hinge and the lock-side lateral detection distance RD_lateral-lock may be unequal, such that the detection region 142 is off-center or asymmetric (e.g., horizontally or laterally off-center or asymmetric) relative to the electronic key detector 140 in the door plane 11. As is illustrated, the hinge-side lateral detection distance RD_lateral-hinge may be greater than the lock-side lateral detection distance RD_lateral-lock, which may account for the building code described above, such as being at least 75%, 50%, 40%, or 25% greater or a range therein (e.g., being between 30% and 60% greater). In one specific example, the hinge-side lateral detection distance RD_lateral-hinge is between 4 and 6 feet, while the lock-side lateral detection distance RD_lateral-lock is between 2 and 4 feet.

As also shown in FIG. 7C, as an alternative to the detection region 142 being measured relative to the electronic key detector 140, the detection region 142 may instead be measured as a lateral extension distance from edges of the door 10 (e.g., a lock-side edge and a hinge-side edge), such that the lateral detection distance RD_lateral may equal the lateral extension distance RD_extension plus a door width D_width of the door 10. For example, the lateral extension distance RD_extension may be approximately two feet, resulting in a lateral detection distance RD_lateral of approximately six feet eight inches (e.g., between approximately 6 and 8 feet) for a standard or predetermined door width of 32 inches.

Referring to FIGS. 7B and 7D, in one example, the vertical detection distance RD_vertical is twelve feet or less, such as approximately ten, eight, or seven feet or less or a range therein (e.g., approximately six to eight feet). The upper-side vertical detection distance RD_vertical-up and the bottom-side vertical detection distance RD_vertical-down may be equal, for example, being approximately six, five, or four feet or less or a range therein (e.g., four to six feet) or may be different.

Referring to FIGS. 7C and 7D, the longitudinal detection distance RD_longitudinal is ten feet or less, such as approximately eight, six, or five feet or less or a range therein (e.g., approximately four to six feet).

As illustrated in FIGS. 7A-7D, the detection region 142 may have a generally conical shape emanating from the electronic key detector 140, which is defined by the distances described above (e.g., Cartesian coordinates include RD_lateral, RD_vertical, RD_longitudinal, and components thereof). The conical shape of the detection region 142 may instead or additionally be defined in Euclidian coordinates relative the electronic key detector 140 and which may account for building codes. Referring to FIG. 7C, in a horizontal plane, the detection region 142 spans a detection range θ_h, which may include components of a lock-side detection angle α_h and a hinge-side detection angle β_h that are measured horizontally from the longitudinal direction and may be the same or different as discussed in further detail below. Referring to FIG. 7D, in a vertical plane, the detection region 142 spans an angular distance θ_v, which may include components α_v and β_v that are measured vertically from the longitudinal direction and may be the same or different as discussed in further detail below. The detection region 142 further spans a detection radius R_radius measured from the electronic key detector 140.

The horizontal detection range θ_h may, for example, be between approximately 65 and 135 degrees, such as between approximately 70 and 125 degrees (e.g., between approximately 90 and 110 degrees). The lock-side detection angle α_h may be between approximately 15 and 45 degrees, such as between approximately 20 and 35 degrees (e.g., between approximately 24 and 30 degrees). The hinge-side detection angle β_h may be between approximately 45 and 90 degrees, such between approximately 60 and 90 degrees (e.g., between approximately 55 and 70 degrees).

The lock-side detection angle α_h and the hinge-side detection angle β_h may also be defined by a formula α_h=arcsin (C+DB_offset/R_radius) and β_h=arcsin (C+D_width−DB_offset), where C=a distance required by code from the door edge, DB_offset is the center of the bore location from the lock side 18 of the door 10, D_width is the width of the door, and R_radius is a selected value (e.g., 5 feet).

The vertical detection range θ_v may, for example, be between approximately 60 and 120 degrees, such as between approximately 70 and 110 degrees (e.g., between approximately 80 and 100 degrees). The upper detection angle α_v may be between approximately 30 and 60 degrees, such as between approximately 35 and 55 degrees. The lower detection angle β_v may be between approximately 30 and 60 degrees, such between approximately 35 and 55 degrees. The upper detection angle α_v and the lower detection angle β_v may be the same or different. In other examples, the lower detection angle β_v may be approximately degrees (e.g., to detect electronic keys 145 on the ground adjacent the door 10).

The detection radius R_radius may be approximately ten feet or less, such as six, five, or four feet or less or a range therein (e.g., between four and six feet).

An alternative detection region 144 may, instead of having a generally conical shape, have another shape, such as a rectangular prism (see FIGS. 7A-7B) defined by the Cartesian dimensions described above (e.g., RD_lateral, RD_vertical, RD_longitudinal, and components thereof). The detection region R-detection may, for example, be governed according to the type or configuration of the electronic key detector 140.

Figure 7E:
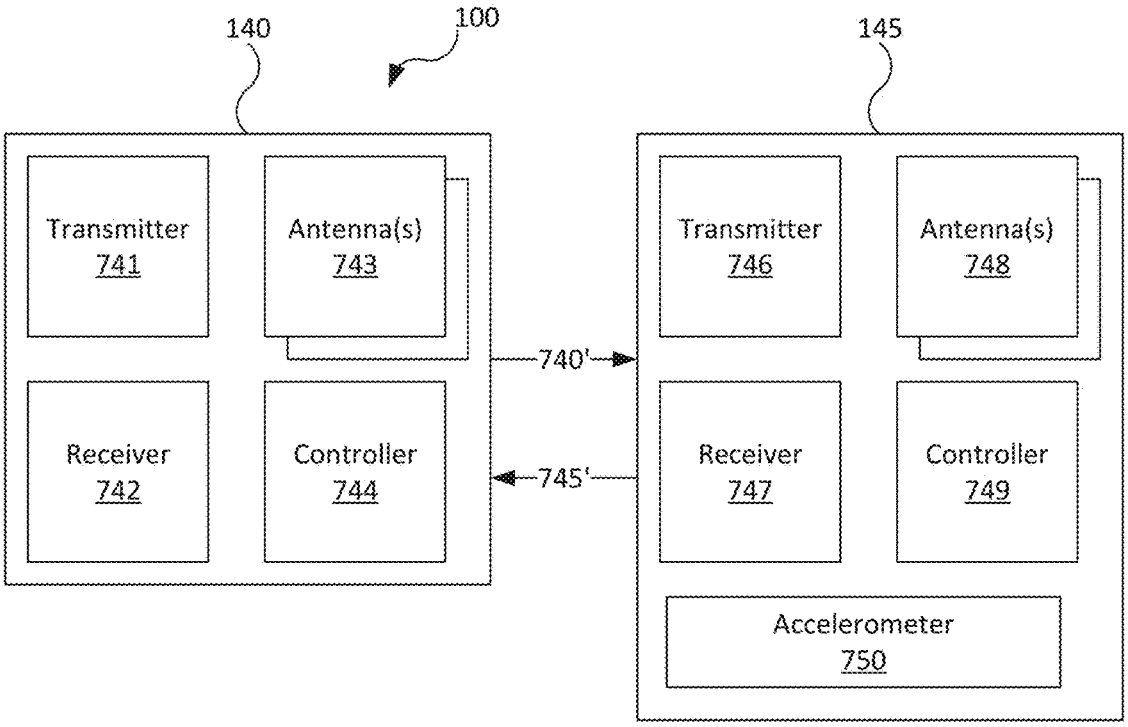
FIG. 7E is a schematic view of the electronic key detector in wireless communication with an electronic key.

Referring to FIG. 7E, the electronic key detector 140 generally includes a transmitter 741, a receiver 742, and one or more antennas 743 coupled thereto, as well as a controller 744 that controls sending of signals with the transmitter 741 and interprets signals received by the receiver 742. The controller 744 may be the controller 262 or may be another similarly configured controller. The electronic keys 145, similarly, each include a transmitter 746, a receiver 747, and one or more antennas 748 coupled thereto, as well as a controller 749 that controls sending of signals with the transmitter 746 and interprets signals received by the receiver 747. The electronic key 145 may also include an accelerometer 750.

To detect the electronic key 145, the electronic key detector 140 sends a lock signal 740' (e.g., a first, challenge, or door signal) to a broadcast region that forms the detection region 142. The lock signal 740' may be sent, for example, in response to detecting touch with the touch detector 120. If the electronic key 145 is within the broadcast region and receives the lock signal 740' at sufficient strength, the electronic key 145 receives the lock signal 740' and sends a key signal 745' (e.g., a second signal) in response thereto, which is then received by the electronic key detector 140. The lock signal 740' may be encrypted or otherwise secured, such that only those electronic keys 145 associated with the electronic key detector 140 may decipher the lock signal 740' and send the key signal 745' in response thereto. Because the electronic key 145 only sends the key signal 745' in response to receiving the lock signal 740' and must be in the detection region 142 to receive the lock signal 740', the electronic key detector 140 detects the electronic key 145 by receiving the key signal 745' therefrom (i.e., determines that the electronic key 145 is in the detection region 142). Those electronic keys 145 outside the detection region 142 will not receive the lock signal 740' from the electronic key detector 140 and, thereby, will not send the key signal 745', such that the electronic key detector 140 will detect those electronic keys 145 outside the detection region 142.

Those electronic keys 145 in the detection region 142 but not associated with the electronic key detector 140 may not interpret (e.g., decrypt) the lock signal 740' and, therefore, will not send the key signal 745' in response thereto. Further, the electronic key detector 140 may filter out any of the key signals 745' that are received below a given signal strength (e.g., suggesting the electronic key 145 is outside the detection region 142). Still further, the key signal 745' may contain acceleration data from the accelerometer 750 of the electronic key 145 and may filter out any of the key signals 745' having acceleration data indicating no movement of the electronic key 145 (e.g., in case the electronic key 145 is inadvertently left on a stable surface in the detection region 142). The key signal 745' may also be encrypted, so as to only be decipherable by the electronic door lock 100 associated with the electronic key 145. The door signal 740' may further include identifying information, such as a username or unique alphanumeric code), which may enable the electronic key detector 140 to decipher between those electronic keys 145 associated therewith (e.g., electronic keys 145 of different users for which access through the door 10 should be permitted).

The electronic key 145 may be a dedicated purpose device (e.g., only functioning as an electronic key for use with the electronic key detector 140), or may be another multi-purpose device with suitable hardware and software (e.g., a smartphone) for receiving and deciphering the lock signal 740' and sending the key signal 745' in response thereto.

Figure 7F:
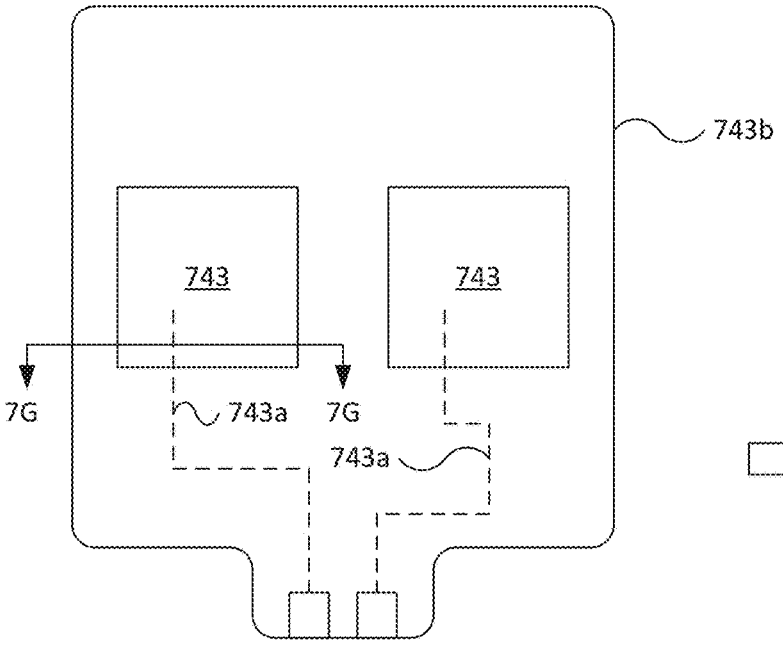
FIG. 7F is a front view of an antenna array of the key detector.
Figure 7G:
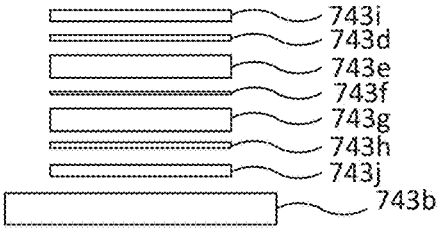
FIG. 7G is an exploded cross-sectional view of the antenna taken along line 7G-7G in FIG. 7F.

Referring to FIGS. 7F-7G, in one embodiment, the antennas 743 of the key detector 140 are configured as a patch antenna array that includes two of the antennas 743 that are patch antennas. The two antennas 743 are cooperatively configured to send the lock signal 740' to a broadcast region that forms the detection region 142. For example, the patch antennas 743 are coupled to feedpaths 743*a* at off-center locations of the antennas 743, which causes each of the antennas 743 to broadcast the lock signal 740' asymmetrically relative thereto. Further, the two antennas 743 are driven by the transmitter 741 to send the first signal 90 degrees off-phase relative to each other, which causes destructive interference therebetween to shape the broadcast region of the lock signal 740' into the detection region 142. Further, the antennas 743 and/or other electronic components may create intentional loss, such that the lock signal 740' and/or the key signal 745' are not broadcast to and/or not receivable from beyond a desired distance (e.g., a detection radius R_radius of approximately five feet, such as between four and six). Thus, assuming the antennas 743 are driven above a minimum required power, the lock signal 740' will not be sent to the detection region 142 at greater than a required power level (e.g., to be detectable by the electronic key 145) regardless of power driving the antennas 743.

Each of the feedpaths 743*a* extend along (e.g., through the circuit board 743*b*) from the antenna 743 coupled thereto to a connector 743*c* (e.g., a coax connector).

Figure 7H:
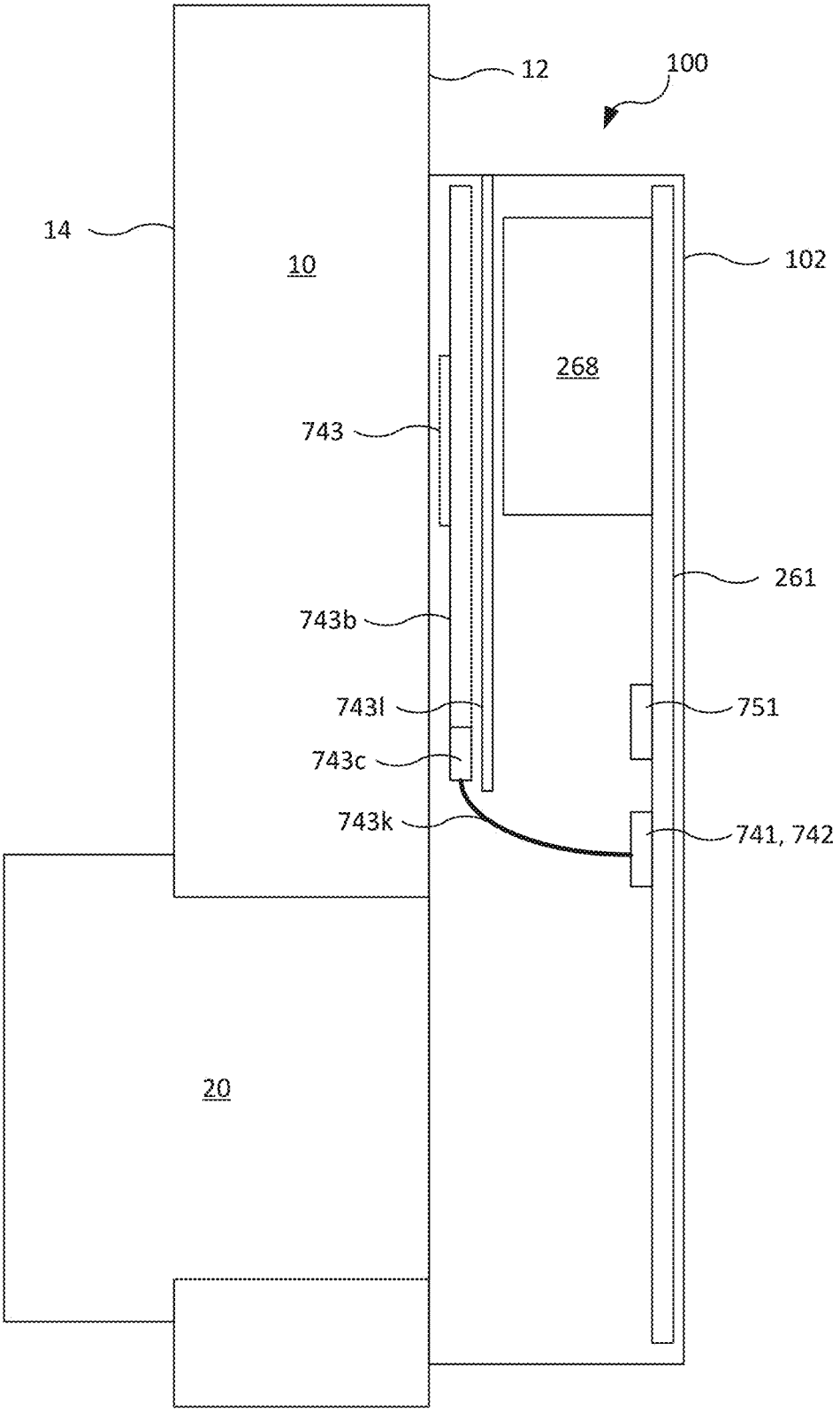
FIG. 7H is a cross-sectional view of the entry door, a deadbolt, and the electronic door lock, including the electronic key detector.

As shown in the exploded cross-sectional view of FIG. 7H, the two antennas 743 are multi-layer assemblies that are coupled to a circuit board 743*b*. Each of the antennas 743 includes, in order, a first copper layer 743*d* (e.g., 1.4 mil), a first dielectric layer 743*e* (e.g., 25 mil of a RO3000 series laminate from Rogers Corp.), a second copper layer 743*f* (e.g., 0.7 mil), a second dielectric layer 743*g* (e.g., 32 mil, which may itself be a multi-layer structure of RO4000 laminate from Rogers Corp.), and a third copper layer 743*h* (e.g., 1.4 mil) that may form a ground plane. Each of the antennas 743 may further include a top paste and/or overlay layer 743*i* and a bottom paste and/or overlay layer 743*j*). The feedpaths 743*a* may extend through the second copper layer 743*f* and the third copper layer 743*h* and conductively couple to the first copper layer 743*d*.

Referring to FIG. 7H, the transmitter 741 and the receiver 742 of the key detector 140 are coupled to the circuit board 261, which is the main (or primary) circuit board of the electronic door lock 100, but may alternatively be coupled to the circuit board 743*b* to which the antennas 743 are coupled. The transmitter 741 is connected to the two antennas 743 via wires 743*k* (e.g., coax) through which the transmitter 741 drives the two antennas 743 to send the lock signal 740'. More particularly, the transmitter 741 drives the two antennas 743 off-phase (e.g., by 90 degrees or a quarter wave apart), such as the first antenna 743 being driven at a 0-degree phase shift and the second antenna being driven at a 90-degree phase shift), for example, to cause destructive interference therebetween. As referenced above, this allows the electronic key detector 140 to broadcast the lock signal 740' in the shape of the detection region 142 (e.g., generally conical and asymmetric relative to the electronic key detector 140, as shown). Further, the transmitter 741 is additionally configured to change the phases at which the two antennas 743 are driven (e.g., shifting each by 90 degrees), for example, to a −90-degree phase shift and a 0-degree phase shift, respectively. This shifted configuration allows the electronic key detector 140 to broadcast the lock signal 740' symmetrically opposite to the non-shifted configuration, which allows the key detector 740 to account for the hinge side 16 of the door 10 being on the right (as shown) or the left.

Still referring to FIG. 7H, the array of the two antennas 743 are positioned within a housing 102 of the electronic door lock 100 and adjacent the interior side 12 of the door 10, for example, with the antennas 743 and/or the circuit board 743*b* parallel with the door plane 11. Rearward of the circuit board 743*b* is positioned a shield 7431 (e.g., a copper or aluminum sheet). The shield 7431 functions to block the lock signal 740' from being emitted rearward, prevents transmission of the lock signal 740' rearward and/or receipt of the key signal 745' from rearward, and further prevents interference (e.g., electromagnetic interference) from the power source 268 (e.g., the batteries) therebehind from reaching the antennas 743.

Still referring to FIG. 7H, the electronic door lock 100 may include another antenna 751 and related circuitry (e.g., driver and/or receiver) for sending and/or receiving signals to and/or from other devices. The antenna 751 may, for example, be configured to send and/or receive signals wirelessly through any suitable protocol (e.g., Wi-Fi, Bluetooth, or BLE). The other electronic devices may, for example, be electronic devices associated with authorized users (e.g., a smartphone or other electronic key 145), which may be located on the inside the building structure 8. The antenna 751 may be omnidirectional (e.g., able to send and/or receive signals to and/or from either side of the door 10). Further, the antenna 751 may be one of the wireless communication devices 264 and may be considered part of the electronic key detector 140 (e.g., responsive to touch on the exterior side 14 of the door 10) or another electronic key detector 140 (e.g., responsive to touch on the interior side 12 of the door 10, such as with the interior touch sensor 527). As such, the electronic door lock 100 may include one electronic key detector 140, or two separate electronic key detectors 140, that is (or are) operable to separately detect an electronic key 145 in the key detection region 144 or on the interior side 12 of the door 10.

Figures 1, 7I:
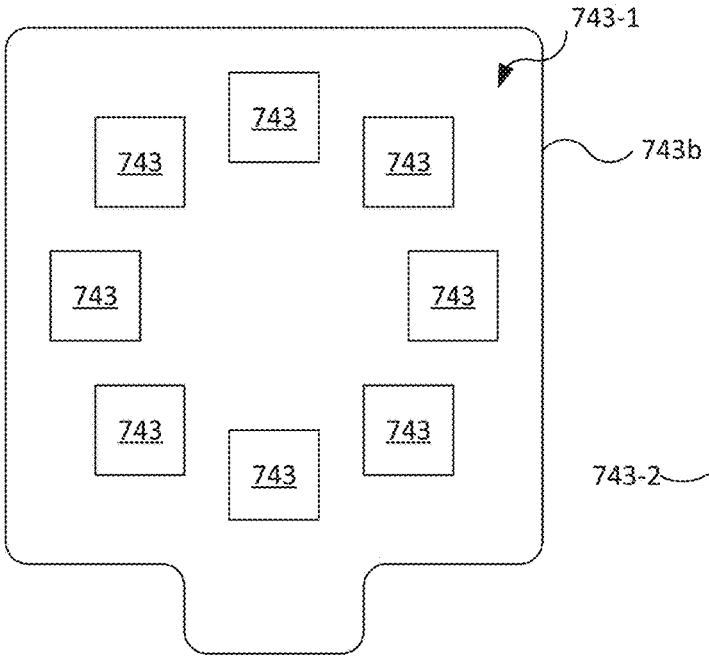
Figures 2, 7I:
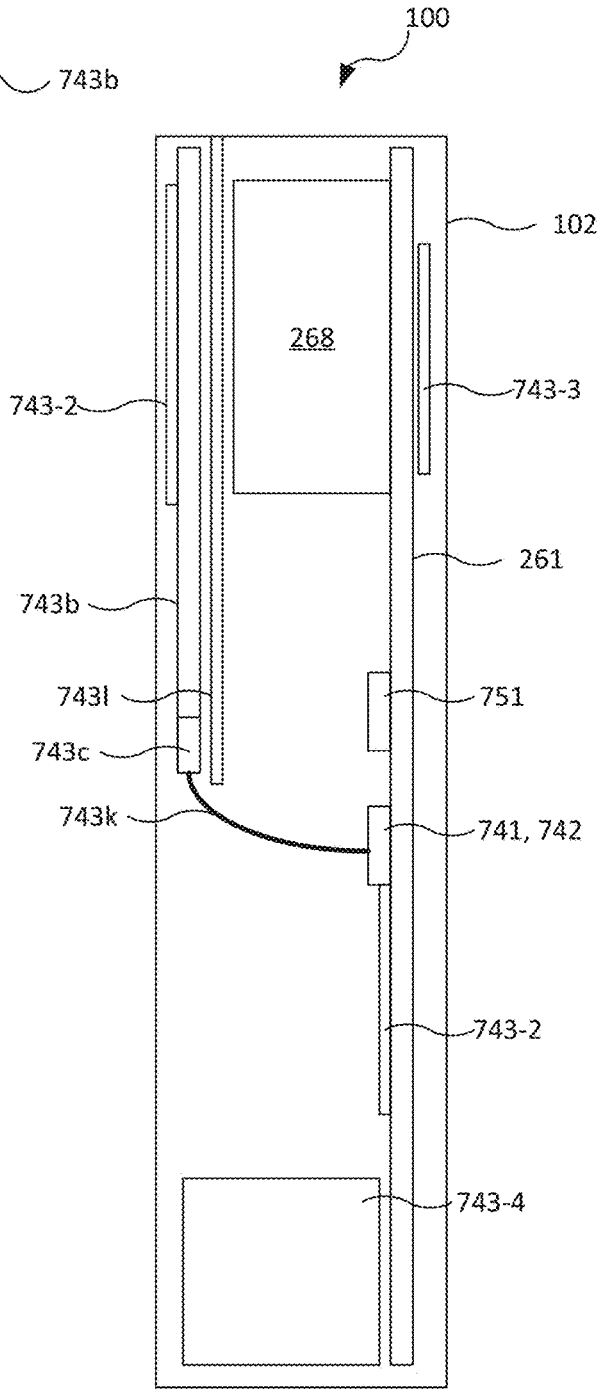

Referring additionally to FIG. 7I-1, a variation of the electronic key detector 140 sends the lock signal 740' (e.g., a door signal) to a broadcast region that extends beyond the detection region 142, the alternative detection region 144, or any other suitable detection region (e.g., on the exterior side 14 and within a predetermined proximity of the door 10 and/or the electronic door lock 100, such as within 7, 5, 4, or 3 feet or less). Any electronic key 145 that receives the lock signal 740' and sends the key signal 745' (e.g., a key signal) in response thereto, whereby the electronic key detector 140 determines whether or not the electronic key 145 is within the detection region 142. For example, the electronic key detector 140 (e.g., the controller 749 thereof) may calculate a position of the electronic key 145 according to an angle of arrival of the key signal 745' from the electronic key 145 to the electronic key detector 140 and according to one or more of a time of flight or a signal strength (e.g., received signal strength indication (RSSI)) of the second signal. The antennas 743 may be patch antennas arranged in an array (e.g., each patch antenna having a radiator and a ground plane associated therewith), or a patch antenna array having a plurality of radiators and a common ground plane. In each case, the array of patch antennas or the patch antenna array may be referred to as an antenna array 743-1. The individual patch antennas or the individual radiators are referred to as antennas with use of the reference numeral 743. The antenna array 743-1 may be positioned as shown for the antenna 743 in FIG. 7H.

This variation of the electronic key detector 140 includes at least three antennas 743 (e.g., eight as shown at 45-degree increments), which are arranged in lateral and vertical relationship to each other and may be referred to as an antenna array 743-1. Alternatively, the antennas 743 may be arranged in a grid pattern. The antennas 743 of the antenna array 743-1 are spaced apart in different dimensions (e.g., laterally and/or vertically, such as by a quarter wavelength) and, thereby, receive the key signal 745' at different phases thereof. Based on the different phases of the key signal 745' received by the antennas 743, the angle of arrival may be determined. For example, if only three antennas 743 were provided, a first group of two antennas 743 spaced apart horizontally is used to determine a horizontal angle of arrival, and a second group of two antennas 743 spaced apart vertically, which may include one antenna of the first group, are used determine a vertical angle of arrival. As a result, the electronic key detector 140 includes at least three of the antennas 743 spatially arranged to determine the horizontal and vertical angles of arrival. In one example, the antenna array 743-1 includes three of the antennas 743, while in another example, the antenna array 743-1 includes four of the antennas 743. Greater resolution (or accuracy) of the angle of arrival may be provided with more antennas (e.g., eight as shown).

The antennas 743 are additionally used to determine a distance of the electronic key 145 from the electronic key detector 140 using a received signal strength indicator (RSSI) and/or a time of flight of the key signal 745'. Thus, by determining the angle of arrival (horizontal and vertical components) and the distance of the electronic key 145, the electronic key detector 140 calculates the position of the electronic key 145 relative thereto.

The electronic key detector 140 may then compare the position of the electronic key 145 relative to the detection region 142 or the alternative detection region 144. If the electronic key 145 is associated with the electronic door lock 100 and is determined to be within the detection region 142 or 144, the electronic key 145 is considered to be detected Using the angle of arrival method described above, the detection region 144 may advantageously be established independent of the hardware characteristics of the antennas 743. For example, the detection region 144 (as referenced above) may be defined as a rectangular prism having the Cartesian dimensions described previously. Further, to account for the hinge-side of the door 10 being on the left or right side of the door, the detection region 144 may be redefined according thereto.

Referring additionally to FIG. 7I-2, a variation of the electronic key detector 140 is configured to determine whether the electronic key 145 is located on the interior side 12 (e.g., an interior hemisphere) or the exterior side 14 of the door 10 (e.g., an exterior hemisphere). The electronic key detector 140 includes a first antenna 743-2, which faces toward and has a radiation pattern that extends primarily to the exterior side 14 of the door 10, and include another antenna 743-3 that faces toward and has a radiation pattern that extends primarily to the interior side 12 of the door 10. Each of the first antenna 743-2 and the second antenna 743-3 may be patch antennas (e.g., having a radiator and a ground plane therebehind relative to the radiation pattern). By facing in opposite directions (i.e., to the exterior side 14 and the interior side 12 of the door 10, respectively), the first antenna 743-2 and the second antenna 743-3 may be used to determine whether the electronic key 145 is located on the exterior side 14 or the interior side of the door 10 by the receipt and/or relative strength of the key signal 745' thereby. The second antenna 743-3, the third antenna 743-4, and the fourth antenna (if included) may be connected to the circuit board 261 (e.g., to the transmitter 741, the receiver 742, or other suitable components) in any manner (not shown).

The variation of the electronic key detector shown in FIG. 7I-2 may further be configured to determine a quadrant in which the electronic key 145 is positioned (e.g., a left or right half of the exterior or interior side or hemisphere in which the electronic key 145 was identified). The electronic key detector 140 includes a third antenna 743-4, which is oriented approximately 90 degrees relative to the first antenna 743-2 and the second antenna 743-3. For example, the third antenna 743-4 may face toward and have a radiation pattern that extends primarily to the left (i.e., when facing the door 10 from the exterior space 4) or to the right. The third antenna 743-4 may, for example, be a patch antenna. The electronic key detector 140 may further include a fourth antenna (not shown) that faces generally opposite the third antenna 734-4.

If the electronic key 145 is determined to be on the exterior side 14 of the door 10, the electronic key detector 140 determines whether the electronic key 145 is located on that side corresponding to the third antenna 743-4 (e.g., if the key signal 745' is received thereby and/or the strength thereof exceeds a threshold), such as the left side, or not (e.g., if the key signal 745' is not received thereby and/or the strength thereof does not exceed a threshold). Alternatively, in the case of including the fourth antenna (not shown) facing opposite the third antenna 743-4, the third antenna 743-4 and the fourth antenna may be used to determine whether the electronic key 145 is located on the left side or the right side of the electronic door lock 100 by the receipt and/or relative strength of the key signal 745' thereby.

By determining whether the electronic key 145 is located in the exterior side 14 or the interior side 12 and the left side or the right side, the key detector 140 is able to determine a quadrant in which the electronic key 145 is located. The key detector 140 may then additionally use the signal strength to determine a distance of the electronic key 145 from the key detector 140, or that the electronic key 145 is within a predetermined proximity (e.g., by comparing to a threshold signal strength).

In a still further example, the first antenna 743-2 and/or the second antenna 743-3 may be configured as the array 743-1 of the antennas 743, which may be used to determine the angle of arrival of the key signal 745' (e.g., the vertical angle of arrival and the horizontal angle of arrival), for example, after the electronic key 145 is determined to be on the exterior side 14 or the interior side 12 of the door 10.

Figure 7J:
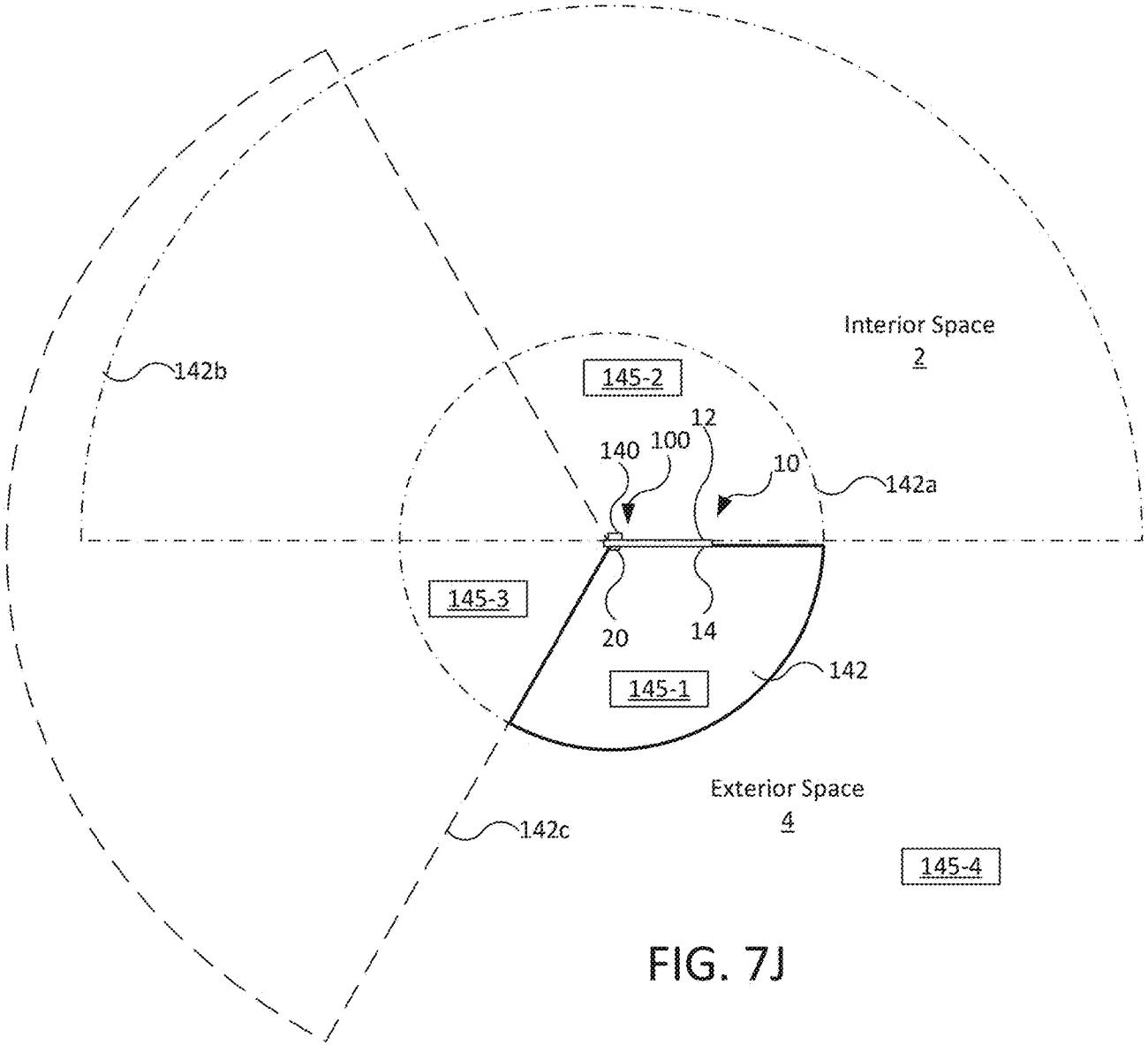
FIG. 7J is a top view illustrating another detection region.

Referring to FIG. 7J, the electronic key detector 140 may instead be configured to determine whether the electronic key 145 associated therewith is in the detection region 142 with a group of cooperative detection zones 142*a*, 142*b*, 142*c* and/or with an array of antennas 143*a*, 143*b*, 143*c* corresponding thereto. As discussed in further detail below, the first detection zone 142*a* is used to determine whether the electronic key 145 is within a predetermined proximity of the electronic key detector 140 and may also be referred to as a proximity detection zone or region. The second detection zone 142*b* is used to determine whether the electronic key 145 is located on the interior side 12 of the door 10 (e.g., of the door plane 11) and may also be referred to as an interior detection zone or region. The third detection zone 142*c* is used to determine whether the electronic key 145 is located on the lock side 18 of the door 10 (e.g., on the interior side 12 and/or the exterior side 14 of the door 10) and may be referred to as a lock-side detection zone or region. The detection region 142 is that region defined within the first detection zone 142*a* but outside the second detection zone 142*b* and outside the third detection zone 142*c*.

As referenced above, the first detection zone 142*a* is used to determine whether the electronic key 145 is within a predetermined proximity of the electronic key detector 140. As illustrated in FIG. 7J, the electronic keys 145-1, 145-2, and 145-3 are all located within the first detection zone 142*a*, while the electronic key 145-4 is located outside the detection zone 142*a*. The first detection zone 142*a* extends around the electronic key detector 140, both on the interior side 12 and the exterior side 14 of the door 10. The first detection zone 142*a* may be a broadcast region of the first antenna 143*a*, which is an omni-directional antenna, to which the lock signal 740' is sent. As a result, the first detection zone 142*a* may have a generally constant radius extending horizontally and/or vertically around the electronic key detector 140. The radius of the first detection zone 142*a* may, for example, be approximately eight, six, or five feet or less or a range therein (e.g., approximately four to six feet). Those electronic keys within the first detection zone 142*a* (i.e., 145-1, 145-2, 145-3, but not 145-4) send the key signal 745' in response to the lock signal 740', which is received by the first antenna 143*a* and, thereby, be determined to be in the first detection zone 142*a*.

The radius of the first detection zone 142*a* may be a limited range of the first antenna 143*a*. For example, the first antenna 143*a* may be configured to broadcast and/or receive other types signals to and/or from electronic keys 145 (e.g., the electronic key 145-4) or other devices outside the detection radius of the first detection zone. For example, the first antenna 143*a* may also be used to detect at longer distances the presence of but not authorize other electronic keys 145 that may or may not be associated with the electronic key detector 140 (e.g., the electronic door lock 100). To send the lock signal 740' and/or receive the key signal 745' to limited detection radius, the first antenna 143*a* may utilize a loss network that functions to restrict the effective distance at which the first antenna 143*a* broadcasts and/or receives signals (e.g., the door signal 740' and the key signal 745').

As referenced above, the second detection zone 142*b* is used to determine whether the electronic key 145 is located on the interior side 12 of the door 10. As illustrated in FIG. 7J, the electronic key 145-2 is located in the second detection zone 142*b*, while the electronic keys 145-1, 145-3, and 145-4 are located outside the second detection zone 142*b*. The second detection zone 142*b* is located on the interior side 12 of the door 10 and may generally form a semi-circular shape in a horizontal plane (e.g., extending approximately 180 degrees or less, such as 175 degrees+/−10 degrees or 5 degrees) and/or a generally hemispherical shape in three dimensions. For example, the second detection zone 142*b* may be a broadcast region and/or a detection of the second antenna 143*b*, which is a directional antenna, such as a patch antenna having a single path (as opposed to an array of patches). For those keys in both the first detection zone 142*a* and the second detection zone 142*c* (i.e., electronic key 145-2), the electronic key 145 sends the key signal 745' in response to receiving the lock signal 740' from the first antenna 143*a*, and the key signal 745' is received by the second antenna 143*b* and, thereby, determines the electronic key 145-2 to be in the third detection zone 142*c*. As referenced above, the third detection zone 142*c* is used to determine whether the electronic key 145 is located on the lock side 18 of the door. As illustrated in FIG. 7J, the electronic key 145-3 is located in the third detection zone 142*c*, while the electronic keys 145-1, 145-2, and 145-4 are located outside the third detection zone 142*c*. The third detection zone 142*c* extends to the exterior side 14 of the door 10. For example, the third detection zone 142*c* may extend to the exterior side 14 of the door 10 at the lock-side detection angle α_h (i.e., measured in the horizontal plane from the longitudinal direction, which is perpendicular to the door plane 11). The third detection zone 142*c* intersects the first detection zone 142*a* on the exterior side 14 of the door 10 to form the lock-side lateral distance RD_lateral-lock, as described previously. The lock-side detection angle α_h and the lock-side lateral distance RD_lateral-lock may, for example, be dimensioned as described previously.

The third detection zone 142*c* has an angular range that extends from the to the lock-side detection angle α_h to approximately the door plane 11 or further to the interior side 12 of the door 10. As shown, the detection zone 142*c* is generally symmetric horizontally about the door plane 11 but may extend to the interior side 12 of the door 10 at another angle. The third detection zone 142*c* may extend vertically in any suitable angular range (e.g., being shaped semi-circularly in the door plane 11).

The third detection zone 142*c* may be a broadcast region and/or detection region of the third antenna 143*c* to which the lock signal 740' is sent and/or from which the key signal 745' is received. For those keys in both the first detection zone 142*a* and the third detection zone 142*b* (i.e., electronic key 145-3), the electronic key 145 sends the key signal 745' in response to receiving the lock signal 740' from the first antenna 143*a*, and the key signal 745' is received by the third antenna 143*c* and, thereby, determines the electronic key 143-3 to be in the third detection zone 142*c*. The third antenna 143*c* may be configured in various different manners to broadcast to the lock side 18 of the door. In one example, the third antenna 143*c* is a dual-sided patch antenna system with patch antennas on each side of a ground plane that is arranged perpendicular to the door plane 11. In another example, the third antenna 143*c* is selectively operated from one of two patch antennas that face opposite directions perpendicular to the door plane 11.

Those electronic keys outside the first detection zone 142*a*, which will not receive the lock signal 740' from the first antenna 143*a* regardless of whether they are in the second detection zone 142*b* or the third detection zone 142*c*, and, thereby, will not send the key signal 745' for detection by the electronic door lock 100.

Figure 7L:
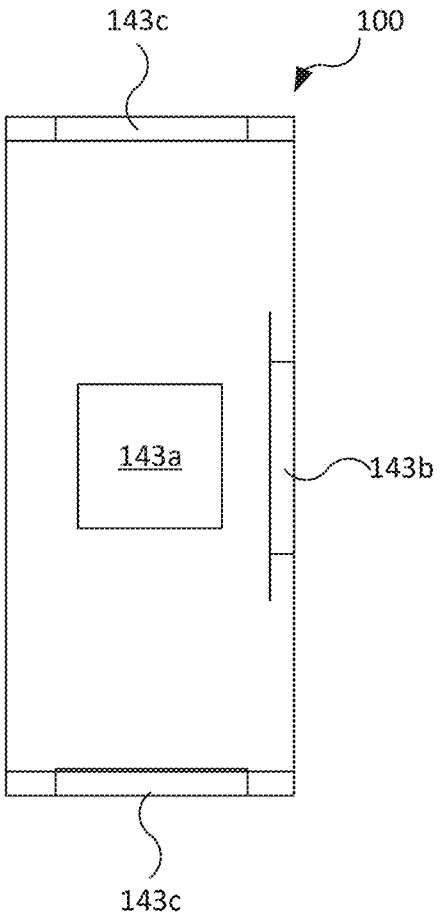
FIG. 7L is a cross-sectional view of the electronic door lock having a variation of the antenna configuration of 7K.
Figure 7K:
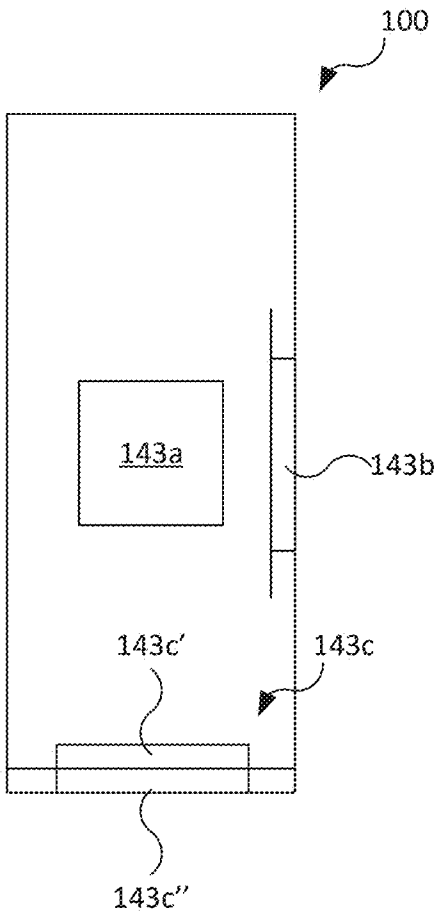
FIG. 7K is a cross-sectional view of the electronic door lock having an antenna configuration.

Referring to FIGS. 7K and 7L, schematic top-down cross-sectional views of the electronic key detector 140. As shown in FIG. 7K, the electronic door lock 100 (e.g., the electronic key detector 140 thereof) includes the antennas 143*a*, 143*b*, 143*c*. The antenna 143*a*, as referenced above, is an omni-directional antenna. The antenna 143*b* is a directional antenna, which detects the key signals 745' from the interior side 12 of the door 10 (e.g., in the zone 142*b*). The antenna 143*b* may, for example, be a patch antenna, which is arranged generally parallel with the door plane 11 and faces into the building structure. The antenna 143*c* is a directional antenna, which detects the key signals 745' from the lock side 18 of the door 10 (e.g., in the zone 142*c*) The antenna 143*c* is a patch antenna that is configured to receive the key signals 745' from one of two sides thereof (e.g., being a patch antenna having two patches 143*c*', 143*c*" on opposite sides of a ground plane of which only one of the patches is operated at a given time). The antenna 143*c* is arranged generally perpendicular to the door plane 11.

Referring instead to FIG. 7L, instead of a single antenna 143*c* with two patches, two of the antennas 143*c* may be provided on opposite (i.e., left and right) sides of the electronic door lock 100. The two antennas 143*c* may be patch antennas that are arranged generally perpendicular to the door plane 11. Only one of the two antennas 143*c* may be operated at a given time and, in particular, the one of the antennas 143*c* on the lock side of the electronic door lock 100 is operated, which may vary for different doors.

Figure 7M:
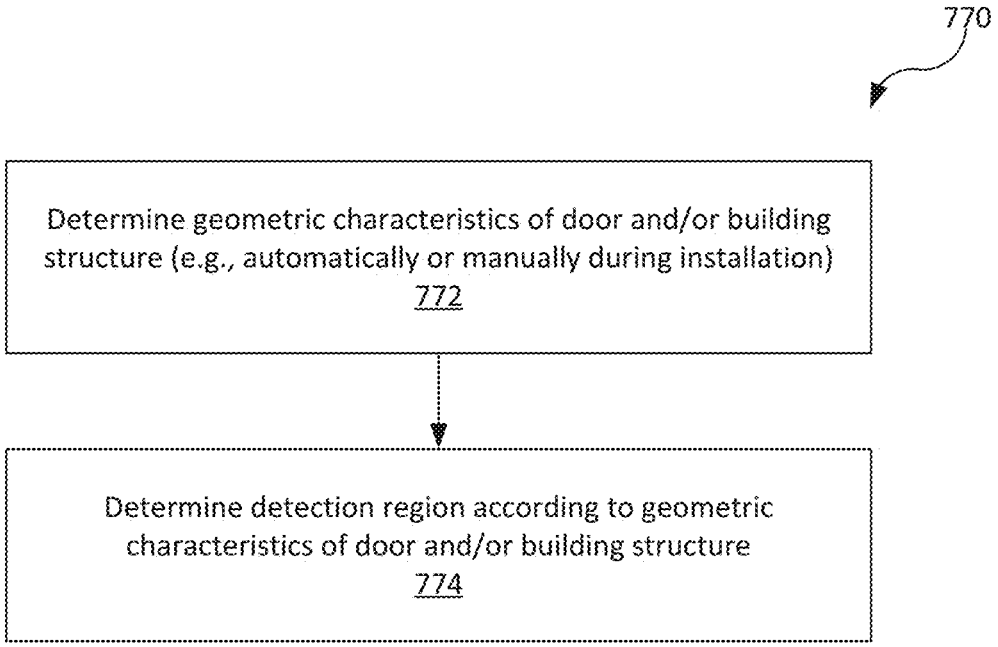
FIG. 7M is a flowchart of a technique for determining a detection region.

Referring to FIG. 7M, a technique 770 is provided for establishing the detection region 142 of the electronic key detector 140. The technique 770 generally includes at 772 determining one or more geometric characteristic of the door 10, and at 774 determining the detection region 142 according to the geometric characteristic.

At 772, the geometric characteristics may, for example, include whether the electronic door lock 100 is on the left or right side of the door, whether the door 10 is inswing or outswing, whether the door 10 is right or left hinged, the width D_width of the door 10, the deadbolt offset DB_offset, whether the building structure includes any forwardly-protruding structures, and/or the dimensions of such forwardly-protruding structures. The geometric characteristics may be determined automatically, for example, during a set up operation. In the set-up operation, the deadbolt operator 110 may attempt to turn the deadbolt clockwise and counter-clockwise to determine whether the electronic door lock 100 is on the left or the right side of the door 10. Opening and closing of the door may allow the electronic door lock 100 to determine the swing direction and/or the hinge-side using the accelerometer thereof (e.g., one of the sensors 266). Alternatively, an installer or user may be prompted to provide the geometric information of the door 10 manually (e.g., inputting the location of the electronic door lock 100 on the left or right, the deadbolt offset, the door width, whether any portions of the building structure 8 protrude forward and/or dimensions of the building structure 8), such as with a smartphone or other computing device in communication with the electronic door lock 100.

At 774, the detection region 142 is determined according to the geometric characteristics. In one example (e.g., with the antenna array shown in FIG. 7F), the shape of the detection region 142 is predetermined by the two patch antennas and may be laterally asymmetric. The transmitter 741 may be switched, so as to drive the two antennas phases shifted 90 degrees, so as to flip the detection region 142 between left and right sides.

In another example (e.g., with the antenna array shown in FIG. 7I using the angle of arrival method), the shape of the detection region 144 is predetermined as a rectangular prism that is laterally asymmetric for use with the angle of arrival method. Position of the detection region 144 is shifted according to the geometric characteristic, for example, to have the lock-side lateral distance RD_lateral-lock be a short dimension than the hinge-side lateral distance RD_lateral-hinge.

In still further example (e.g., with the antennas in FIG. 7J-7L), the shape of the detection region 144 is predetermined by the antenna(s) 143*c* with one of the patches of the two-sided patch or one of the antennas 143*c* on different sides of the electronic door lock 100 being operated to achieve the detection region 142 as shown in FIG. 7J (e.g., with the lock side detection zone 142*c* on the lock side 18 of the door 10, as opposed to the hinge side 16 thereof).

In still further examples with the angle of arrival method, the detection region 142 may not have a predetermined shape and instead have a shape (e.g., any/all dimensions described previously) that is later defined or calculated with the geometric characteristics.

Figure 7N:
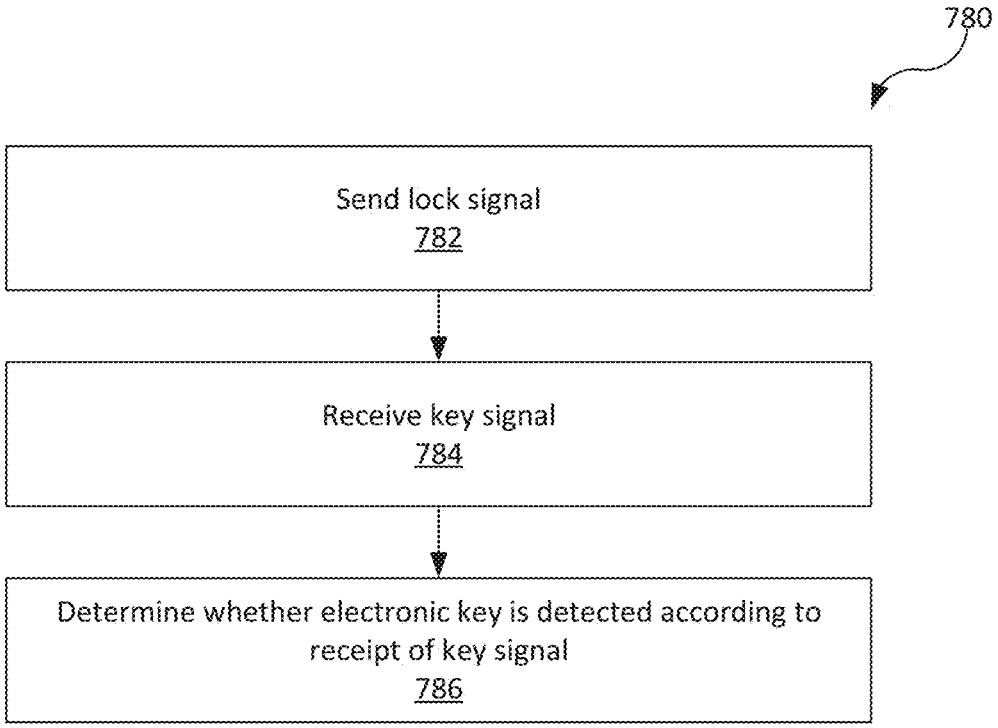
FIG. 7N is a flow chart of a technique for detecting an electronic key associated with the electronic door lock.
Figure 70:
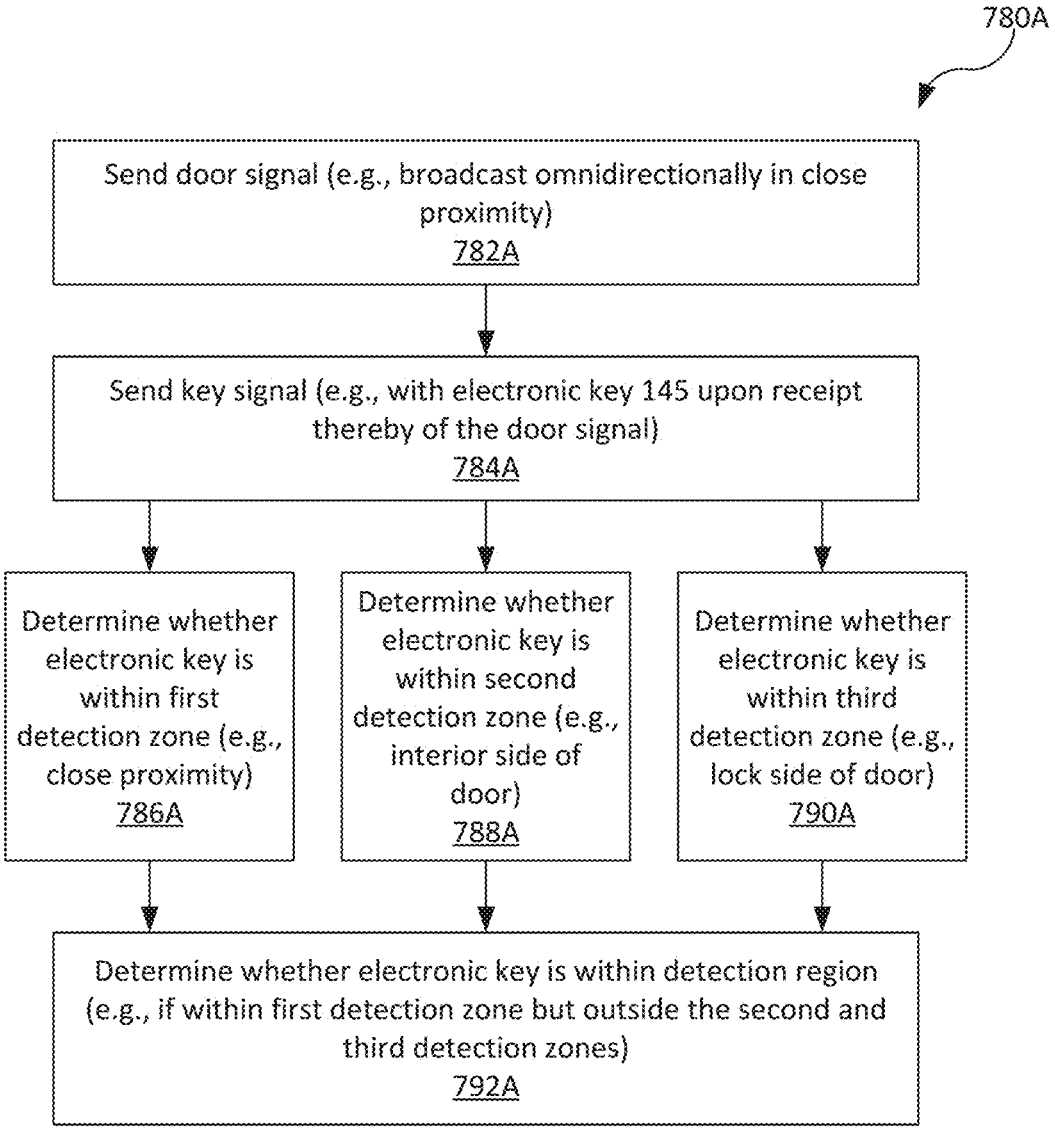

Referring to FIG. 7N, a technique 780 is provided for detecting an electronic key 145 with the electronic key detector 140 and variations thereof described previously (e.g., using angle of arrival and/or the multiple detection zones 142*a*, 142*b*, 142*c*). At 782, the lock signal 740' is sent with the electronic key detector 140 as described above. The lock signal 740' may, for example, be sent upon detecting a touch with the touch detector 120 (see, e.g., FIG. 9).

At 784, the key signal 745', if any, is received by the electronic key detector 140.

At 786, a key detection is determined according to the key signal 745'. For example, a key detection may be determined upon receipt of any key signal 745' having a signal strength above a predetermined level, and/or upon receiving a key signal 745' having accelerometer data indicating movement of the electronic key 145.

Referring to FIG. 7O, a technique 780A, which is a variation of the technique 780, is provided for detecting an electronic key 145 with the electronic key detector 140 utilizing the multiple detection zones 142*a*, 142*b*, 142*c*. The technique 780A generally includes determining whether the electronic key 145 is within a predetermined proximity of the electronic key detector 140 (e.g., in the first detection zone 142*a*), on the interior side 12 of the door 10 (e.g., in the second detection zone 142*b*), and on the lock side 18 of the door 10 (e.g., in the third detection zone 142*c*). If the electronic key 145 is within the predetermined proximity but not on the interior side 12 or the lock side 18 of the door 10, the electronic key 145 is determined to be detected (i.e., within the detection region 142). Such determinations may be made in succession or simultaneously, as described below.

At 782A, the door signal 740' is broadcast omnidirectionally to the first detection region, such as to the first detection zone 142*a* with the first antenna 143*a* (as described previously).

At 784A, the electronic key 145, upon receipt of the door signal 740', sends the key signal 745'.

At 786A, the electronic key detector 140 determines whether the electronic key 145 is inside or outside the first detection zone 142*a* (e.g., within the predetermined proximity of the electronic key detector 140). If the key signal 745' is received by the first antenna 143*a*, the electronic key 145 is determined to be inside the first detection zone 142*a*. If the key signal 745' is not received by the first antenna 143*a*, the electronic key 145 is determined to be outside the first detection zone 142*a* (e.g., no electronic key 145 associated with the electronic door lock 145 is detected therein).

At 788A, the electronic key detector 140 determines whether the electronic key 145 is inside or outside the second detection zone 142*b* (e.g., on the interior side 12 of the door 10). If the key signal 745' is received by the second antenna 143*b*, the electronic key 145 is determined to be inside the second detection zone 142*b*. If the key signal 745' is not received by the second antenna 143*b*, the electronic key 145 is determined to be outside the second detection zone 142*b* (e.g., no electronic key 145 associated with the electronic door lock 145 is detected therein).

At 790A, the electronic key detector 140 determines whether the electronic key 145 is inside or outside the third detection zone 142*b* (e.g., at the lock side 18 of the door 10). If the key signal 745' is received by the third antenna 143*c*, the electronic key 145 is determined to be inside the third detection zone 142*c*. If the key signal 745' is not received by the third antenna 143*b*, the electronic key 145 is determined to be outside the third detection zone 142*c* (e.g., no electronic key 145 associated with the electronic door lock 145 is detected therein).

At 792A, the electronic key detector 140 determines whether the electronic key 145 determines whether the electronic key 145 is detected (e.g., is inside or outside the detection region 142). If at 786A, 788A, and 790A, the electronic key 145 is determined to be each of inside the first detection zone 142*a*, outside the second detection zone 142*b*, and outside the third detection zone 142*c*, the electronic key 145 is determined to be detected. If instead at 786A, 788A, or 790A, the electronic key 145 is determined to be any of outside the first detection zone 142*a*, inside the second detection zone 142*b*, or inside the third detection zone 142*c*, the electronic key 145 is determined to not be detected. It should be noted, that if no key signal 745' is received by any of the antennas 143*a*, 143*b*, 143*c*, no electronic key 145 is detected.

The technique 780 and/or the technique 780A may further include, as a preceding operation to sending the door signal 740' at 782 or 782A, a further operation of finding, but not detecting or authorizing, any electronic keys 145 that may be within a larger vicinity than the detection region 142. For example, electronic keys 145 may be configured to broadcast signals periodically and/or in response to additional door signals by the first antenna 143*a* to a longer range.

The operations at 786A, 788A, and 790A may be performed in simultaneously and/or in any suitable order, for example, operations 788A and 790A of determining whether the electronic key 145 is in the second detection zone 142*b* and the third detection zone 142*c* may be performed only upon determining that the electronic key 145 is within the first detection zone 142*a* at 786A.

Figure 7P:
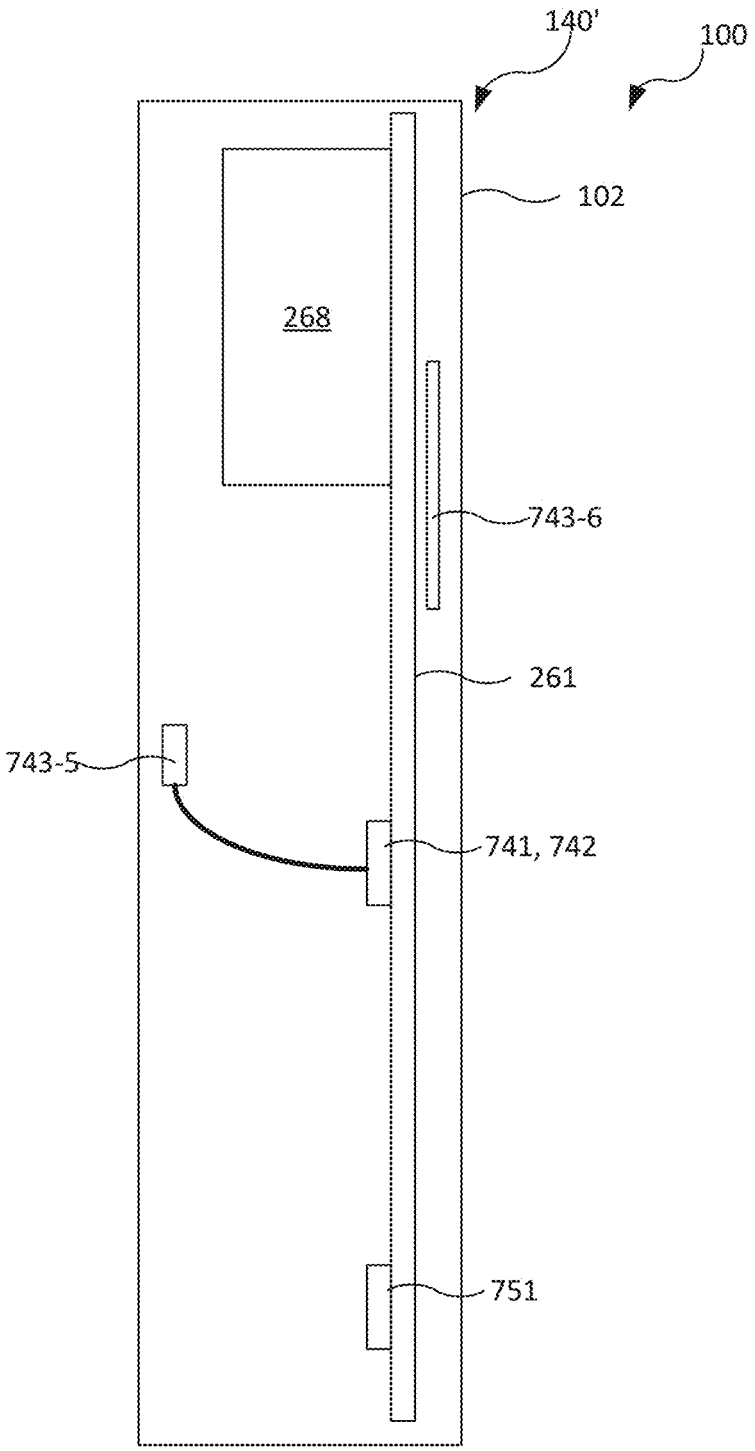
FIG. 7P is a cross-sectional view of the electronic door lock with a variation of the key detector.
Figure 7Q:
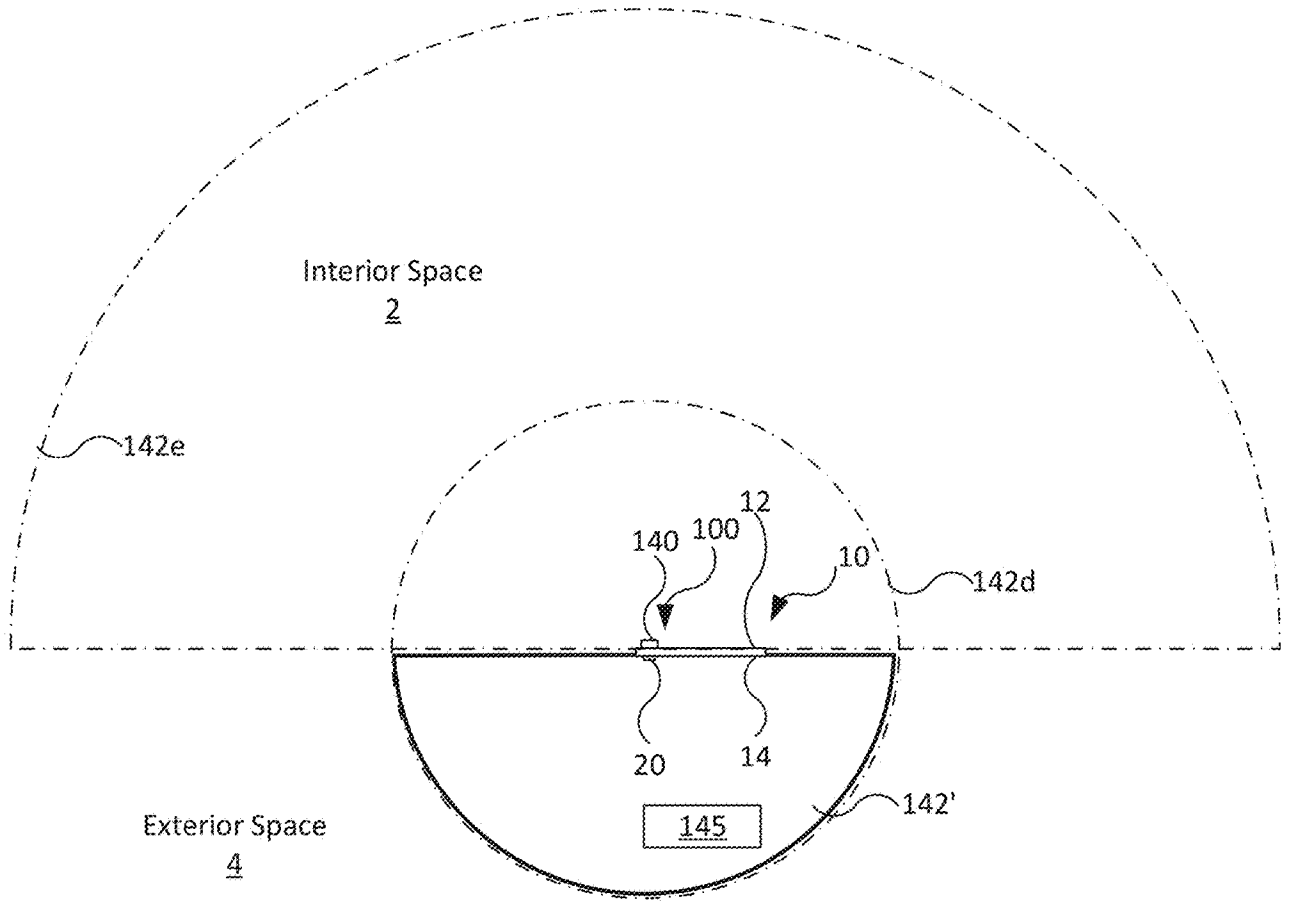
FIG. 7Q is a top view illustrating another detection region.
Figure 7R:
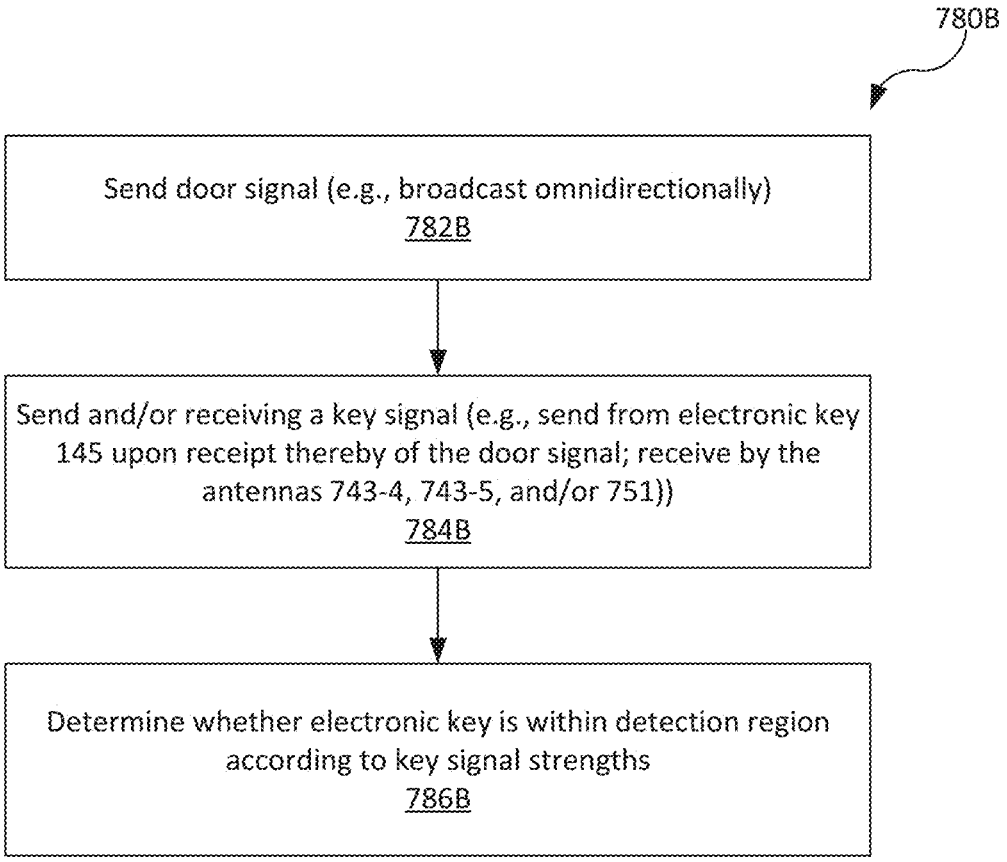
FIG. 7R is a flow chart of an alternative technique for detecting an electronic key associated with the electronic door lock.

Referring to FIGS. 7P-7R, an electronic key detector 140' is a variation of the electronic key detectors 140 described previously and determines whether the electronic key 145 is within a detection region 142' that is located on the exterior side 14 of the door 10 and in close proximity to the electronic key detector 140 (e.g., within 10, 7, 5, 4, 3, or 2 feet or less). The electronic key detector 140' assesses whether the electronic key 145 is in the detection region 142' using a group (e.g., pair) of cooperative detection zones 742*d*, 742*e* and/or with an array (e.g., group or pair) of antennas 743-5, 743-6 corresponding thereto. The electronic key detector 140' may assess whether the electronic key 145 is in the detection region with a third detection zone 742*f* with a third antenna 751 corresponding thereto, which may, by default or by selection, be used in addition to or instead of the first detection zone 742*d* and the first antenna 743-5. The antennas may be coupled to the circuit board 261, such as the transmitter 741, the receiver 742, or other suitable components, in any suitable manner (e.g., shown as a cable for the first antenna 743-5; not shown for the second antenna 743-6).

The first detection zone 142*d* extends to both the interior space 2 of the door 10 and the exterior side 14 of the door 10. The first detection zone 142*d* is formed by the first antenna 743-5. For example, the first detection zone 142*d* is formed by a first radiation pattern of the first antenna 743-5 that extends to both interior space 2 and the exterior side 14 of the door 10. The first antenna 743-5 (depicted schematically) may, for example, be an omni-directional antenna (e.g., a dipole antenna) having radiation pattern with a toroidal shape whose axis extends generally horizontal and parallel with the plane 11 of the door 10. The radiation pattern is approximated by the detection zone 142*d*. Variations of the first detection zone 142*d* and the antenna 743-5 are contemplated, such as a dipole antenna whose toroidal radiation pattern has an axis that extends vertically and parallel with the plane 11 of the door 10. It should be further understood that the radiation pattern of the antenna 743-5 may be influenced by other components of the electronic door lock 100 and/or the door 10 itself. Further, the antenna 743-5 may be spaced apart from the main circuit board 261 to reduce the influence of the circuit board 261 as a ground plane on the radiation pattern of the antenna 743-5.

The second detection zone 142*e* is formed by the second antenna 743-6. For example, the second detection zone 142*e* is formed by a second radiation pattern of the second antenna 743-6 that extends to the interior space 2 but substantially not the exterior space 4. The second antenna 743-6 is a directional antenna having radiation pattern that that extends primarily inward to the interior space 2. Side lobes of the second radiation pattern, which may include a back lobe, of the second antenna 743-6 may have negligible gain relative to the primary lobe. The second antenna 743-6 may, for example, be a patch antenna, or other suitable type of antenna.

The electronic key detector 140' determines whether the electronic key 145 is located within the detection region 142' according to the key signal 745' received by the first antenna 743-5 and the second antenna 743-6.

In one example, the electronic key detector 140' determines whether the electronic key 145 is within the detection region 142 by determining both whether the door is located in the exterior space 4 or the interior space 2 of the door and whether the electronic key 145 is within the first detection zone 142*d* or otherwise in close proximity of the door 10. To determine whether the electronic key 145 is located in the exterior space 4 or the interior space 2, the electronic key detector 140' (e.g., the controller 744 thereof) measures the strengths of the key signal 745' as received by the first antenna 742-3 (i.e., the first key signal strength) and the second antenna 742*e* (i.e., the second key signal strength), and calculates a difference therebetween (i.e., between the first key signal strength and the second signal strength) that may be referred to as the key signal strength difference. The key signal strength difference is expected to be higher if the electronic key 145 is located in the exterior space 4 as compared to if the electronic key 145 is located on the interior space 2 of the door 10. This is because both the first radiation pattern and the second radiation pattern extend into the interior space 2, thus resulting in a smaller key signal strength difference in the interior space 2, while only the first radiation pattern extends into the exterior space 4, thus resulting in a larger key signal strength difference in the exterior space 4. The key signal strength difference may be compared to a threshold value or range (e.g., a signal strength difference threshold) to determine whether the electronic key 145 is on the exterior side 14 (i.e., equals or exceeds the signal strength difference threshold) or interior space 2 (i.e., is less than the signal strength difference threshold).

The electronic key detector 140' (e.g., the controller 744 thereof) also determines whether the electronic key 145 is within the first detection zone 742*e* and/or close proximity of the door 10, such as within 10, 7, 5, 4, or 3 feet less. In various examples, the electronic key detector 140' determines whether the electronic key 145 is in the first detection zone 742*e* and/or in close proximity of the door 10 according to the first key signal strength. In one example, the electronic key detector 140' measures the first key signal strength, and compares the first key signal strength to a signal strength threshold to determine whether the electronic key 145 is within the first detection zone 142*d* or otherwise in close proximity of the door 10 (i.e., equals or exceeds the signal strength threshold) or is not (i.e., is below the signal strength threshold). In another example, the electronic key detector 140' calculates a distance of the electronic key 145 to the door 10 according to the first key signal strength, and compares the calculated distance to a proximity threshold (e.g., 10, 7, 5, 4, 3, or 2 feet or less) to determine whether the electronic key is within the first detection zone 142*d* or otherwise in close proximity of the door 10 (i.e., is less than or equals the proximity threshold) or is not (i.e., is greater than the proximity threshold).

The electronic key detector 140' determines that the electronic key 145 is in the detection zone 142 if it is determined both that the electronic key 145 is in the exterior space 4 (e.g., based on the difference in key signal strengths) and that the electronic key 145 is in close proximity to the door 4 (i.e., based on the first key signal strength). The key signal strength difference and the proximity may be evaluated in any suitable manner, such sequentially (i.e., requiring one criterion of the other be satisfied before evaluating the other criterion) or contemporaneously (i.e., evaluating both criteria at substantially the same time).

In another example, the electronic key detector 140' determines whether the electronic key 145 is in the detection region 142 by assessing, such as by forming binary or probabilistic determinations, of whether the electronic key 145 is in each of the first detection zone 142*d* and the second detection zone 142*e*. For example, the electronic key detector 140' may compare the first key signal strength to a first key strength threshold to determine whether the electronic key 145 is in the first detection zone 142*d* (e.g., equals or is greater than the first key strength threshold) or not (e.g., is less than the first key strength threshold). The electronic key detector 140' may also compare the second key signal strength to a second key strength threshold to determine whether the electronic key 145 is in the second detection zone 142*e* (e.g., equals or is greater than the second key strength threshold) or not (e.g., is less than the second key strength threshold). The electronic key 145 is determined to be in the detection region 142 if the electronic key 145 is determined to be in the first detection zone 142*d* but not the second detection zone 142*e*.

The various thresholds described above may be determined in any suitable manner, for example, being predetermined (e.g., being agnostic to the door 10 with which the electronic door lock 100 is used), being determined during an initialization or setup process (e.g., after the electronic door lock 100 is coupled to the door 10), and/or being re-determined over time (e.g., days, weeks, months, years) during operation of the electronic key detector 140'. Further, the initialization or setup process may be used to determine whether the electronic key 145 can be reliably located with the first antenna 743-5 and whether the antenna 751 should instead or additionally be used to determine the location of the electronic key 145.

As shown in FIG. 7P, the electronic key detector 140' may further include a third antenna, such as the antenna 751 or another antenna, that is of a different type, configuration, or location than the first antenna 743-5. The first antenna 743-5 may be located in close proximity of the door 10 (e.g., away from an outer surface of the electronic door lock 100) and have a radiation pattern that is altered in different manners by different doors 10 (e.g., being generally unaffected by doors primarily made of wood, while being impeded from extending to the exterior side 14 by doors being made of metal, such as a steel shell). The third antenna 751 functions to supplement or replace detection of the electronic key 145 in the exterior space 4 otherwise performed by the first antenna 743-5. In one example, the third antenna 751 is an omnidirectional antenna having a radiation pattern that extends to the exterior space 4 and the interior space 2. The third antenna 751 is spaced apart from the first antenna 743-5, for example, being spaced part from the first antenna 743-5 further away from the door 10 (i.e., further into the interior space 2). The third antenna 751 may, for example, be a monopole antenna, or other suitable type of antenna.

Referring to FIG. 7R, a technique 780B (e.g., method) for determining whether an electronic key, such as the electronic key 145, is within a detection region (e.g., an authentication zone), such as the detection region 142. The technique 780B generally includes sending a door signal (e.g., broadcasting the door signal 740' with an omnidirectional antenna, such as the first antenna 743-5 or the antenna 751), sending and/or receiving a key signal (e.g., sending the key signal 745' with the electronic key 145 and/or receiving the key signal 745' with the antennas 743-5, 743-6, 751), and determining 786B whether the electronic key is within the detection (e.g., an authentication zone, such as the detection region 142'). The various determinations are performed by a controller, such as the controller 744 or the controller 262.

The determining 786B may be performed according to the key signal strength of the key signal 745' received by the different antennas. In one example, the determining 786B includes determining whether the electronic key is on the interior side 12 of the door (e.g., in the interior space 2) or the exterior side 14 (e.g., in the exterior space 4) and, if on the exterior side 14, determining a distance of the electronic key from the electronic door lock. The side of the electronic key is determined according to the first key signal strength and the second key signal strength, for example, by determining a difference therebetween that is then compared to a threshold or range (e.g., a higher signal strength different indicating the electronic key is on the exterior side 14 of the door). The proximity of the electronic key 145 to the door is determined according to the first key signal strength, such as by comparing the signal strength to a signal strength threshold (e.g., if greater, then determined to be within the proximity) or by calculating a distance from the signal strength that is compared to a proximity threshold.

The determining 786B, in another example, includes determining whether the electronic key is within a first detection zone extending to both sides of the door 10 (e.g., with the first antenna 743-5) and is within a second detection zone extending to substantially only the interior side 12 of the door 10 (e.g., with the second antenna 743-6). The electronic key is determined to be in the detection region (e.g., the authentication zone) if the electronic key is determined to be in the first detection zone and not the second detection zone.

Furthermore, the techniques 780, 780A, and/or 780B may be initiated upon detection of touch as described previously. Upon detecting the electronic key, another operation may be performed, such as operating the deadbolt operator 110 to move the deadbolt lock 20 (see, e.g., the techniques in FIGS. 9A and 9B).

Referring to FIGS. 8A-8D, the electronic door lock 100 may include the door position detector 150. The door position detector 150 is configured to determine whether the door 10 is closed or open, and may further determine an angle at which the door is open and whether the door is moving. The door position detector 150 is configured as a self-contained system of the electronic door lock 100, which does not require external hardware for determining the door position. For example, conventional devices for detecting whether a door is open or closed may include a door-side component (e.g., a magnet) and a frame-side component (e.g., a Hall sensor) that when aligned or not provide a binary determination of whether the door is closed or open, respectively. The door position detector 150, by not requiring external hardware, advantageously does not require the additional labor, components, or negative aesthetics associated with such conventional devices. The door position information (e.g., whether closed, open, moving, and/or door angle) may be utilized in various manners, for example, with the other systems of the electronic door lock 100 disclosed herein (e.g., the deadbolt operator 110 may not operate if the door is open) and/or be in communication with other external systems to provide notifications thereto (e.g., a home security system or a smartphone, whereby a user may view the status of the door 10).

The door position detector 150 generally includes a magnetometer 852 (e.g., a compass), an accelerometer 854, and a controller 856. The magnetometer 852 and the accelerometer 854 may each be one of the sensors 266. The magnetometer 852 and/or the accelerometer 854 may be used for other functions of the electronic door lock 100. For example, the accelerometer 854 may be used in the setup operation of the electronic key detector 140 for determining the orientation thereof, as described above. The magnetometer 852 and the accelerometer 854 may be provided cooperatively as a singular device (e.g., on a single chip), separate devices (as illustrated schematically), and may further be subdivided into further subcomponents (e.g., the accelerometer 854 may be a single device configured to measure acceleration in multiple directions, or may be provided as separate devices that are each configured to measure acceleration in a single direction). The controller 856 may be the controller 262 of the electronic door lock 100, as described above, which may be used in conjunction with other systems described herein (e.g., the electronic key detector 140). The door position detector 150 may further include a wireless communication device 858, which may be one of the wireless communications devices 264 of the electronic door lock 100, whereby the door position information (e.g., closed, open, moving and/or angle) may be communicated to other devices or systems (e.g., the external security system referenced above).

The door position detector 150, by utilizing measurements from both the magnetometer 852 and the accelerometer 854, provides a robust solution for determining whether the door 10 is closed or open. While the magnetometer 852 may alone be used to determine whether the door 10 is open or closed, for example by measuring an angle of the door 10 relative to a closed position, fluctuations in the earth's magnetic field and/or other magnetic disturbances (e.g., from portable electronic devices passing thereby) may lead to inaccurate determinations from the magnetometer 852 alone. For example, a changed reading from the magnetometer 852 may represent the door 10 being opened by 0.5 degrees (e.g., not allowing the deadbolt lock 20 to lock) or a shift in the earth's magnetic field. Further, while the accelerometer 854 may alone be used to determine whether the door 10 is open or closed, for example by deriving displacement as the second integral of acceleration readings, small errors in acceleration readings (e.g., from sensor creep or resolution) may cause inaccurate determinations from the accelerometer 854 alone. As described below, however, the position of the door 10 (e.g., whether open or closed) may be reliably determined according to measurements from both the magnetometer 852 and the accelerometer 854.

Referring to FIG. 8B, a door coordinate system is defined relative to the door position detector 150, and thereby relative to the door 10 to which the door position detector 150 is coupled. For example, an X-direction extends parallel to the door plane 11 and, thereby, radially relative to a hinge side 16 of the door 10. A Y-direction extends perpendicular to the door plane D and, thereby, tangentially relative to the hinge side 16 of the door 10. As the door 10 is rotated about the hinge side 16, the door coordinate system moves with the door 10 from the closed position (i.e., the door 10 illustrated in solid lines) to the open position (i.e., the door 10 illustrated in broken dash-dot lines) and relative to the earth's magnetic field (e.g., north pointing upward on the page in this example). Thus, as the door 10 is moved between the closed and open positions, the magnetometer 852 will sense the earth's magnetic field differently with readings changing in the X- and Y-directions, which may also be expressed as an angle measurement relative to the earth's magnetic field. Further, the accelerometer 854 will sense acceleration with readings in the X-direction (i.e., radial direction) having a non-zero value with any pivoting movement of the door 10 (i.e., due to centrifugal force) regardless of whether readings in the Y-direction (i.e., tangential direction) have a non-zero value (i.e., with changing angular velocity) or zero-value (i.e., with constant angular velocity).

As shown below in Table I below, the magnetometer 852 and the accelerometer 854 output different readings as the door 10 is moved between the closed position and the open position. Measurements of the magnetometer 852 and the accelerometer 854 are different when the door 10 is in the closed position (illustrated as facing due south in FIG. 8B) and different open positions, including whether the door is open and static or moving (i.e., moving toward or away from the closed position, such as when closing or opening the door 10, respectively). When the door 10 is in a closed state (i.e., in the closed position), the angle measurement from the magnetometer 852 equals a reference angle (i.e., of the closed position, which may be referred to as a closed reference angle), while the accelerometer 854 simultaneously measures zero acceleration in the X-direction and the Y-direction. When the door 10 is in an open position (i.e., an open and static state), the angle measurement from magnetometer 852 is different from the reference angle (e.g., 130 degrees as shown in FIG. 8B), while the accelerometer 854 simultaneously measures zero acceleration in the X-direction and the Y-direction. The open position, as is generally used herein, refers to the door 10 being static unless otherwise apparent. When the door 10 is moving relative to the closed position (e.g., is open and moving), the magnetometer 852 measures different non-zero angles relative the reference angle, while the accelerometer 854 simultaneously measures non-zero acceleration values. As the door 10 is moved, the acceleration in the Y-direction (i.e., the tangential direction) may be non-zero as the angular velocity of the door 10 changes but may be zero for a constant angular velocity. As the door 10 is moved, the acceleration in the X-direction (i.e., the radial direction) is non-zero due to centrifugal force acting on the accelerometer 854 and is, therefore, a reliable determiner of movement of the door 10.

TABLE I

| Door State | Magnetometer (angle to closed) | Accelerometer (X-direction) | Accelerometer (Y-direction) |
|---|---|---|---|
| Closed | 0 | 0 | 0 |
| Open (Static) | Static (non-zero magnitude) | 0 | 0 |
| Moving (Open - toward/ away from closed) | Changing (non-zero magnitude) | >0 | Variable direction and magnitude |

Referring to the flowchart in FIG. 8C, a technique 860 is provided for determining whether door 10 is in a closed state, an open state, or a moving state, such as with the door position detector 150.

At 862, the door 10 is in the closed state and the door position detector 150 determines whether the door 10 remains in the closed state or changes to the moving state. The door position detector 150 measures a current angle with the magnetometer 852 and acceleration with the accelerometer 854 and determines, according to thereto, whether the door 10 remains in the closed state or has changed to the moving state. If both an angle change from the closed position and acceleration are detected, the door 10 is determined to be in (e.g., have changed to) the moving state at the technique 860 moves to 864. If no angle change is detected, if acceleration is not detected, or neither is detected, the door 10 is determined to remain in the closed state and the technique 860 remains at 862.

The angle change (from closed) is detected by comparing the current angle to a reference angle, such as the closed reference angle that is the angle measured by the magnetometer 852 when the door 10 is in the closed position. For example, the current angle may be compared to a closed angle threshold, which is the closed reference angle and any threshold buffer angle (e.g., 0.5 degrees or less, such as 0.3 or 0.1 degrees, more or less, as may be suitable to account for movement of the door 10 within the closed position and/or any fluctuations of the earth's magnetic field). If the current angle is greater than (or equal to) the closed angle threshold, then the angle change is detected; if the current angle is less than (or equal to) the closed angle threshold, then no angle change is detected. The acceleration is considered detected if acceleration is measured by the accelerometer 854 above an acceleration threshold, which may be zero (e.g., measuring non-zero acceleration), or other suitable value. Both the current angle and the acceleration may be a single measurement or may be compiled from multiple measurements (e.g., an average) at a suitable frequency or resolution (e.g., between 5 ms and 500 ms, such as between 10 ms and 250 ms, such as at 20 ms and/or at 200 ms, more or less) for a suitable number of measurements (e.g., between three and ten, such as four, more or less). Further, in the case of the magnetometer 852 measuring the magnetic field with components in the X- and Y-directions, such components may be converted to an angular measurement.

At 864, the door 10 is in the moving state and the door position detector 150 determines whether the door 10 remains moving or has changed to the closed state or the open state. The door position detector 150 measures the current angle with the magnetometer 852 and the acceleration with the accelerometer 854 and determines, according thereto, whether the door 10 is in the moving, closed, or open states. If acceleration is not detected and an angle change (from closed) is not detected, the door 10 is determined to be in the closed position and the technique 860 may proceed to 862. If no acceleration is detected and an angle change is detected, the door 10 is determined to be in the open position and may proceed to 866. The current angle measured by the magnetometer 852 (i.e., when acceleration is not detected) is also determined to be an open reference angle. The open reference angle may be later used to determine whether the door 10 is moved from the open position. If acceleration is detected, regardless of any angle change, the door 10 is determined to remain in the moving state and the technique 860 may remain at 864.

The angle change and the acceleration may be detected as described above with respect to 862 (e.g., by comparing to threshold values, such as the closed reference angle or the closed angle threshold and the acceleration threshold).

At 866, the door is in the open state and the door position detector 150 determines whether the door 10 remains in the open state or has changed to the moving state. The door position detector 150 measures the current angle with the magnetometer 852 and the acceleration with the accelerometer 854 and determines, according thereto, whether the door is still in the open state or has changed to the moving state. If both an angle change from the open state and acceleration are detected, the door 10 is determined to be in (e.g., have changed to) the moving state and the technique 860 may proceed to 864. If no angle change is detected, if no acceleration is detected, or both, the door 10 is determined to remain in the open state.

The angle change (from open) is detected by comparing the current angle to the open reference angle, which as described above, was the current angle measured by the magnetometer 852 when acceleration was not detected in the moving state (e.g., as last measured). For example, the angle change may be detected by determining whether the current angle is within or outside an open angle range, which is equal to the open reference angle and any threshold buffers or range therearound (e.g., +/−0.5 degrees or less, such as +/−0.3 or 0.1, more or less, as may be suitable to account for negligible movements of the door 10 and/or fluctuations in the earth's magnetic field). For example, if the now current angle is outside the open angle range surrounding the open reference angle, then the angle change is detected; if the current angle is within the open angle range, then no angle change is detected. The open angle range may instead be expressed as a maximum open angle threshold and a minimum open angle threshold. It should be noted that the open reference angle and/or the open angle range may change each time the door 10 is moved to a new static position.

The technique 860 may further include communicating the state of the door 10 (e.g., closed or open) to an external device, such as with the wireless communication device 858. It should be noted that the moving state is a transient state, which may be useful for determining whether the door 10 is later in the closed or open states and may, or may not, be communicated externally. Further operations may be determined based on the open or closed state of the door 10 as determined with the technique 860, the technique 860A, or otherwise with the electronic door lock 100. For example, the various other systems disclosed herein (e.g., the deadbolt operator 110, the touch detector 120, the deadbolt locker 130, and/or the key detector 140 may be inoperable (e.g., will not be operated) if the door 10 is in the open state.

Referring to FIG. 8D, a technique 860A is provided for determining whether door 10 is in a closed state, an open state, or a moving state, such as with the door position detector 150. The technique 860A is a variation of the technique 860 by including further and/or modified operations for conserving energy otherwise consumed by the magnetometer 852 and the accelerometer 854, while accounting for disturbances in the magnetic field that may be measured by the magnetometer 852. As described in further detail below, the modified operations include sampling the magnetometer 852 at different resolutions, operating the accelerometer 854 in some cases only after an angle change is initially determined, and/or by confirming different states by using timing determinations.

At 862A, as with 862, the door 10 is in the closed state and the door position detector determines whether the door 10 has potentially changed to the moving state. The door position detector 150 measures a current angle with the magnetometer 852 at a low resolution, such as between 500 ms and 100 ms (e.g., 200 ms). If no angle change (from closed) is detected, the door 10 is determined to remain in the closed state and the technique 860A may remain at 862A or may proceed to 861A at which the closed reference angle may be adjusted (described below). If at 862A an angle change is detected, acceleration is then measured with the accelerometer 854 to determine whether acceleration is detected. If at 862A acceleration is not detected (after the angle change was already detected or not if measured simultaneously), the technique 860A proceeds to 861A. If at 862A acceleration is detected (after the angle change was already detected), the technique 860A proceeds to 863A at which the door 10 is determined (e.g., confirmed) to be in the moving state or not.

The angle change and the acceleration may be detected as described above with respect to 862 (e.g., by using a singular value or averaging, and by comparing to threshold values, such as the closed reference angle and the threshold acceleration).

Power may be conserved by operating the magnetometer 852 at the low resolution. Power may be further conserved by operating the accelerometer 854 only upon detecting the angle change. Alternatively, the accelerometer 854 may be operated concurrently with the magnetometer 852.

At 861A, if the current angle is greater than an angle update threshold, the closed reference angle (or he closed angle threshold) is changed according to the current angle. The angle update threshold is, for example, equal to the closed reference angle and any update buffer or range suitable to account for disturbances in the earth's magnetic field or any other magnetic disturbances. Thus, the new closed angle threshold is changed to the current angle plus the aforementioned threshold buffer, which may be smaller than the update buffer or range. The angle update threshold may also be updated (e.g., equaling the new closed reference angle plus the update buffer or range). The technique 860A may proceed from 861A to 862A. The door 10 may be considered the closed state in 861A.

At 863A, the door position detector 150 determines whether the angle change (from closed) is detected for a predetermined time (e.g., an open duration threshold), so as to confirm whether the door 10 is out of the closed state (e.g., is in the moving state). The door position detector 150 measures the current angle with the magnetometer 852 at a high resolution, such as between 5 ms and 50 ms (e.g., 20 ms), and also measures an open time (e.g., duration or incremental counter) over which the angle change remains detected. If at 863A the angle change (from closed) is not detected, the door 10 is determined to be in the closed state and the technique 860A may proceed back to 862 (or 861A at which the closed reference angle is adjusted). If at 863A the angle change is detected and the open time exceeds an open duration threshold (i.e., the predetermined time), the door 10 is determined to be in the moving state and the technique 860A may proceed to 864A. If at 863A the angle change is detected and the open time does not exceed the open duration threshold, the technique 860A remains at 863A until either the angle change is not detected (and the door 10 is determined to be in the closed state), or the open time exceeds the open duration threshold (and the door 10 is determined to be in the moving state).

The angle change (from closed) may be detected as described above with respect to 862 (e.g., by averaging angle measurements to determine the current angle and by comparing the current angle to the closed reference angle or the closed angle threshold). By sampling at a higher resolution and/or over a longer time at 863A, the current angle may be measured more reliably (e.g., accounting for aberrant measurements) as compared to the lower resolution at 862A. The open time may be determined according to any suitable method, such as with an incremental counter or other timer, which is compared to the open duration threshold.

At 864A, as with 864, the door position detector 150 determines whether the door 10 remains in the moving state or whether the door 10 has moved to the closed or open position and been static for a predetermined time (e.g., a static duration threshold). The door position detector 150 measures the current angle with the magnetometer 852 at the high resolution, measures acceleration with the accelerometer 854, and also measures a static time (e.g., duration or incremental counter) over which acceleration is not detected and determines, according thereto, whether the door 10 remains in the moving state or has changed to the closed or open state.

If at 864A acceleration is not detected and the angle change (from closed) is not detected, the door 10 is determined to be in the closed state and the technique 860A may proceed back to 862A (or 861A at which the closed reference angle is adjusted). If at 864A acceleration is not detected, the angle change is detected, and the static time exceeds the static duration threshold, the door is determined to be in the open state and the technique 860A may proceed to 866A. The technique 860A also establishes the current angle as an open reference angle to which later angle measurements are compared to determine if the door 10 has moved from the open position. If at 864A acceleration is detected or the static time does not exceed the static duration threshold, the door 10 is determined to remain in the moving state and the technique 860A remains at 864A until no acceleration is detected (e.g., the door 10 is in the closed state or in the open state).

The angle change (from closed) may be detected as described above with respect to 862 (e.g., by averaging measurements to determine the current angle, and by comparing the current angle to the closed reference angle or the closed angle threshold). The static time may be determined according to any suitable method, such as with an incremental counter or other timer, which is compared to the static duration threshold.

At 866A, as with 866, the door 10 is in the open state and the door position detector 150 determines whether the door 10 remains in the open state or has changed to the moving state. The door position detector 150 measures the current angle with the magnetometer 852 at the low resolution. If at 866A an angle change is detected (from open), then acceleration is measured with the accelerometer 854 to determine whether acceleration is detected. If at 866A acceleration is not detected (after the angle change was already detected or not if measured simultaneously), the door 10 is determined to remain in the open state and the technique remains at 866A. If at 866A, acceleration is detected (after the angle change was already detected), the technique 860A proceeds to 867A at which the door 10 is confirmed to be in the open state or not.

The angle change (from open) may be detected as described above with respect to 866 (e.g., by averaging measurements to determine the current angle, and by comparing the current angle to the open reference angle or open reference range). The acceleration may be detected as described previously.

Power may be conserved by operating the magnetometer 852 at the low resolution. Power may be further conserved by operating the accelerometer 854 only upon detecting the angle change. Alternatively, the accelerometer 854 may be operated concurrently with the magnetometer 852.

At 867A, the door position detector 150 confirms whether the door is in the open or closed positions by determining whether the door 10 has been outside the closed position for a predetermined time, so as to determine whether the door 10 remains in the open state or is in the moving state. The door position detector 150 measures the current angle with the magnetometer 852 at the high resolution and also measures a movement time (e.g., duration or incremental counter) over which the current angle is outside the open range. If at 867A an angle change (from open) is not detected, the technique 860A determines the door 10 to be in the open state and proceeds back to 866A. If at 867A the angle change is detected and the movement time is less than a static duration threshold, the door 10 is determined to be in the open state and the technique 860A proceeds to 866A. If at 867A the angle change is detected and the movement time is greater than the static duration threshold, the door 10 is determined to be in the moving state and the technique 860A proceeds to 864A.

The angle change (from open) may be detected as described above with respect to 866 (e.g., by comparing to the open reference angle or range therearound). The movement time may be determined according to any suitable method, such as with an incremental counter or other timer, which is compared to the static duration threshold.

The technique 860A may further include communicating the door position (e.g., closed or open) to an external device with the wireless communication device 858.

Figure 8F:
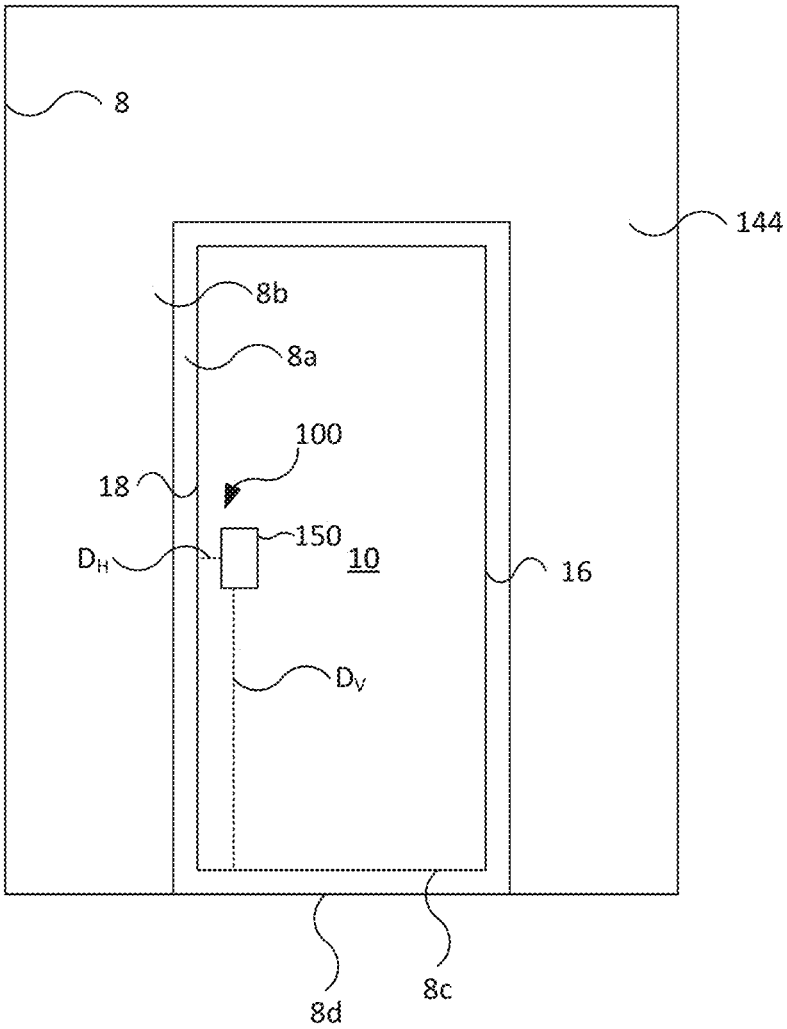

Referring additionally to FIGS. 8E and 8F, the position detector 150, or the electronic door lock 100 otherwise, may, instead of or in addition to the magnetometer 852 and the accelerometer 854, include one or more additional sensors (e.g., of the sensors 266) to determine or otherwise assess whether the door 10 is closed or open. As shown schematically in FIG. 8E, the position detector 150 may include a microphone 855 and/or a proximity sensor or other contactless distance measuring device.

The microphone 855 may be used to determine audibly whether the door 10 is open and/or closed. As the door 10 is opened (i.e., moved from the closed position) and closed (i.e., move to the closed position), sound signature is produced (e.g., as the door 10 engages and disengages various objects, such as a door frame, threshold, and seal) and passes through the air, which may have unique audio characteristics (e.g., an audio signature) that are indicative of the door 10 being opened or closed. As a result, the sound produced as the door is opened or closed may be used as an indicator of whether the door is closed or not.

For example, during an initial setup operation and/or subsequent usage of the door 10, the door position detector 150 records with the microphone 855 sound as the door 10 is opened and/or closed (e.g., initial closing recording and initial opening recording). Subsequently, as the door 10 is opened and closed, audio may be detected (e.g., recorded) and compared to the initial closing recording and/or the initial opening recording to assess whether the door is closed or is opened (e.g., current recordings). The initial recordings and the current recordings may be compared in any suitable manner. For example, the initial recordings may be processed in some manner to represent the sound signature, for example, to produce an initial sound representation (e.g., spectrogram or other type of audio representation). The current recordings are processed in as similar manner to produce a current sound representation that is then compared to the initial sound representation (e.g., for closing and/or opening). If the current recording matches (or otherwise favorably compares to) the initial closed recording or the initial opening recording, the door 10 is determined to be closed or open, respectively. Such a determination may be referred to as a sound-based door position determination. The aforementioned processing and comparison may be performed by a controller (e.g., the controller 856 and/or the controller 262).

Further, because the door 10 may be opened or closed in different manners (e.g., at different speeds), multiple initial recordings may be captured to which the current recording is later compared to determine whether the door is closed or open. Such initial recordings may be recorded during the initial setup or over time as the door 10 is used.

The sound-based door position determination may be used in different manners, such as a standalone indicator of whether the door is open or closed, or in conjunction with other door position determinations (e.g., to confirm the door position as determined with the magnetometer 852 and the accelerometer).

The proximity sensor 857 is configured to detect distance therefrom to a fixed portion of the building structure in order to determine whether the door 10 is closed or open. For example, whenever the door 10 is in the closed position, the door 10 and, thereby, the electronic door lock 100 and the proximity sensor 857 are in a repeatable position relative to and in line of sight of static features of the building structure 8 near the door 10, such as a vertical door frame 8*a* (or door trim) or a lower door threshold 8*b*, which may be referred to as a building reference feature (e.g., building target feature).

The proximity sensor 857, by having line of sight to the building feature, can determine a distance thereto, which may be unique to other positions and referred to as a closed reference distance, which may be unique to the closed position as compared to open positions.

Referring to FIG. 8F, for example, the proximity sensor 857 may measure horizontal distance DH to a vertical door frame 8*a* (or door trim thereon), which projects forward (out of the page) relative to an adjacent wall. As the door 10 is moved (e.g., swings) from the closed position, the distance measured by the proximity sensor 857 is expected to increase as the proximity sensor 857 points to building structures or other objects further from the proximity sensor 857 (e.g., a wall across a room). In another example, the proximity sensor 857 may measure vertical distance $D_V$ to the lower door threshold 8*c*, which protrudes above the floor 8*d* on which the threshold 8*c* may be positioned. As the door 10 is moved from the closed position, the distance measured by the sensor 857 is expected to increase as proximity sensor 857 points to the floor 8*d* instead of the threshold 8*c*. Accordingly, if the current distance measured by the proximity sensor 857 is the same as or different from (e.g., greater than) the closed reference distance, the door 10 is determined to be closed or open, respectively. Such a determination may be referred to as a proximity-based or distance-based door position determination. The aforementioned measurement may be performed may be performed by a controller (e.g., the controller 856 and/or the controller 262).

The proximity sensor 857 may be any suitable type of contactless proximity sensor, such as a laser-based, other optical (e.g., infrared) time of flight sensor (e.g., a laser range finder, radar, or ultrasonic).

The proximity-based door position determination may be used in different manners, such as a standalone indicator of whether the door is open or closed, or in conjunction with other door position determinations (e.g., to confirm the door position as determined with the magnetometer 852 and the accelerometer).

Referring to FIGS. 9A to 9B, the electronic door lock 100 detects various conditions, which may be indicative of the user's intent and permission to open the deadbolt lock 20 (e.g., combination of touch and electronic key detection, or rotation of the deadbolt lock 20 as with a conventional key) or malintent (e.g., erratic touch over a time and/or with torque), and determines according thereto to whether the deadbolt lock 20 may be opened by the electronic door lock 100 or according to which the deadbolt lock 20 may be secured with the deadbolt locker 130. The various techniques described herein may be implemented with the various sensors and systems described herein, which may further include one or more movement sensors 412*a* (e.g., one of the sensors 266, for example, being integrated with or otherwise coupled to the pin 416 or the motor 412) that is configured to measure torque applied to the deadbolt mechanism 22 (e.g., to the keyed cylinder 24 and/or the pin 416), and/or a position of the deadbolt mechanism 22 (e.g., rotation of the deadbolt lock 20 and/or the keyed cylinder 24 and/or linear position of the bolt 22*a* in a gradual or binary manner, such as with a mechanical or optical sensor), or other conditions associated with movement of the pin 416. In one preferred example, the movement sensor 412*a* is a Hall effect sensor that detects changes of magnetic field due to rotation (full or partial) of the pin 416. Hall effect sensors may be advantageous, for example, to detect partial rotation of the pin 416, which may be indicative, for example, of an impermissible attempt to unlock the deadbolt lock 20 (e.g., without a physical key), such as with a bump key or lock pick. A full rotation (e.g., 180 degrees) may indicate use of the physical key associated with the deadbolt lock 20. The various techniques described herein may, for example, be performed by the controller 262 according to software programming with the various sensors and systems described herein, which may be the controller used with one or more of the other systems described herein. The sensors 266 may also include the touch sensor 522 and the accelerometer 854.

In the various techniques described below, the electronic door lock 100 may determine whether to unlock the deadbolt lock 20 (e.g., by operating the deadbolt operator 110) according to detection of an electronic key 145 (e.g., with the electronic key detector 140) and touch of the deadbolt lock 20 (e.g., capacitance or touch sensed with the touch sensor 522, such as with the touch detector 120). The electronic door lock 100 may additionally determine whether to block (e.g., disable) the deadbolt lock 20 (e.g., by operating the deadbolt locker 130) according to a combination of (e.g., two, three, or four of) detection of an electronic key 145 (e.g., with the electronic key detector 140), touch (e.g., capacitance or touch sensed with the touch sensor 522, such as with the touch detector 120), movement (e.g., rotation) of the deadbolt lock 20 (e.g., of the pin 416), and/or acceleration of the electronic door lock 100.

Referring to FIG. 9A, a technique 900 determines whether to unlock a deadbolt (e.g., the deadbolt lock 20) with an electronic door lock (e.g., with the deadbolt operator 110 of the electronic door lock 100). The technique 900 generally includes operations of detecting touch at 902, detecting an electronic key at 904, and unlocking the deadbolt at 906 (e.g., with the deadbolt operator 110) according to both detecting touch at 902 and detecting the electronic key at 904.

At 902, the electronic door lock 100 detects touch on the exterior side 14 of the door 10, for example, touch of the deadbolt lock 20 electrically coupled to the touch sensor 522. For example, detection of touch at 902 may be determined with the touch detector 120 described previously (e.g., the technique 530 or the technique 530A), or in another suitable manner to detect an intentional touch by a user (e.g., if capacitance exceeds a predetermined threshold). Detection of such an intentional touch may be referred to as a positive touch. It should be noted that other classifications of touch may be detected, as will be described for example, such as erratic touch (e.g., with fluctuating capacitance) that may be indicative of malintent.

At 904, the electronic door lock 100 detects an electronic key 145 (i.e., detects an electronic key that is authenticated or otherwise associated with the electronic door lock 100 for permissive operation thereof). For example, the electronic key 145 may be detected with the electronic key detector 140 in the manners described previously (e.g., with the technique 780 and the antennas 743 and variations thereof). Such detection of an electronic key 145 that is authenticated or otherwise associated with the electronic door lock 100 for authorized operation thereof may be referred to as a positive electronic key detection, which is to be distinguished from detection of other electronic keys 145 not associated for operation of the electronic door lock (e.g., for other electronic door locks, such as those on different homes) or non-detection. If no associated electronic key 145 is detected but touch is still or is again detected at 902, the electronic door lock 100 continues to repeat the operation 904 of detecting an electronic key 145. Detection of the electronic key 145 at 904 is preferably performed upon detection of a positive touch at 902, for example, to conserve power associated with detecting electronic keys 145 but may be performed prior thereto or concurrent therewith.

At 906, the electronic door lock 100 unlocks the deadbolt lock 20 (e.g., operates the deadbolt operator 110) upon both a positive touch detection at 902 and a positive key detection at 904.

Still referring to FIG. 9B, a technique 910 is provided for disabling an electronic door lock (e.g., the electronic door lock 100) and/or disabling a deadbolt (e.g., the deadbolt lock 20) with the electronic door lock (e.g., the deadbolt locker 130 of the electronic door lock 100). The technique generally includes detecting touch at 912 and also one or both of detecting rotational motion at 914 of the deadbolt lock 20 (e.g., of the pin 416) and/or detecting acceleration at 916 of the door 10 (e.g., of the electronic door lock 100). Such touch, rotation, and acceleration may be considered lock tampering risk factors. The technique further includes making a risk determination at 918 according to the lock tampering risk factors, and at 920 disabling the electronic door lock 100 (e.g., so as to not operate the deadbolt operator 110) and/or blocking the deadbolt lock 20 (e.g., by operating the deadbolt locker 130). The technique 910 may also include detecting the electronic key 145, for example, with the technique 900 (i.e., for unlocking the deadbolt lock 20) being performed in conjunction with the technique 900 (i.e., for blocking the deadbolt lock 20).

At 912, the electronic door lock 100 detects touch 912, such as with the touch sensor 522 (e.g., capacitance). For example, the electronic door lock 100 may determine an erratic touch, which may have characteristics associated with lock tampering (e.g., use of lock picking tools) of the deadbolt lock 20 (e.g., of the keyed cylinder 24). An erratic touch includes one or more instances of elevated changes in capacitance (e.g., peak-to-peak fluctuations) over a short period of time (e.g., less than approximately two, one, or half a second, more or less). An elevated change of capacitance may be determined relative to a threshold magnitude, which may be referred to as a capacitance change threshold. The capacitance change threshold may be fixed or may vary. For example, the capacitance change threshold may vary according to the magnitude of capacitance being sensed (e.g., a steady-state capacitance, which may vary according to the person or object touching the touch sensor). For any steady-state capacitance, the magnitude of the measured capacitance is expected to normally fluctuate, which may be referred to as noise. The magnitude of such noise increases as the magnitude of the steady-state capacitance magnitude increases. Accordingly, the capacitance change threshold for determining erratic touches may increase as the steady-state capacitance magnitude increases, so as to distinguish between erratic touches (e.g., indicative of lock tampering) and steady-state touches (e.g., indicative of intent to operate the electronic door lock 100). In one example, the capacitance magnitude threshold is a multiple of the standard deviation of the current steady-state capacitance being measured (e.g., being between two and seven times the standard deviation, such as between three and five times, such as three, four, or five times). It should be noted that use of a physical key with the keyed cylinder 24 may result in determination of an erratic touch, thus it may be advantageous to evaluate touch in combination with other factors (e.g., rotation and acceleration, as described below) to mitigate disabling the electronic door lock 100 and/or blocking the deadbolt lock 20 based only on touch (e.g., only on capacitance).

At 914, the electronic door lock 100 detects rotation of the pin 416, for example, with the movement sensor 412*a* (e.g., a Hall effect sensor as mentioned above). Rotation of the pin 416 through its full range of motion (e.g., 180 degrees) may be indicative of deadbolt lock 20 having been operated by a physical key, while erratic rotation of the pin 416 may be indicative of lock tampering (e.g., bypassing the keyed cylinder 24). An erratic rotation may include one or more partial rotations of the pin 416 at an instance or over a period of time. Such a partial rotation may be a small angular movement (e.g., within a range) with such a movement being defined between slowed, stopped, or reversed rotation. A partial rotation may, for example, be less than 45, 30, 15, 10, or 5 degrees or less and greater than 1, 2, or 3 degrees or more). Erratic movement may also be determined by fluctuations in readings from the movement sensor 412*a*, which may be compared to a suitable movement change threshold. In one example, the movement sensor 412*a* may experience noise at a constant position, and the movement change threshold is a multiple of the standard deviation of the noise of the movement sensor 412*a* (e.g., between two and six times the standard deviation, such as three, four, or five times).

At 916, the electronic door lock 100 detects acceleration thereof, such as with the accelerometer 854. Acceleration may, by itself, reflect an innocuous event, such as wind, knocking, or debris engaging the door 10. Acceleration, detected in combination with other factors (e.g., an erratic touch and/or an erratic rotation) may be indicative of lock tampering, such as with a bump key as is understood in the art. An erratic acceleration may be determined when measured acceleration exceeds an acceleration threshold. The acceleration threshold may be a fixed value, for example, being based on experimentation or according to noise within acceleration readings. For example, output from the accelerometer 854 may normally fluctuate at steady state, while the acceleration threshold may be a multiple of the standard deviation of the noise of the output from the accelerometer 854 (e.g., between one and seven times the standard deviation, such as between three and five times, such as three, four, or five times).

At 918, a risk assessment is made according to the detection of touch, rotation, and acceleration at 912, 914, and 916. For example, substantially contemporaneous determination of an erratic touch, an erratic rotation, and/or an erratic acceleration may be indicative of a tempering threat according to which the electronic door lock 100 may be disabled (e.g., so as to not operate the deadbolt operator 110) and/or the deadbolt lock 20 may be blocked (e.g., by operating deadbolt locker 130).

In forming the risk assessment, each of the lock tampering risk factors may be weighted differently. For example, an erratic touch may be weighted relatively low, because an erratic touch may be the result of actions by a user having a physical key associated with the deadbolt lock 20, such as when inserting the associated physical key or when accidentally inserting a different physical key. An erratic rotation may be weighted moderately, because an erratic rotation may be the result of unlikely actions of a user having a physical key associated with the deadbolt lock 20, such as rotating the associated physical key in a back and forth or otherwise erratic manner. An erratic acceleration may be weighted highly, because an erratic acceleration may, in combination with others of the risk factors, indicate an immediate threat (e.g., a bump key). Furthermore, a risk assessment may be bypassed or determined to be no risk if a full rotation is detected or upon detection of an authorized electronic key 145.

In one specific example, the risk assessment is determined according to a risk counter, while each of the lock tampering risk factors accelerates the counter. Once the risk assessment exceeds a risk threshold, a lock tampering risk is determined present. For illustrative purposes, erratic touch has a risk value of three, erratic rotation has a risk value of five, and erratic acceleration has a risk value of eight, while the risk counter threshold is nine. Starting the counter from zero, when a touch is detected (e.g., at 902 of the technique 900) and no authorized electronic key 145 is detected (e.g., at 904 of the technique 900), the counter is started and increments higher (e.g., linearly) with time while touch is still detected (e.g., at 902). If erratic touch is detected (e.g., at 912, which may inherently coincide with touch being detected at 902), the risk counter is increased by the risk value of three. If the erratic rotation is detected (e.g., at 914), the risk counter is increased by the risk value of five. If the erratic acceleration is detected (e.g., at 916), the risk counter is increased by the risk value of eight. If at any time, the touch is no longer detected (e.g., at 902), the risk counter decrements lower until reaching zero. If at any time, the electronic key 145 that is associated with the electronic door lock 100 is detected (e.g., at 904 of the technique 900), the deadbolt is unlocked (e.g., at 906 of the technique 900). Reoccurrence of any of the lock tampering risk factors at suitable interval may result in further acceleration of the risk counter by the corresponding risk value.

The risk values associated with each of the erratic touch, rotation, and acceleration may be different than described above (e.g., higher or lower). Furthermore, various combinations of simultaneous occurrence of such lock tampering risk factors may result in exceeding the risk threshold, while others may not. For example, erratic touch (e.g., risk value of three) and/or erratic rotation (e.g., risk value of five) in combination with acceleration (e.g., risk value of eight) exceed the risk threshold (e.g., nine). On the other hand, erratic touch and erratic rotation do not alone exceed the risk threshold but may with maintained touch over time and/or later occurrence of acceleration and/or re-occurrence of erratic touch and/or erratic rotation.

If the risk assessment exceeds the risk threshold, or is otherwise determined to be a high risk (e.g., based on simultaneous or contemporaneous occurrence of the lock tampering risk factors), the deadbolt lock 20 is blocked at 920 (e.g., by operating the deadbolt locker 130). For example, the deadbolt locker 130 may block the deadbolt lock 20 for a duration of which may be referred to as a lockout duration). The lockout duration may be a predetermined amount of time. The lockout duration may also increase as a function of a number of high risk determinations (e.g., occurring over a fixed or variable time frame). Instead of or in addition to blocking the deadbolt 20 at 920, the electronic door lock 100 may provide a notification or alert, such as a visual notification (e.g., via the lights 529*c*, the display 530, or other light or display of the electronic door lock 100), an audible notification or siren (e.g., via a speaker or other audible output device of the electronic door lock 100), or by sending a signal, such as a notification signal or an alert signal communicating information of a high risk determination (e.g., via the wireless communication device 264, such as to a phone or other electronic device of the user or to a municipality or other authority).

If the risk assessment does not exceed the risk threshold, erratic touch, rotation, and acceleration are still detected at 912, 914, and 916 and then assessed at 918.

If a full rotation is detected, the risk assessment is determined to be no risk and/or the technique 900 (i.e., determining whether to unlock the deadbolt) and/or the technique 910 (i.e., for disabling the electronic door lock and/or blocking the deadbolt) are stopped since the full rotation indicates that the deadbolt lock 20 has been manually unlocked (e.g., with the physical key).

If an electronic key 145 associated with the electronic door lock 100 is detected, the deadbolt lock 20 is unlocked (e.g., with the deadbolt operator 110) and the technique 910 is stopped, since the deadbolt lock 20 has been unlocked.

Instead of determining a risk assessment, other logics may be used. Referring to FIG. 9B, another technique 930 is provided for determining whether to unlock or block the deadbolt lock 20.

At 932, it is determined whether a touch has been detected, for example, with the technique 530 or the technique 530A.

At 934, if a touch was determined at 932, it is determined whether an electronic key has been detected, for example, with the technique 780.

At 936, if an electronic key was detected at 934, the deadbolt operator 110 is operated to open the deadbolt lock 20.

At 938, if an electronic key was not detected at 934, it is determined whether a full rotation has been detected (e.g., of the keyed cylinder 24 or the pin 416). If a full rotation is detected (e.g., if the deadbolt lock 20 is operated by a conventional physical key), no action is taken.

At 940, if a full rotation was not detected at 938, it is determined whether erratic capacitance is detected. Erratic capacitance may be indicative of the deadbolt lock 20 being picked with lock pick. Erratic capacitance means widely varying capacitance levels (e.g., above a reference capacitance). If erratic capacitance is not detected, the technique 930 may proceed to 904 to again determine whether a new touch has been detected.

At 942, if erratic capacitance was detected at 940, it is determined whether a duration of the erratic capacitance (e.g., an erratic duration) exceeds a predetermined time (e.g., a timer). If the erratic duration does not exceed the timer, it is continued to be determined whether erratic capacitance is still detected at 940.

At 944, if the erratic duration exceeds the timer, the deadbolt locker is engaged. An extended duration of erratic capacitance may indicate a continued attempt to pick the deadbolt lock 20.

At 946, if the erratic capacitance is detected at 940, regardless of the duration at 942, it is determined whether torque has been applied to the deadbolt lock 20.

At 948, if torque has been applied to the deadbolt at 946, the deadbolt locker is engaged. A combination of erratic capacitance detected at 912 and torque detected at 912, regardless of the erratic duration at 914, may be indicative of an attempt to pick the deadbolt lock 20.

Variations of the techniques may omit various operations (e.g., measuring torque and/or rotation), perform different operations (e.g., determine position of the deadbolt lock 20), and/or perform various operations in different orders (e.g., reversed or concurrently).

Referring to FIGS. 10A-10E, a turnkey electronic module for converting a locking device into a smart locking device includes a processor, a printed circuit board, and an electric motor. The processor is mounted on the printed circuit board and the printed circuit board is configured to mount within a housing of the locking device. The electric motor is in communication with the processor and is configured to actuate a locking assembly of the locking device so as to lock or unlock the locking device. The locking device 1010 may further include various systems, components, or other aspects of the electronic door lock 100 described previously.

The turnkey electronic module is a passive home entry module which, in its basic form, provides Lock and Unlock functions through simple touch of the door handle. Using the turnkey electronic module, door lock manufacturers can cost-effectively compete in the burgeoning smart lock market segment by reducing R&D costs and focusing on their core competency of making door lock hardware. The electronic modules are designed to be incorporated inside door lock assemblies. They provide the quasi-totality of electronic circuitry and software necessary to produce a smart lock. In other words, it is a turnkey solution. As a B2B product, the module is intended to be supplied to door lock manufacturers who will market the end products under their brands.

The module is a relatively small and compact electronic unit. It is housed and sealed. It only has two external interfaces: a mating metal piece that rotates the door lock shaft for locking/unlocking, and a battery connector. It is easily integrated into door lock designs by running the shaft through the center hole of the module and attaching the connector to a battery or an alternative power source. The mechanical key does not need to be eliminated for the module to be incorporated.

The basic electronic module mainly comprises of a capacitive sensor to detect user intent (Lock or Unlock), an antenna for authentication, and a motor for rotating the shaft. The replaceable battery pack or other power source that powers the module is provided externally by the manufacturers. Advanced electronic modules can provide further optional functions. These options include Bluetooth Low Energy (BLE) for user intent and/or authentication through smartphones, and Wi-Fi for broadcasting module data to a server. These additional features enable manufacturers to communicate Lock and Unlock commands to the module remotely. As a result, they can add features such as unlock on approach (BLE) or mobile app usage (Wi-Fi or BLE). Though the advanced modules enable these applications, the manufacturer is responsible for creating an app and defining the features they wish to offer. The module will provide an integration guide to allow for seamless interfacing.

Referring now to FIG. 10A, a locking device 1010 incorporating a module to convert the locking device 1010 to a smart locking device is shown. Here, the locking device 1010 includes a pin 1012 that when actuated actuates a locking assembly 1014 so as to move a deadbolt 1016 into a locked or unlocked position. The locking device 1010 also includes a mounting plate 1018 that has configured such that a sensor assembly is mounted into the mounting plate 1018. The locking device 1010 along with the mounting plate 1018, may be mounted to a door 1020.

Referring to FIG. 10B, a more detailed view of the module 1022 for converting the locking device of FIG. 10A to a smart locking device is shown. Here, the module 1022 includes a printed circuit board 1024 configured so as to be inserted within the locking device 1010 of FIG. 10A. The printed circuit board 1024 may include any one of a number of different electrical components, such as a processor 1026. The processor 1026 may be in communication with a sensor via a wire (electrode) 1028. The sensor may be a capacitive touch sensor that sends an electrical signal through the wire or wires 1028 to the processor 1026. As such, based on the electrical signals received by the processor 1026, the processor 1026 can determine if a user is touching the locking device. For example, the processor 1026 and the capacitive touch sensor may be configured to form the touch detector 120 as described previously, for example, to implement the technique 530 and/or the technique 530A.

Referring to FIG. 10C, another view of the locking device 1010 is shown. Here, with the wires 1028 extending out of the locking device 1010 so as to be in communication with the mounting plate 1018 of FIG. 10A. Thusly configured, an electrical signal will be generated based on the user's touch of the mounting plate and this electrical signal is provided to the processor 1026 of FIG. 10B. From there, the processor 1026 of FIG. 10B can send instructions to an electrical motor that can rotate the pin 1012 so as to lock or unlock the locking device.

Referring to FIG. 10C, another view of the locking device 1010 is shown. Here, the locking device is mounted to the door 1020. Here, the electrical wires 1028 will be in electrical contact with the mounted plate 1018 and the mounted plate 1018 will be in electrical contact with the deadbolt 1016. As stated before, the processor, as best shown in FIG. 10B, can be configured such that when it receives electrical signals when a user touches the locking device 1010, the processor 1026 can instruct an electrical motor to turn the pin 1012 so as to unlock the locking device 1010.

Referring to FIG. 10E, a block diagram of the electrical components of the turnkey module is shown. Here, as stated previously, the electrical components may include a processor 1026. The processor 1026 may be in communication with a sensor, such as the mounting plate 1018 via wires (or electrodes) 1028. Electrical signals generated when a user touches the mounting plate 1018 can be transmitted to the processor 1026 via the wires 1028. Upon receiving the electrical signals, the processor 1026 can make any one of a number of determinations regarding what these signals mean.

For example, based upon the touch of the locking device, the processor 1026 could instruct an electrical motor 1030 to actuate the locking assembly so as to move the deadbolt from a locked or unlocked position or vice versa. Additionally, the processor may further be in communication with an antenna 1032. The antenna 1032 may be configured to receive electromagnetic waves from any one of a number of devices, such as a smartphone, radio frequency identification tag, or other device capable of transmitting electromagnetic waves. These electromagnetic waves received by the antenna 1032 are converted to electrical signals and provided to the processor 1026. Upon receiving the signals, the processor 1026 may perform any one of a number of different functions including instructing the motor 1030 to lock or unlock the locking device. For example, the aforementioned devices may be configured as an electronic key 145 (as described previously), while the processor 1026 and the antenna 1032 may be configured to form the electronic key detector 140 or a variation thereof as described previously, which may implement the technique 780 for detecting the electronic key 145.

As such, this specification discloses a turnkey module that can be easily incorporated by current manufacturers of locking devices so as to provide these manufacturers with a quick solution in the quickly growing smart lock marketplace. For example, as this module provides basic and can even be modified to provide even advanced functionality, traditional hardware lock manufacturers can rapidly incorporate the module so as to convert their traditional locking devices into smart lock devices.

Referring to FIGS. 11A-11L, systems and methods are disclosed for preventing lockpicking and/or tampering with a lock, and more specifically to systems and methods to prevent lockpicking and/or tampering with a lock (e.g., a deadbolt lock) of a door A locking device for detecting tampering or lock picking of a locking assembly of the locking device includes a mounting plate configured to partially house the locking assembly, a touch sensor, an anti-picking actuator, and a processor in communication with the touch sensor and the anti-picking actuator.

The anti-picking actuator moves between a first position that physically prevents the deadbolt of the locking assembly from moving from the locked position to the unlocked position and a second position that allows the deadbolt to move between the locked position and the unlocked position. The processor is configured to determine when the electrical signal emitted from the touch sensor indicates that the locking assembly is being picked or tampered with by the user and to actuate the anti-picking actuator to the first position when the processor determines that the locking assembly is being picked or tampered with to prevent the lock from being unlocked.

Referring to FIGS. 11A-11D, different views of a locking device 1110 are shown. The locking device 1110 may further include various components or aspects of the locking device 1010 and/or the electronic door lock 100 described previously. Generally, the locking device 1110 is to be mounted on a door. When a pin 1112 rotates in the appropriate direction, a locking assembly, shown and described later in this specification, moves a deadbolt from a locked position to an unlocked position. By so doing, this allows one to open the door in which the locking device 1110 is attached to.

Referring to FIGS. 11E and 11F, these figures illustrate the locking device 1110 being mounted to a door 1114. Here, the locking assembly 1116 is shown to include a deadbolt 1118 that is capable of moving between the locked and unlocked position. In FIGS. 11E and 11F, the deadbolt 1118 is shown to be in an unlocked position thereby allowing the door 1114 to open freely. As such, when a user wishes to unlock or lock the locking device, the user must insert a key or similar device through a housing 1120.

Generally, when inserting the key through the housing 1120, the user's hand may come in contact with the housing 1120. It has been noted that constant contact with the housing 1120 indicates that the locking device 1110 is being tampered with or being picked so as to gain unauthorized access to the space located behind the door 1114. Here, the housing 1120 partially houses the locking assembly 1116 and may include a sensor 1122. The sensor 1122 is capable of detecting the touch of the user and emits an electrical signal indicating when a user has touched the housing 1120.

Referring to FIGS. 11G and 11H, the backside of the locking device 1110 is shown. Here, an anti-picking actuator 1124 is shown. In FIG. 11G, the anti-picking actuator 1124 is in a position that allows the locking assembly to move the deadbolt between a locked and unlocked position. However, as shown in FIG. 11H, the anti-picking actuator 1124 is an extended position that prevents the movement of the locking assembly so as to prevent the movement of the deadbolt from a locked to unlocked position. As will be described later in this specification, the device 1110 also includes a processor that is able to determine when the locking device 1110 is being picked or tampered with and then can move the anti-picking actuator 1124 so as to prevent the movement of the deadbolt 1118. The locking device 1110 may be configured as the electronic door lock 100 described previously, such as including the deadbolt locker 130 described previously (e.g., with the anti-picking actuator 1124 be configured as the locking actuator 632).

FIGS. 11I-11K illustrate a more detailed view of the anti-picking actuator 1124. The anti-picking actuator 1124 may be such that when it is in extended position it comes into contact with a flange 1126 that prevents the movement of the locking assembly 1116 so as to prevent the movement of any deadbolt between a locked and unlocked position.

Referring to FIG. 11L, a block diagram of the electronic components of the locking device are shown. Electronic components include a processor 1130 in communication with a sensor 1122. As stated previously, the sensor 1122 that emits an electrical signal when a user comes into contact with the sensor 1122. The sensor 1122 is generally mounted to the housing 1120. As such, when the housing 1120 is touched by the user, the sensor 1122 will emit an electrical signal to the processor 1130.

Additionally, the electronic components include an electric motor 1132 in communication with the anti-picking actuator 1124. The processor 1130 analyzes these electrical signals from the sensor 1122 and determines that the locking device has been picked or tampered with. After such a determination is made, the processor 1130 instructs the motor 1132 to engage the anti-picking actuator 1124 so as to prevent the movement of the deadbolt from a locked to unlocked position.

As such, the device disclosed in this specification has the ability to determine when the locking device is being picked or tampered with. Upon a determination that the lock is being picked or tampered with, the locking device has the ability to physically prevent the deadbolt from moving between the locked and unlocked position.

Furthermore, the processor 1130 may be able to make a second determination that no tampering or lock picking is being performed and then can move the anti-picking device into a second position that allows the deadbolt to move between the locked and unlocked position. This determination may be made based on the amount of contact made with the plate 1120 as determined by electrical signals emitted by the sensor 1122. Additionally, the processor 30 may start a timer upon determining that the lock is being picked or tampered with and then may only make a determination that the lock is not being picked or tampered with after a certain period of time has elapsed, for example, one hour.

Additionally, other devices could be utilized to communicate with the processor so as to indicate and to force the processor to move the anti-picking device into a position such that allows the deadbolt to move freely. This could be done with a specialized key or perhaps a certain type of touch by the user to the mounting plate 1120 as detected by the sensor. For example, a certain number of taps or other indication provided to the mounting plate by the user could be determined by the processor to be an authorized person attempting to move the anti-picking device into the position that allows the deadbolt to move freely.

Furthermore, in determining whether the locking device (e.g., the deadbolt) is being tampered with, the locking device 1110 may implement the technique 900 and/or the technique 910 described previously (e.g., by detecting erratic touch) and/or include further components described with respect thereto (e.g., the movement sensor 412*a* to detect the position of the pin 1112 and/or the accelerometer 854 for detecting acceleration of the locking device 1110.

Referring to FIGS. 12A-12C, an electronic locking device includes a locking assembly and a battery pouch. The locking assembly includes a deadbolt and is configured to move the deadbolt between an unlocked position and a locked position. The electronic locking device is configured to be at least partially disposed within the cavity formed within a door that utilizes electronic locking device. The battery pouch contains a battery for powering the electronics of the electronic locking device and is configured to extend and be housed substantially within the cavity formed within the door when the locking assembly is attached to the door.

Referring now to FIG. 12A, an electronic locking device 1210 is shown. The locking device 1210 may further include various components or aspects of the locking devices 1010, 1110, and/or the electronic door lock 100 described previously. The electronic locking device 1210 may be a locking device that interacts with a locking assembly. The locking assembly can include a deadbolt that can extend between a locked position and an unlocked position. The locking assembly includes a pin 1212 that when rotated accordingly, will rotate the locking assembly which in turn actuates the deadbolt between a locked and unlocked position. Generally, the locking assembly 1210 includes a mounting plate 1214. The mounting plate 1214 generally houses the internal components of the device 1210. Here, the device 1210 also includes a sensor 1216 for determining when a user touches the locking device 1210. As such, the locking device 1210 will include at least the sensor, which is an electrical component but will also most likely contain additional other electrical components, such as a processor for receiving information from the sensor 1216. In addition, the locking device 1210 may include other electrical components, such as an electrical motor capable of turning the pin 1012 so as to actuate the locking assembly so as to move the deadbolt between an unlocked and locked position.

In order to power the electrical components of the locking device 1210, a battery pouch 1218 having at least one battery cell is provided for. The battery pouch 1218 is generally attached to the locking assembly 1210 opposite of the mounting plate 1214.

As shown in FIG. 12B, the locking device 1210 is shown inserted into a cavity 1222 (e.g., a bore) of a door 1220. The cavity 1222 may take any shape, but in this example is shown to be round so as to physically mate with the circular shape of the locking device 1210. As can be shown in this figure, the battery pouch 1218 extends into the cavity 1222 of the door 1220. By so doing, a fairly large battery can be utilized to power the electrical components of the locking device 1210. In addition, because the battery pouch 1218 is located substantially or entirely within the cavity 1222, the overall aesthetic design of the locking device 1210 can take any one of a number of different forms without having to consider the size and shape of the battery or battery pouch 1218, as the battery is contained within the battery pouch 1218 and is substantially or entirely located within the cavity 1222 of the door 1220.

Referring to FIG. 12C, a cross-sectional view of the battery pouch 1218 is shown. Here, the battery pouch 1218 includes two separate battery cells 1224A and 1224B. These battery cells may be any type of battery cell, but in this example are known as AAA batteries. Of course, it should be understood that any type of battery cell could be utilized, so long as it is capable of being substantially located within the cavity 1222 of the door 1220.

Referring to FIGS. 13A and 13B, the electronic door lock 100 includes a battery 1368*a*, for example, the power source 268 (e.g., a battery) shown in FIG. 7H or the battery pouch 1218, which may be wirelessly (e.g., inductively) charged. A receiving coil 1368*b* is electrically coupled to the battery 1368*a* (e.g., via suitable circuitry and/or electrical components, to facilitate charging of the battery 1368*a* with the receiving coil 1368*b*. The receiving coil 1368*b* is coupled to the door 10 at a suitable location for reliably aligning the receiving coil 1368*b* with a transmitting coil 9 coupled to the building structure 8. The transmitting coil 9 is further coupled to a power source 9*a*, such as the power grid. The receiving coil 1368*b* may, for example, be positioned on the door 10 adjacent the electronic door lock 100 and/or be part thereof for alignment with the transmitting coil 9 at a lock-side location 1369 when the door 10 is closed (e.g., along the door jamb). Alternatively, the receiving coil 1328*b* may be positioned at a threshold location 1370, a hinge-side location 1371, or a header location 1372. In each instance, the receiving coil 1368*b* is in wired communication with the battery 1368*a*.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Further the methods described herein may be embodied in a computer-readable medium. The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

EMBODIMENTS

Embodiment 1

A turnkey electronic module for converting a locking device into a smart locking device, the module comprising:

a printed circuit board, the printed circuit board configured to mount within a housing of the locking device;

a processor mounted on the printed circuit board; and an electric motor in communication with the processor, electric motor being configured to actuate a locking assembly of the locking device so as to lock or unlock the locking device.

Embodiment 2

The module of embodiment 1, further comprising a sensor in communication with the processor and configured to emit an electrical signal when a user touches an inside faceplate of the locking device.

Embodiment 3

The module of embodiment 2, wherein the processor is configured to determine when the user touches the inside faceplate of the locking device by monitoring the electrical signal from the sensor, the processor being further configured to control the electric motor so as to lock or unlock the locking assembly of the locking device when the user touches the inside faceplate of the locking device.

Embodiment 4

The module of embodiment 1, further comprising an antenna in communication with the processor, the processor configured to detect electromagnetic signals and provide an electrical signal to the processor based on these electromagnetic signals.

Embodiment 5

The module of embodiment 4, wherein the processor is configured to control the electric motor so as to lock or unlock the locking assembly of the locking device when receiving determining that the electromagnetic signal received by the antenna is a lock or unlock signal.

Embodiment 6

A locking device for detecting tampering or lock picking of a locking assembly of the locking device, the device comprising:

The locking assembly having a deadbolt, the locking assembly configuring to actuate the deadbolt between a locked position and an unlocked position; a mounting plate configured to partially house the locking assembly;

a touch sensor, the touch sensor being configured to emit an electrical signal when the mounting plate is touched by a user;

an anti-picking actuator, wherein the anti-picking actuator moves between a first position that physically prevents the deadbolt from moving from the locked position to the unlocked position and a second position that allows the deadbolt to move between the locked position and the unlocked position; and a processor in communication with the touch sensor and the anti-picking actuator, the processor configured to determine when the electrical signal emitted from the touch sensor indicates that the locking assembly is being picked or tampered with by the user and actuate the anti-picking actuator to the first position when the processor determines that the locking assembly is being picked or tampered with.

Embodiment 7

The device of embodiment 6, wherein the processor is configured to actuate the anti-picking actuator to the second position when the processor determines that the locking assembly is no longer picked or tampered with.

Embodiment 8

An electronic locking device, the device comprising:

a locking assembly having a deadbolt, wherein the locking assembly is configured to move the deadbolt between an unlocked position and a locked position;

the electronic locking device being configured to be at least partially disposed within a cavity formed within a door that utilizes the electronic locking device;

a battery pouch for containing a battery for powering electronics of the electronic locking device, the battery pouch being configured to extend and be housed substantially within the cavity formed within the door when the locking assembly is attached to the door.

Embodiment 9

An electronic door lock for use with an existing deadbolt lock comprising:

a deadbolt operator that is operatively coupleable to the deadbolt lock;

a touch detector that is operatively coupleable to the deadbolt lock to detect touch to the deadbolt lock; and a controller that selectively operated the deadbolt operator according to the touch detected by the touch detector.

Embodiment 10

An electronic door lock comprising:

a touch detector that senses touch to a deadbolt lock capacitively;

a controller; and a deadbolt locker that is selectively operated by the controller to engage the deadbolt lock to secure the deadbolt lock according to the touch sensed by the touch detector.

Embodiment 11

An electronic door lock comprising:

a deadbolt operator that is operatively coupleable to a deadbolt lock;

an electronic key detector that is coupleable to an interior side of a door to which the deadbolt lock is coupled, and detects electronic keys in a key detection region on an exterior side of the door, the key detection region being horizontally asymmetric relative to the key detector in a coordinate system defined by a plane of the door; and a controller that selectively operates the deadbolt operator according to the detection of the electronic key with the electronic key detector.

Embodiment 12

A door position detector comprising:

an accelerometer for sensing movement of a door to which the door position detector is coupleable;

a magnetometer for sensing the magnetic field of the environment of the magnetometer; and a controller that determines whether a door to which the door position detector is coupled is in either an open position or a closed position according to the accelerometer and the magnetometer.

Embodiment 13

An electronic door lock for use with a deadbolt lock comprising:

a controller;

a touch detector that is operatively coupleable to the deadbolt lock to detect touch to the deadbolt lock;

an electronic key detector that is coupleable to an interior side of a door to which the deadbolt lock is coupled, and detects electronic keys in a key detection region on an exterior side of the door, the key detection region being horizontally asymmetric relative to the key detector in a coordinate system defined by a plane of the door;

a deadbolt operator that is operatively coupleable to the deadbolt lock and selectively operated by the controller according to the touch detected by the touch detector and the detection of the electronic key by the electronic key detector; and a deadbolt locker that is selectively operated by the controller to engage the deadbolt lock to secure the deadbolt lock according to the touch detected by the touch detector and the detection of the electronic key by the electronic key detector.

Embodiment 14

An electronic door lock for an entry door of a building structure comprising:

a controller; and an electronic key detector in communication with the controller for detecting an electronic key that is associated with the electronic door lock is in a detection region on an exterior side of the entry door, wherein the detection region is laterally asymmetric about the electronic key detector relative to a plane of the door.

Embodiment 15

The electronic door lock of embodiment 14, wherein the detection region extends laterally from the electronic key detector a first distance on a hinge-side of the entry door and a second distance on a lock-side of the door, the first distance being greater than the second distance.

Embodiment 16

The electronic door lock of embodiment 15, wherein the first distance and the second distance are measured horizontally in a door plane defined by the entry door.

Embodiment 17

The electronic door lock of embodiment 15, wherein the hinge-side of the door is determined during a setup operation in which the electronic door lock is coupled to the entry door and the entry door is moved between a closed position and an open position.

Embodiment 18

The electronic door lock of embodiment 14, wherein the key locator determines that the electronic key is in the detection region by sending a first signal having a broadcast area that is contained by the detection region and receiving a second signal sent by the electronic key in response to the first signal.

Embodiment 19

The electronic door lock of embodiment 13, wherein the key locator includes a patch antenna array with two patch antennas that cooperatively send the first signal to the broadcast area contained by the detection region.

Embodiment 20

The electronic door lock of embodiment 14, wherein the key locator determines whether the electronic key is in the detection region by calculating a key position of the electronic key, and determining whether the key position is in the detection region.

Embodiment 21

The electronic door lock of embodiment 20, wherein to calculate the key position, the key locator sends a first signal that is broadcast beyond the detection region, receives a second signal sent by the electronic key in response to the first signal, and calculates the key position according to an angle of arrival of the second signal and one or more of a signal strength or a time of arrival of the second signal.

Embodiment 22

The electronic door lock of embodiment 20, wherein the key locator includes an omnidirectional antenna that sends the first signal and receives the second signal and includes an array of at least two antennas.

Embodiment 23

The electronic door lock of embodiment 14, wherein the key locator determines that the electronic key is in the detection region by sending a first signal to a first detection zone, and receiving a second signal sent by the electronic key in response to the first signal with a first antenna corresponding to the first detection zone but not with a second antenna corresponding to a second detection zone that overlaps the first detection zone and not a third antenna corresponding to a third detection zone that overlaps the first detection zone.

Embodiment 24

The electronic door lock of embodiment 14, further comprising a motor electronically selectively operated by the controller to operate a deadbolt to unlock the entry door upon detecting the electronic key in the detection region.

Embodiment 25

The electronic door lock of embodiment 24, further comprising a touch detector electronically coupled to the controller for detecting a touch on the exterior side of the entry door, and upon detecting the touch, the electronic key detector detects whether the electronic key is in the detection region.

Embodiment 26

The electronic door lock of embodiment 25, wherein the touch detector is electronically coupleable to the deadbolt, whereby the deadbolt functions as an electrode of the touch detector for detecting the touch.

Embodiment 27

An electronic door lock for use with a deadbolt lock for a door, the deadbolt lock having a bolt movable between an extended position and a retracted position and having a locking arm rotatable between a non-locking position and a locking position in which the locking arm engages the bolt to prevent retraction from the extended position, the electronic door lock comprising:

a controller; and a deadbolt locker having a locking actuator that, when coupled to the deadbolt lock, is selectively operated by the controller to prevent rotation of the locking arm from the locking position to the non-locking position.

Embodiment 28

The electronic door lock of Embodiment 27, further comprising an electronic key detector for detecting an electronic key associated with the electronic door lock, and one or more of a touch sensor for detecting touch, a movement sensor for detecting rotation of a pin by which deadbolt lock is operated, or an accelerometer for detecting acceleration of the door;

wherein the locking actuator includes a block that, when the locking actuator is selectively operated by the controller and torque is applied to the locking arm, is moved toward an exterior side of the door to a position above the locking arm and prevents rotation of the locking arm from the locking position by transferring force from the locking arm to a surface of the door defining a bore in which the locking arm is positioned;

wherein the touch sensor detects capacitance and electrically couples to the deadbolt lock for the deadbolt lock to function as an electrode of the touch sensor; and wherein the controller selectively operates the deadbolt locker according the detection of the electronic key and one or more of the detection of the touch, the detection of the rotation, or the detection of the acceleration.

Embodiment 29

The electronic door lock of Embodiment 28, wherein the locking actuator, when selectively operated, moves toward an exterior side of the door to prevent rotation of the locking arm.

Embodiment 30

The electronic door lock of Embodiment 29, wherein the locking actuator, when selectively operated, moves to a position above the locking arm.

Embodiment 31

The electronic door lock of Embodiment 30, wherein the locking actuator includes a block that, as torque is applied to the locking arm, prevents rotation of the locking arm from the locking position by transferring force from the locking arm to a surface of the door defining a bore in which the locking arm is positioned.

Embodiment 32

The electronic door lock of Embodiment 27, further comprising the deadbolt lock.

Embodiment 33

The electronic door lock of Embodiment 27, further comprising one or more of a touch sensor for detecting touch, a movement sensor for detecting rotation of a pin by which deadbolt lock is operated, or an accelerometer for detecting acceleration of the door, wherein the controller selectively operates the deadbolt locker according to one or more of the touch, the rotation, or the acceleration.

Embodiment 34

The electronic door lock of Embodiment 33, wherein the electronic door lock includes the touch sensor, the movement sensor, and the accelerometer; and wherein the controller selectively operates the deadbolt locker according to the touch, the rotation, and the acceleration.

Embodiment 35

The electronic door lock of Embodiment 33, wherein the touch is erratic touch that is detected with the touch sensor, and the controller selectively operates the deadbolt locker according to the erratic touch.

Embodiment 36

The electronic door lock of Embodiment 35, wherein the touch sensor is a capacitive sensor, and the erratic touch is detected if changes in capacitance exceed a capacitance change threshold.

Embodiment 37

The electronic door lock of Embodiment 33, wherein the touch sensor detects capacitance and electrically couples to the deadbolt lock for the deadbolt lock to function as an electrode of the touch sensor.

Embodiment 38

The electronic door lock of Embodiment 33, wherein if a full rotation of the pin through a range of motion is detected with the movement sensor, the deadbolt locker is not operated.

Embodiment 39

The electronic door lock of Embodiment 27, further comprising an electronic key detector, wherein upon detection of an electronic key associated with the electronic door lock, the deadbolt locker is not operated.

Embodiment 40

An electronic door lock comprising:

a touch sensor electrically connectable to a deadbolt lock to detect touch thereto;

a locking actuator movable to mechanically block the deadbolt lock; and a controller that selectively operates the locking actuator according to the touch detected by the touch sensor.

Embodiment 41

The electronic door lock according to Embodiment 40, further comprising one or more of a movement sensor for detecting rotation of a pin by which the deadbolt lock is operated, or an accelerometer by which acceleration of the electronic door lock is determined.

Embodiment 42

The electronic door lock according to Embodiment 41, comprising the movement sensor and the accelerometer, wherein the controller selectively operates the locking actuator according to the touch detected, the rotation detected, and the acceleration detected.

Embodiment 43

An electronic door lock for operating a deadbolt lock of a door, the electronic door lock comprising;

one or more of a deadbolt operator that locks and unlocks the deadbolt lock or a deadbolt locker that prevents unlocking of the deadbolt lock;

a touch sensor that is electrically coupleable to the deadbolt lock for detecting touch thereof;

a movement sensor for sensing rotation of a pin that is rotatable for operating the deadbolt lock;

an accelerometer for measuring acceleration of the door; and a controller that selectively operates the one or more of the deadbolt operator or the deadbolt locker according to the touch sensor, the movement sensor, and the accelerometer.

Embodiment 44

The electronic door lock according to Embodiment 43, further comprising an electronic key detector, wherein the controller selectively operates the one or more of the deadbolt operator or the deadbolt locker according to detection with the electronic key detector an electronic key associated with the electronic door lock.

Embodiment 45

The electronic door lock according to Embodiment 44, comprising the deadbolt operator and the deadbolt locker.

Embodiment 46

The electronic door lock according to Embodiment 44, wherein the controller selectively operates the deadbolt operator according to the touch sensor and the electronic key detector, and the controller selectively operates the deadbolt operator according to the touch sensor, the movement sensor, and the accelerometer.

What is claimed is:

1. An electronic door lock for use with a deadbolt lock for a door, the deadbolt lock of a type having a bolt movable between an extended position and a retracted position and having a locking arm rotatable between a non-locking position and a locking position in which the locking arm prevents movement of the bolt from the extended position to the retracted position, the electronic door lock comprising:

a controller; and a deadbolt locker having a locking actuator that is selectively operated by the controller to prevent rotation of the locking arm from the locking position to the non-locking position;

wherein the locking actuator is movable between a first position in which the locking actuator is extended and prevents rotation of the locking arm from the locking position to the non-locking position and a second position in which the locking actuator is retracted and allows rotation of the locking arm between the locking position and the non-locking position.

2. The electronic door lock according to claim 1, further comprising a deadbolt operator, and a touch sensor;

wherein the deadbolt operator rotates a tailpiece of the deadbolt lock to moves the bolt between the extended position and the retracted position;

wherein the touch sensor detects capacitance and is electrically coupleable to the deadbolt lock for the deadbolt lock to function as an electrode of the touch sensor to sense capacitance therewith; and wherein the controller selectively operates each of the deadbolt locker and the deadbolt operator according to the touch sensor.

3. The electronic door lock according to claim 1, wherein in the first position, the locking actuator is positioned above the locking arm of the deadbolt lock to be engaged thereby to prevent rotation thereof.

4. The electronic door lock according to claim 1, wherein the locking actuator moves toward an exterior side of the door when moved from the second position to the first position.

5. The electronic door lock according to claim 4, wherein the locking actuator moves between the first position and the second position transversely relative to movement of the bolt between the extended position and the retracted position.

6. The electronic door lock according to claim 1, wherein the locking actuator prevents rotation of the locking arm from the locking position to the non-locking position by transferring force from the locking arm to a surface of the door defining a bore in which the locking arm is positioned.

7. The electronic door lock according to claim 6, wherein the locking actuator includes a locking block that, when the locking actuator is in the first position, engages the surface of the door and the locking arm of the deadbolt lock.

8. The electronic door lock according to claim 1, further comprising one or more of a touch sensor for detecting touch, a movement sensor for detecting rotation of a pin by which the deadbolt lock is operated to move the bolt between the extended position and the retracted position, or an accelerometer for detecting acceleration of the door, wherein the controller operates the deadbolt locker according to one or more of the touch, the rotation of the pin, or the acceleration.

9. The electronic door lock according to claim 8, wherein the electronic door lock includes the touch sensor, the movement sensor, and the accelerometer; and the controller selectively operates the deadbolt locker according to the touch, the rotation of the pin, and the acceleration.

10. The electronic door lock according to claim 8, wherein the controller selectively operates the deadbolt locker according to erratic touch.

11. The electronic door lock according to claim 10, wherein the touch sensor is a capacitive sensor, and the erratic touch is detected if changes in capacitance exceed a capacitance change threshold.

12. The electronic door lock according to claim 8, comprising the touch sensor, wherein the touch sensor detects capacitance and electrically couples to the deadbolt lock for the deadbolt lock to function as an electrode of the touch sensor.

13. The electronic door lock according to claim 1, further comprising an electronic key detector, wherein upon detection of an electronic key associated with the electronic door lock, the deadbolt locker is not operated.

14. The electronic door lock according to claim 1, further comprising a deadbolt operator that is controlled by the controller to operate the deadbolt lock to move the bolt between the extended position and the retracted position.

15. The electronic door lock according to claim 1, further comprising a capacitive sensor that is electrically coupleable to the deadbolt lock for the deadbolt lock to function as an electrode of the capacitive sensor to sense capacitance therewith, and the controller operates the deadbolt locker according to the capacitance sensed with the deadbolt lock.

16. An electronic door lock for operating a deadbolt lock of a door, the electronic door lock comprising;

a deadbolt operator that locks and unlocks the deadbolt lock;

a threaded fastener;

a touch sensor that is conductively coupleable with the threaded fastener to the deadbolt lock for detecting touch of the deadbolt lock; and a controller that selectively operates the deadbolt operator according to the touch sensor.

17. The electronic door lock according to claim 16, wherein the touch sensor includes a conductive contact that is conductively engaged by the threaded fastener.

18. The electronic door lock according to claim 17, wherein the electronic door lock is configured to be mounted to the door with the threaded fastener.

19. The electronic door lock according to claim 16, further comprising a deadbolt locker, and the controller selectively operates the deadbolt locker to prevent unlocking of the deadbolt lock.

20. An electronic door lock comprising:

a touch sensor electrically connectable to a deadbolt lock to detect touch thereto;

a deadbolt operator having an electric motor for extending and retracting a deadbolt mechanism of the deadbolt lock;

a locking actuator movable to mechanically block the deadbolt lock; and a controller that selectively operates each of the locking actuator and the deadbolt operator according to the touch detected by the touch sensor.

* * * * *